US006346372B1

(12) United States Patent
Yoshikawa et al.

(10) Patent No.: US 6,346,372 B1
(45) Date of Patent: Feb. 12, 2002

(54) SILVER HALIDE PHOTOGRAPHIC LIGHT-SENSITIVE MATERIAL

(75) Inventors: Masaru Yoshikawa; Hirotomo Sasaki; Atsushi Matsunaga, all of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/611,309

(22) Filed: Jul. 6, 2000

(30) Foreign Application Priority Data

| | | |
|---|---|---|
| Jul. 7, 1999 | (JP) | 11-193598 |
| Jul. 22, 1999 | (JP) | 11-207959 |
| Mar. 30, 2000 | (JP) | 12-094527 |

(51) Int. Cl.[7] ..... G03C 1/09

(52) U.S. Cl. ..... 430/567; 430/601; 430/603; 430/605; 430/600

(58) Field of Search ..... 430/600, 603, 430/601, 605, 567

(56) References Cited

U.S. PATENT DOCUMENTS

| | | | | | |
|---|---|---|---|---|---|
| 5,220,030 | A | * | 6/1993 | Deaton | 430/605 |
| 5,376,522 | A | * | 12/1994 | Takiguchi et al. | 430/605 |
| 5,912,112 | A | * | 6/1999 | Lok et al. | 430/605 |
| 5,945,270 | A | * | 8/1999 | Lok et al. | 430/605 |

* cited by examiner

*Primary Examiner*—Richard L. Schilling
(74) *Attorney, Agent, or Firm*—Sughrue Mion, PLLC

(57) ABSTRACT

A silver halide photographic light-sensitive material is disclosed, comprising a support having thereon at least one silver halide emulsion layer, which contains at least one compound represented by formula (1) or (A-1).

26 Claims, No Drawings

SILVER HALIDE PHOTOGRAPHIC LIGHT-SENSITIVE MATERIAL

FIELD OF THE INVENTION

The present invention relates to a silver halide photographic light-sensitive material, more specifically, the present invention relates to a silver halide photographic light-sensitive material favored with high sensitivity, small generation of fogging, high contrast, small increase in the fog during a long-term storage of the light-sensitive material and small fluctuation in the sensitivity due to aging after the exposure.

BACKGROUND OF THE INVENTION

The silver halide emulsion for use in silver halide photographic light-sensitive materials is usually subjected to chemical sensitization using various chemical substances so as to obtain desired sensitivity, gradation and the like. Representative known examples of the chemical sensitization include sulfur sensitization, selenium sensitization, tellurium sensitization, noble metal sensitization using gold or the like, reduction sensitization and combinations thereof. In recent years, the silver halide photographic light-sensitive material is strongly demanded to have high sensitivity, excellent graininess, high sharpness and rapid processability for allowing expedited progress of the development or the like and to this purpose, various improvements have been made on the above-described sensitization methods. Among these, most commonly used is the gold-sulfur sensitization method using a so-called labile sulfur compound capable of reacting with silver ion to produce silver sulfide, and a gold compound. This sensitization method is specifically described, for example, in P. Grafkides, *Chimie et Physique Photographique*, 5th ed., Paul Montel (1987), T. H. James (compiler), *The Theory of the Photographic Process*, 4th ed., Macmillan (1977), and H. Frieser, *Die Grundlagen der Photographischen Prozesse mit Silber-halogeniden*, Akademische Verlagasgeselshaft (1968).

In general, for applying the gold-sulfur sensitization to a silver halide emulsion, a method of separately adding a labile sulfur compound capable of reacting with the silver ion to generate silver sulfide, and a gold compound is used. This method is described in the above-described publications and additionally in *Nippon Shashin Gakkai Shi* (*Journal of Japan Photographic Society*), Vol. 50, No. 2, page 108 et seq. (1987), *Journal of the Optical Society of America*, Vol. 39, No. 6, page 494 et seq. (1949) and the like.

In the methods described in these publications, a chloroauric acid is used as the gold compound and a thiourea compound or a thiosulfate is used as the labile sulfur compound. However, with use of these compounds, various problems are present, for example, the degree of increase in the sensitivity is not satisfied, fogging readily occurs, the gradation is in low contrast and when the light-sensitive material is stored for a long period of time, fog is seriously generated. Means for solving these problems are strongly demanded.

On the other hand, with respect to the method of applying gold-sulfur sensitization using a gold compound other than the chloroauric acid, methods of using a gold complex of thioethers described in JP-B-38-6447 (the term "JP-B" as used herein means an "examined Japanese patent publication") and JP-A-62-85239 (the term "JP-A" as used herein means an "unexamined published Japanese patent application"), a gold complex of rhodanines described in JP-A-1-147537, a gold complex of mesoions described in JP-A-4-267249, a gold complex of hydantoins described in JP-A-4-268550, or a gold complex of water-soluble group-containing mercapto compounds described in JP-B-45-8831 and EP-A-915371 are known. These compounds all are, however, incapable of satisfactorily solving the above-described problems.

JP-A-4-67032, JP-A-4-75053 and JP-A-4-86649 describe gold complex compounds having an improvement effect on the increase of fog due to aging of the light-sensitive material over a long period of time, and on the resulting deterioration in graininess; and also, JP-A-3-266828 discloses an example of using a gold complex obtained by coordinating a thiourea as the sulfur sensitizer to a trivalent gold ion. However, these compounds all are incapable of exhibiting satisfactory action to solve the above-described problems, either.

Furthermore, JP-A-4-204724 describes a method for applying gold-selenium sensitization to a silver halide emulsion, where a labile selenium compound capable of reacting with silver ion to produce silver selenide, and a gold compound are separately added. However, in this case, fog seriously increases and the above-described problems cannot be solved.

Particularly, in an internal latent image-type direct positive silver halide emulsion, the gold sensitization speck is known to act as an effective sensitization center at the chemical sensitization of the core but, as conventionally acknowledged, also form fogged nuclei giving rise to the reduction in the density of the reversal positive performance due to the excess use of the gold sensitizer (e.g., chloroauric acid) or the prolonged post-ripening time. Therefore, it is keenly demanded to form a high-sensitivity gold sensitization center while reducing the formation of fogged nuclei as much as possible.

In the photographic art, the mercapto compound is well known to have an effect of preventing fogging and is used by coordinating it to a gold complex. For example, there are known a method of using a complex in which a mercapto compound is one-coordinated to gold described in JP-A-8-69075, a method of using a gold complex of a mercapto compound substituted by a sulfonic acid group described in JP-B-45-8831, a method of using a gold complex of a two-coordinate and symmetric water-soluble group-containing mercapto compound described in European Patent 915371, a method of using a gold complex in which a tetra-substituted thiourea and a heterocyclic mercapto compound are coordinated at the same time to gold described in U.S. Pat. No. 5,912,111, a method of using a gold complex having asymmetrically coordinated therein a heterocyclic mercapto compound and a mesoionic compound described in U.S. Pat. No. 5,912,112, and a method of using an asymmetric gold complex having coordinated therein a mercapto compound and at the same time a thiosulfonic acid compound described in JP-A-9-118685. However, these methods are still deficient particularly in the fog/sensitivity ratio and cannot solve the above-descried problems.

SUMMARY OF THE INVENTION

The present invention has been made under these circumstances and the object of the present invention is to provide a silver halide photographic light-sensitive material favored with low fog, high sensitivity, small generation of fog during a long-term storage, small fluctuation in the sensitivity due to aging after the exposure, and high contrast by using a specific gold complex.

The above-described object can be attained by the silver halide photographic light-sensitive material described below.

[1] A silver halide photographic light-sensitive material comprising a support having thereon at least one silver halide emulsion layer, which contains at least one compound represented by the following formula (1) or (A-1):

$$\{L^1—A^1—Y^1—Au(I)—Y^2—A^2—L^2\}X_n \quad (1)$$

wherein $L^1$ and $L^2$, which may be the same or different, each represents a group containing a labile sulfur group, labile selenium group or labile tellurium group capable of reacting with silver halide to produce silver sulfide, silver selenide or silver telluride, $Y^1$ and $Y^2$, which may be the same or different, each represents a coordination group capable of forming a complex with gold, $A^1$ and $A^2$, which may be the same or different, each represents a divalent linking group or a mere bond, X represents a counter salt necessary for neutralizing the electric charge of the compound, and n represents a number of from 0 to 1:

$$\{B^1—Au(I)—B^2\}X_n \quad (A\text{-}1)$$

wherein $B^1$ and $B^2$, which may be the same or different, each represents an azole compound, $B^2$ represents a compound containing at least one of a labile sulfur group, a labile selenium group and a labile tellurium group each capable of reacting with silver halide to produce silver sulfide, silver selenide or silver telluride, a hydantoin compound, a phosphine compound, a halogen atom, a thioether compound, a mesoionic compound or $R^1$—S, $R^1$ represents an aliphatic hydrocarbon group, an aryl group, a heterocyclic group, an acyl group or a sulfonyl group, X represents a counter anion or cation necessary for neutralizing the electric charge of the compound, and n represents a number of from 0 to 1.

[2] The silver halide photographic light-sensitive material as described in [1], wherein the compound represented by formula (1) is a symmetric compound where $L^1$ and $L^2$, $Y^1$ and $Y^2$, and $A^1$ and $A^2$ in respective pairs are the same.

[3] The silver halide photographic light-sensitive material as described in [1] or [2], wherein in formula (1), $L^1—A^1—Y^1$ and/or $Y^2—A^2—L^2$ have a water-soluble group.

[4] The silver halide photographic light-sensitive material as described in [1], [2] or [3], wherein in formula (1), $L^1$ and $L^2$ each contains at least one bond of C═S, C═Se, C═Te, P═S, P═Se and P═Te.

[5] The silver halide photographic light-sensitive material as described in [1], [2], [3] or [4], wherein formula (1) is represented by the following formula (2) or formula (3):

(2)

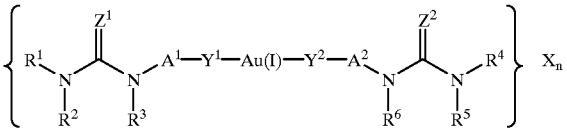

wherein $Z^1$ and $Z^2$ each represents sulfur atom, selenium atom or tellurium atom, $R^1$, $R^2$, $R^3$, $R^4$, $R^5$ and $R^6$ each represents hydrogen atom, an aliphatic hydrocarbon group, an aryl group, a heterocyclic group, an acyl group, an amino group, an alkoxy group, a hydroxy group or a carbamoyl group, provided that these may be combined to form a ring, and $Y^1$, $Y^2$, $A^1$, $A^2$, X and n have the same meanings as defined in formula (1);

(3)

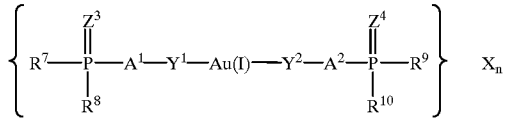

wherein $Z^3$ and $Z^4$ each represents sulfur atom, selenium atom or tellurium atom, $R^7$, $R^8$, $R^9$ and $R^{10}$ each represents an aliphatic hydrocarbon group, an aryl group, a heterocyclic group or an amino group, and $Y^1$, $Y^2$, $A^1$, $A^2$, X and n have the same meanings as defined in formula (1).

[6] The silver halide photographic light-sensitive material as described in any one of [1] to [5], wherein in formula (3), $Z^3$ and $Z^4$ each is selenium atom or tellurium atom.

[7] The silver halide photographic light-sensitive material as described in [1], [2], [3] or [4], wherein in formula (1), $L^1$ and $L^2$ each is represented by the following formula (4):

$$L^3—A^3{}_m—L^4 \quad (4)$$

wherein $L^3$ and $L^4$ each represents a group having a labile sulfur group, a labile selenium group or a labile tellurium group capable of reacting with silver halide to produce silver sulfide, silver selenide or silver telluride, $A^3$ represents a divalent or trivalent linking group, and m represents an integer of 0 or more, provided that any one of $L^3$, $L^4$ and $A^3$ is combined with $A^1$ or $A^2$ in formula (1).

[8] The silver halide photographic light-sensitive material as described in [7], wherein in formula (4), $L^3$ is a group containing a labile sulfur group capable of reacting with silver halide to produce silver sulfide, and $L^4$ is a group containing a labile selenium group capable of reacting with silver halide to produce silver selenide

[9] The silver halide photographic light-sensitive material as described in [7] or [8], wherein in formula (4), the labile sulfur group contained in $L^3$ and $L^4$ is a thiocarbonyl group (C═S) or a thiosulfonic acid group (—$SO_2S^-$), and the labile selenium group is a selenocarbonyl (C═Se) group or a phosphine selenide group (P═Se).

[10] The silver halide photographic light-sensitive material as described in any one of [1] to [9], wherein in formulae (1), (2) and (3), $Y^1$ and $Y^2$ each is an arylmercapto group or a heterocyclic mercapto group.

[11] The silver halide photographic light-sensitive material as described in any one of [1] to [10], wherein in formulae (1), (2) and (3), $Y^1$ and $Y^2$ each is a mercaptotetrazole group, a mercaptotriazole group or a mesoionic 3-mercapto-1,2,4-triazole group.

[12] The silver halide photographic light-sensitive material as described in [1], wherein the azole compound represented by $B^1$ and $B^2$ in formula (A-1) is represented by the following formula (A-2) or (A-3):

(A-2)

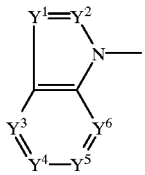

wherein $Y^1$ and $Y^2$ each independently represents nitrogen atom or C—$W^1$, $W^1$ represents hydrogen atom, an aliphatic hydrocarbon group, an aryl group, a heterocyclic group, a hydroxy group, an alkyloxy group, a halogen atom or a substituted or unsubstituted amino group, $Y^3$, $Y^4$, $Y^5$ and $Y^6$ each represents C—$W^2$ or nitrogen atom, and $W^2$ represents the same substituent as $W^1$, a carboxy group, a sulfo group, an amido group, an acyl group, a ureido group, a sulfonamido group, a sulfamoyl group, a carbamoyl group, a nitrile group or a nitro group, provided that $Y^1$ and $Y^2$, $Y^3$ and $Y^4$, $Y^4$ and $Y^5$, and $Y^5$ and $Y^6$ in respective pairs may be combined to form a ring;

(A-3)

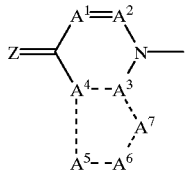

wherein $A^1$ and $A^2$ each represents nitrogen atom and/or C—$W^3$, $W^3$ represents hydrogen atom, an aliphatic hydrocarbon group, an aryl group, a heterocyclic group, a hydroxy group, an alkyloxy group, a substituted or unsubstituted amino group, a halogen atom, a nitrile group, a nitro group or a carboxy group, $A^3$ and $A^4$ each represents nitrogen atom, carbon atom or C—H, $A^5$, $A^6$ and $A^7$ each represents nitrogen atom or C—$W^4$, $W^4$ has the same meaning as $W^3$, the ring formed by $A^3$, $A^4$, $A^5$, $A^6$ and $A^7$ represents an unsaturated 5-membered ring containing two double bonds not adjacent to each other, Z represents oxygen atom or N—$W^5$, and $W^5$ represents hydrogen atom or an aliphatic hydrocarbon group, provided that $A^1$ and $A^2$, $A^5$ and $A^6$, and $A^6$ and $A^7$ in respective pairs may be combined to form a ring.

[13] The silver halide photographic light-sensitive material as described in [1] or [12], wherein in formula (A-1), $B^2$ is a compound represented by formula (A-2) or (A-3).

[14] The silver halide photographic light-sensitive material as described in [1] or [12], wherein in formula (A-1), $B^2$ is a compound containing at least one of a labile sulfur group, a labile selenium group and a labile tellurium group capable of reacting with silver halide to produce silver sulfide, silver selenide or silver telluride, a mesoionic compound or $R^1$—S.

[15] The silver halide photographic light-sensitive material as described in [1], [12], [13] or [14], wherein in formula (A-1), at least one of $B^1$ and $B^2$ has at least one water-soluble group.

[16] The silver halide photographic light-sensitive material as described in any one of [1] to [11], wherein the silver halide emulsion comprises internal latent image-type direct positive silver halide grains each having a core/shell structure consisting of a chemically sensitized core and a chemically sensitized shell, and at least one of the compounds represented by formulae (1), (2) and (3) is present at the chemical sensitization of the core and/or shell.

[17] The silver halide photographic light-sensitive material as described in any one of [1] to [16], which has at least one blue-sensitive emulsion layer, at least one green-sensitive emulsion layer, at least one red-sensitive emulsion layer and at least one hydrophilic protective colloid layer on the support

[18] The silver halide photographic light-sensitive material as described in any one of [1] to [17], which contains at least one silver halide emulsion where tabular silver halide grains having an aspect ratio of 8 or more occupy 60% or more of the entire projected area of silver halide grains contained in the silver halide emulsion containing at least one compound represented by formula (1), (2), (3) or (A-1).

[19] The silver halide photographic light-sensitive material as described in any one of [1] to [18], which contains a silver halide emulsion chemically sensitized with at least one compound represented by formula (1), (2), (3) or (A-1).

[20] The silver halide photographic light-sensitive material as described in any one of [1] to [17], which contains at least one silver halide emulsion where tabular silver halide grains having an aspect ratio of 8 or more occupy 60% or more of the entire projected area of silver halide grains contained in the silver halide emulsion chemically sensitized by at least one compound represented by formula (1), (2), (3) or (A-1).

DETAILED DESCRIPTION OF THE INVENTION

The compounds represented by formulae (1), (2), (3) and (4) for use in the present invention are described in detail below.

In formula (1), examples of the group containing a labile sulfur group capable of reacting with silver halide to produce silver sulfide, represented by $L^1$ or $L^2$, include an arylthiosulfonic acid group having from 6 to 10 carbon atoms, a thiourea group having from 6 to 10 carbon atoms and a rhodanine group having from 6 to 10 carbon atoms. Examples of the group containing a labile selenium group capable of producing silver selenide include a selenourea group, a selenoamido group, a selenoketone group, a phosphine selenide group, a selenophosphate group, a selenocarboxylic acid group, a selenoester group and an isoselenocyanate group. Examples of the group containing a labile tellurium group capable of producing silver telluride include a tellurourea group, a diacyl telluride group, a telluroamido group, a phosphine telluride group and dicarbamoyl telluride group. $L^1$ and $L^2$ each contains two or more of the above-described chalcogen groups at the same time.

In formula (1), examples of the coordination group capable of forming a complex with gold, represented by $Y^1$ or $Y^2$, include a substituted or unsubstituted linear or branched alkylmercapto group having from 1 to 20 carbon atoms, an arylmercapto group having from 6 to 20 carbon atoms (e.g., phenylmercpato, o-carboxyphenylmercapto, naphthalenemercapto), a substituted or unsubstituted 5- or 6-membered heterocyclic mercapto group (e.g., 2-mercaptopyridyl, 2-mercaptofuryl, 2-mercaptothiophene, 5-mercapto-1,2,3,4-tetrazole, 3-mercapto-1,2,4-triazole, 2-mercapto-1,3-imidazole, mesoionic-3-mercapto-1,2,4-triazole) and a substituted or unsubstituted benzo-condensed heterocyclic mercapto group (e.g., 2-mercaptobenzimidazole, 2-mercaptobenzothiazole, 2-mercaptobenzoxazole).

In formula (1), the divalent linking group represented by $A^1$ or $A^2$ include a substituted or unsubstituted linear or branched alkylene group having from 1 to 20 carbon atoms (e.g., methylene, ethylene, trimethylene, isopropylene, tetramethylene, hexamethylene, 3-oxapentylene, 2-hydroxytrimethylene), a substituted or unsubstituted cyclic alkylene group having from 3 to 18 carbon atoms (e.g., cyclopropylene, cyclopentylene, cyclohexylene), a substituted or unsubstituted alkenylene group having from 2 to 20 carbon atoms (e.g., ethene, 2-butelene), an alkynylene group having from 2 to 10 carbon atoms (e.g., ethine), a substituted or unsubstituted o-, m- or p-phenylene group having from 6 to 20 carbon atoms (e.g., unsubstituted p-phenylene), a substituted or unsubstituted naphthylene group having from 10 to 20 carbon atoms (e.g., unsubstituted 2,5-naphthylene), a heterocyclic linking group (e.g., 2,6-pyridylene), a carbonyl group (—CO—), a thiocarbonyl group (—CS—), an imido group (—CN—), a sulfonyl group (—$SO_2$—), a sulfone group (—SO—), an ester group (—$CO_2$—), a thioester group (—C(=O)S—), an amido group (—C(=O)N—), an ether group (—O—), a thioether group (—S—), an amino group (—N—), a ureido group (—NC(=O)N—), a thioureido group (—NC(=S)N—) and a thiosulfonyl group (—$SO_2$S—). Two or more of these divalent linking groups may be combined with each other to newly form a divalent linking group.

In formula (1), $L^1$, $L^2$, $Y^1$, $Y^2$, $A^1$ and $A^2$ each may have a substituted, if possible, and examples of the substituent include a halogen atom (e.g., fluorine, chlorine, bromine), an aliphatic hydrocarbon group (e.g., methyl, ethyl, isopropyl, n-propyl, t-butyl, n-octyl, cyclopentyl, cyclohexyl), an alkenyl group (e.g., allyl, 2-butenyl, 3-pentenyl), an alkynyl group (e.g., propargyl, 3-pentynyl), an aralkyl group (e.g., benzyl, phenethyl), an aryl group (e.g., phenyl, naphthyl, 4-methylphenyl), a heterocyclic group (e.g., pyridyl, furyl, imidazolyl, piperydinyl, morphoryl), an alkoxy group (e.g., methoxy, ethoxy, butoxy, 2-ethylhexyloxy, ethoxyethoxy, methoxyethoxy), an aryloxy group (e.g., phenoxy, 2-naphthyloxy), an amino group (e.g., unsubstituted amino, dimethylamino, diethylamino, dipropylamino, dibutylamino, ethylamino, dibenzylamino, anilino), an acylamino group (e.g., acetylamino, benzoylamino), a ureido group (e.g., unsubstituted ureido, N-methylureido, N-phenylureido), a thioureido group (e.g., unsubstituted thioureido, N-methylthioureido, N-phenylthioureido), a urethane group (e.g., methoxycarbonylamino, phenoxycarbonylamino), a sulfonylamino group (e.g., methylsulfonylamino, phenylsulfonylamino), a sulfamoyl group (e.g., unsubstituted sulfamoyl, N,N-dimethylsulfamoyl, N-phenylsulfamoyl), a carbamoyl group (e g., unsubstituted carbamoyl, N,N-diethylcarbamoyl, N-phenylcarbamoyl), a sulfonyl group (e.g., mesyl, tosyl), a sulfinyl group (e.g., methylsulfinyl, phenylsulfinyl), an alkyloxycarbonyl group (e.g., methoxycarbonyl, ethoxycarbonyl), an aryloxycarbonyl group (e.g., phenoxycarbonyl), an acyl group (e.g., acetyl, benzoyl, formyl, pivaloyl), an acyloxy group (e.g., acetoxy, benzoyloxy), a phosphoramido group (e.g., N,N-diethyl phosphoramido), an alkylthio group (e.g., methylthio, ethylthio), an arylthio group (e.g., phenylthio), a cyano group, a sulfo group, a thiosulfonic acid group, a sulfinic acid group, a carboxy group, a hydroxy group, a mercapto group, a phosphono group, a nitro group, a sulfino group, an ammonio group (e.g., trimethylammonio), a phosphonio group, a hydrazino group, a thiazolino group and a silyloxy group (e.g., t-butyldimethylsilyloxy, t-butyldiphenylsilyloxy). When two or more substituents are present, they may be the same or different.

In formula (1), when the counter salt represented by X is an anion, examples thereof include a halogenium ion (e.g., $F^-$, $Cl^-$, $Br^-$, $I^-$), a tetrafluoroboronate ion ($BF_4^-$), a hexafluorophosphonate ion ($PF_6^-$), a sulfate ion ($SO_4^-$), an aryl sulfonate ion (e.g , p-toluene sulfonate ion, naphthalene-2,5-disulfonate ion), a carboxy ion (e.g., acetate ion, trifluoroacetate ion, oxalate ion, benzoate ion) When the counter salt represented by X is a cation, examples thereof include an alkali metal ion (e.g., lithium cation, sodium cation, potassium cation), an alkaline earth metal ion (e.g., magnesium ion, calcium ion), a substituted or unsubstituted ammonium ion (e.g., unsubstituted ammonium ion, triethylammonium, tetramethylammonium) and a substituted or unsubstituted pyridinium ion (e.g., unsubstituted pyridinium ion, 4-phenylpyridinium ion). n is a number of X necessary for neutralizing the electric charge of the complex and represents a value of from 0 to 1. The number may be a decimal.

The compound represented by formula (1) is preferably a compound where $L^1$ and $L^2$ each is an arylsulfonic acid group, a thiourea group, a selenourea group, a selenoamido group, a selenoketone group, a phosphine selenide group, a tellurourea group, a dicarbamoyl telluride group, a phosphine telluride group or a group containing two or more of these groups at the same time; $Y^1$ and $Y^2$ each is an arylmercapto group having from 6 to 10 carbon atoms or a 5- or 6-membered heterocyclic mercapto group; $A^1$ and $A^2$ each is a substituted or unsubstituted linear or branched alkylene group having from 1 to 10 carbon atoms, a substituted or unsubstituted cyclic alkylene group having from 3 to 10 carbon atoms, a substituted or unsubstituted alkenylene group having from 2 to 10 carbon atoms, a substituted or unsubstituted phenylene group having from 6 to 15 carbon atoms, a heterocyclic linking group, a carbonyl group (—CO—), a thiocarbonyl group (—CS—), a sulfonyl group (—$SO_2$—), an ester group (—$CO_2$—), a thioester group (—C(=O)S—), an amido group (—C(=O)N—), an ether group (—O—), a thioether group (—S—), an amino group (—N—), a ureido group (—NC(=O)N—), a thioureido group (—NC(=S)N—) or a divalent linking group newly formed as a result of combining of two or more of the above-described linking groups with each other; and X is, when it is an anion, a halogenium ion, tetrafluoroboronate ion or hexafluorophosphonate ion, or when it is a cation, an alkali metal ion, an alkaline earth metal ion or an ammonium ion. Preferably, $L^1$ and $L^2$, $Y^1$ and $Y^2$, and $A^1$ and $A^2$ in respective pairs are the same to form a symmetric gold complex, more preferably, $L^1$—$A^1$—$Y^1$ and/or $Y^2$—$A^2$—$L^2$ have a water-soluble group. The water-soluble group is preferably a sulfo group, a carboxy group, a hydroxy group, an ammonium group or an amino group, more preferably a sulfo group, a carboxy group, or a hydroxy group.

The compound represented by formula (1) is more preferably a compound represented by formula (2) or (3), which is described in detail later, or a compound where L and L each is a group represented by formula (4), $Y^1$ and $Y^2$ each is a mercaptotetrazole group, a mercaptotriazole group or a mesoionic-3-mercapto-1,2,4-triazole group, $A^1$ and $A^2$ each is a substituted or unsubstituted linear or branched alkylene group having from 1 to 6 carbon atoms, a substituted or unsubstituted cyclic alkylene group having from 3 to 6 carbon atoms, a substituted or unsubstituted alkenylene group having from 2 to 6 carbon atoms, a substituted or unsubstituted phenylene group having from 6 to 12 carbon atoms, a heterocyclic linking group, a carbonyl group (—CO—), a thiocarbonyl group (—CS—), an amido group (—C(=O)N—), an ether group (—O—), a thioether group (—S—), an amino group (—N—), a ureido group (—NC(=O)N—) or a divalent linking group newly formed as a result of combining of two or more of the above-described divalent linking groups with each other.

Formula (2) which is one preferred example of formula (1) is described in detail below.

In formula (2), examples of the aliphatic hydrocarbon group represented by $R^1$, $R^2$, $R^3$, $R^4$, $R^5$ or $R^6$ include a substituted or unsubstituted linear or branched alkyl group having from 1 to 30 carbon atoms (e.g., methyl, ethyl, isopropyl, n-propyl, n-butyl, t-butyl, 2-pentyl, n-hexyl, n-octyl, t-octyl, 2-ethylhexyl, 1,5-dimethylhexyl, n-decyl, n-dodecyl, n-tetradecyl, n-hexadecyl, hydroxyethyl, hydroxypropyl, 2,3-dihydroxypropyl, carboxymethyl, carboxyethyl, sodium sulfoethyl, diethylaminoethyl, diethylaminopropyl, butoxypropyl, ethoxyethoxyethyl, n-hexyloxypropyl), a substituted or unsubstituted cyclic alkyl group having from 3 to 18 carbon atoms (e.g., cyclopropyl, cyclopentyl, cyclohexyl, cyclooctyl, adamantyl, cyclododecyl), an alkenyl group having from 2 to 16 carbon atoms (e.g., allyl, 2-butenyl, 3-pentenyl), an alkynyl group having from 2 to 10 carbon atoms (e.g., propargyl, 3-pentynyl) and an aralkyl group having from 6 to 16 carbon atoms (e.g., benzyl). Examples of the aryl group include a substituted or unsubstituted phenyl group having from 6 to 20 carbon atoms and a substituted or unsubstituted naphthyl group having from 10 to 20 carbon atoms, such as unsubstituted phenyl, unsubstituted naphthyl, 3,5-dimethylphenyl, 4-butoxyphenyl and 4-dimethylaminophenyl. Examples of the heterocyclic group include a pyridyl group, a furyl group, an imidazolyl group, a piperidyl group and a morphoryl group. Examples of the acyl group include an acetyl group, a formyl group, a benzoyl group, a pivaloyl group, a caproyl group and an n-nonanoyl group. Examples of the amino group include an unsubstituted amino group, a methylamino group, a hydroxyethylamino group, an n-octylamino group, a dibenzylamino group, a dimethylamino group and a diethylamino group Examples of the alkoxy group include a methoxy group, an ethoxy group, an n-butyloxy group, a cyclohexyloxy group, an n-octyloxy group and an n-decyloxy group. Examples of the carbamoyl group include an unsubstituted carbamoyl group, an N,N-diethylcarbamoyl group and an N-phenylcarbamoyl group. $R^1$, $R^2$, $R^3$, $R^4$, $R^5$ and $R^6$ may combine with each other to form a ring.

In formula (2), $R^1$, $R^2$, $R^3$, $R^4$, $R^5$ and $R^6$ each may have a substituent, if possible. Examples of the substituent are the same as those for the substituent which $L^1$ or $L^2$ in formula (1) may have.

In formula (2), $Y^1$, $Y^2$, $A^1$, $A^2$, X and n have the same meanings as defined in formula (1).

The compound represented by formula (2) is preferably a compound where $R^1$, $R^2$, $R^3$, $R^4$, $R^5$ and $R^6$ each is hydrogen atom, a substituted or unsubstituted linear or branched alkyl group having from 1 to 6 carbon atoms, a substituted or unsubstituted cyclic alkyl group having from 3 to 6 carbon atoms, an alkenyl group having from 2 to 6 carbon atoms, a substituted or unsubstituted phenyl group having from 6 to 10 carbon atoms, a heterocyclic group or an acyl group, and $Y^1$, $Y^2$, $A^1$, $A^2$, X and n are the same as $Y^1$, $Y^2$, $A^1$, $A^2$, X and n, respectively, in the preferred example of the compound represented by formula (1). Preferably, $Z^1$ and $Z^2$, $R^1$ and $R^4$, $R^2$ and $R^5$, $R^3$ and $R^6$, $Y^1$ and $Y^2$, and $A^1$ and $A^2$ in respective pairs are the same to form a symmetric gold complex.

The compound represented by formula (2) is more preferably a compound where $R^1$, $R^2$, $R^3$, $R^4$, $R^5$ and $R^6$ each is hydrogen atom, a substituted or unsubstituted linear or branched alkyl group having from 1 to 4 carbon atoms, a substituted or unsubstituted phenyl group having from 6 to 10 carbon atoms or an acyl group. Preferably, at least one of $R^1$, $R^2$ and $R^3$ and at least one of $R^4$, $R^5$ and $R^6$ are hydrogen atom, and more preferably, at least one water-soluble group is contained in $R^1$, $R^2$ or $R^3$ and in $R^4$, $R^5$ or $R^6$. The water-soluble group is preferably a sulfo group, a carboxy group, a hydroxy group, an ammonium group or an amino group, more preferably a sulfo group, a carboxy group or a hydroxy group. In this more preferred compound, $Y^1$, $Y^2$, $A^1$, $A^2$, X and n are the same as $Y^1$, $Y^2$, $A^1$, $A^2$, X and n, respectively, in the more preferred example of the compound represented by formula (1).

Specific examples of the compound represented by formula (2) are set forth below, however, the present invention is by no means limited thereto.

(2-1)

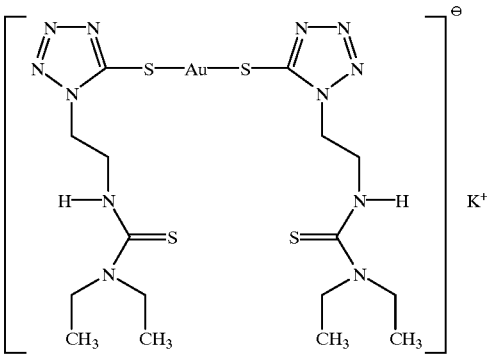

-continued
(2-2)
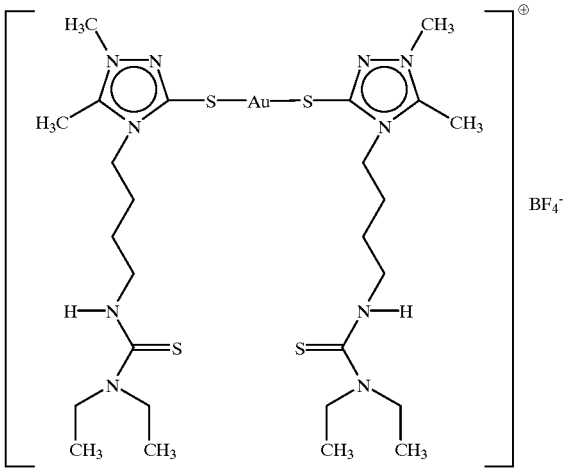
(2-3)
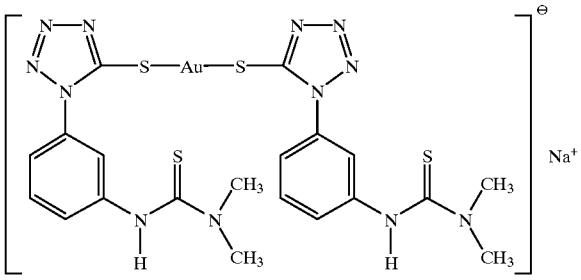
(2-4)
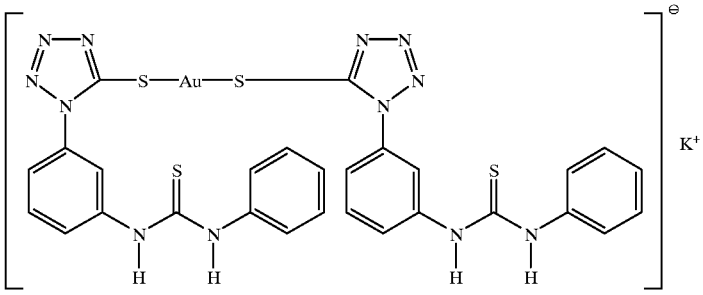
(2-5)
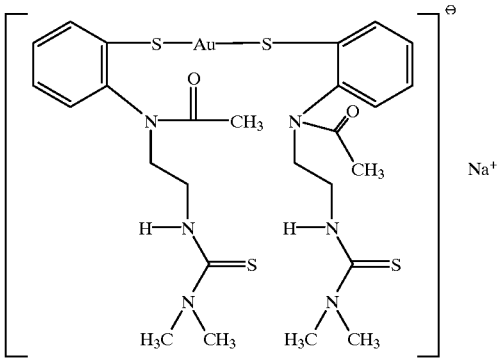

-continued
(2-6)
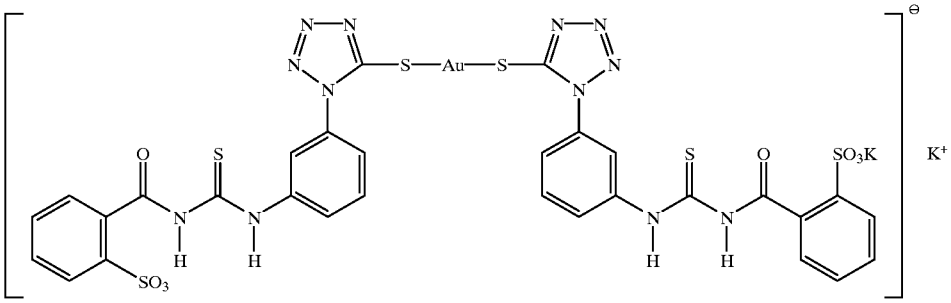
(2-7)
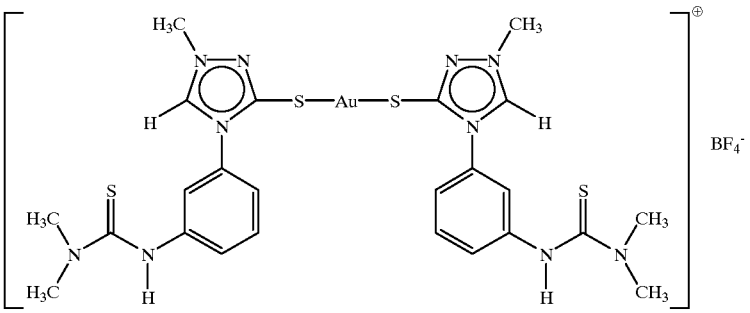
(2-8)
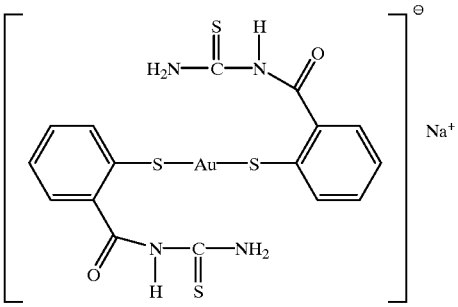
(2-9)
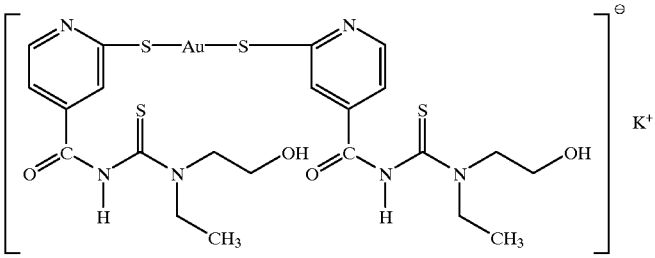

-continued (2-10)

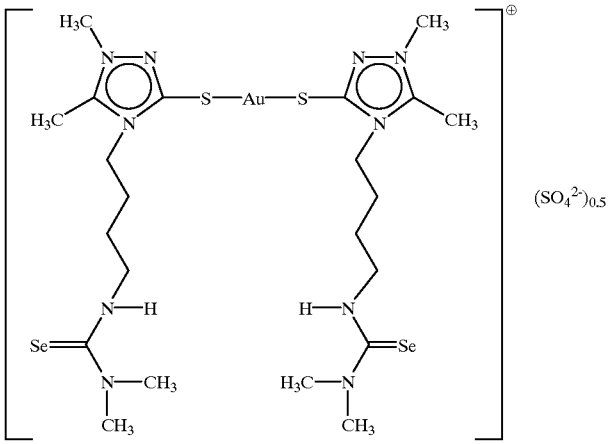

(2-11)

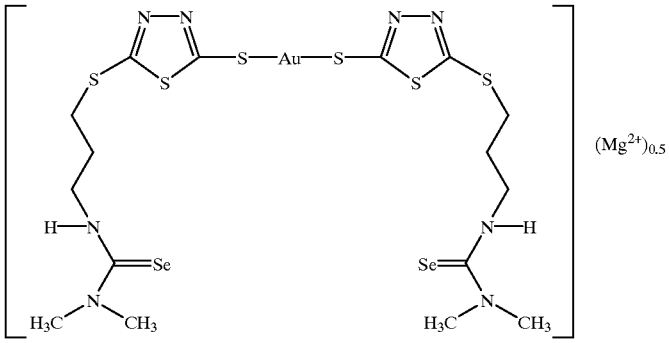

(2-12)

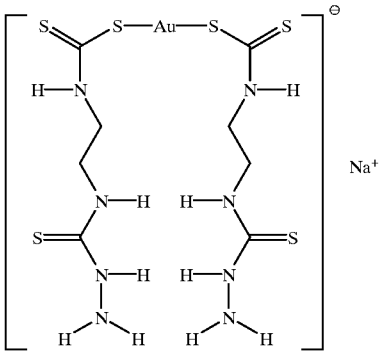

(2-13)

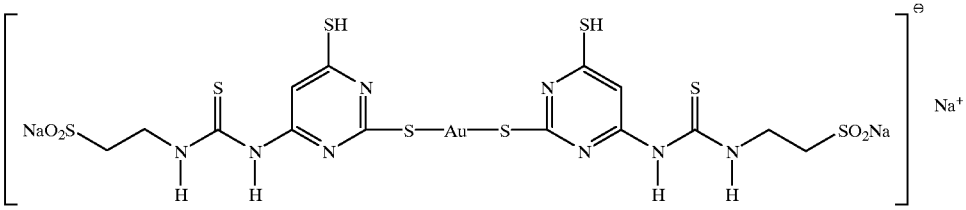

Out of these specific examples of the compound represented by formula (2), in gold complexes where $Y^1$ and $Y^2$ each is a meso-ion, the partial charge polarized on the mesoionic ligand is omitted so as to avoid confounding with the total charge of the complex ion. The circle denoting 6 non-localized π electrons on the heterocyclic moiety is shown as it is, though it does not reveal aromaticity. This is specifically shown below using mesoionic-1,4,5-trimethyl-3-mercapto-1,2,4-triazole and a gold complex thereof as an example.

(Mesoionic Compound and Gold Complex Thereof)

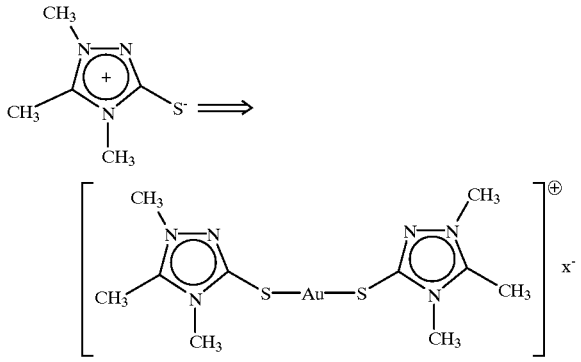

wherein X has the same meaning as defined in formula (2).

The compound represented by formula (2) can be synthesized by a known method, for example, by referring to *Chem. Rev.*, 55, 181–228 (1955), *J. Org. Chem.*, 24, 470–473 (1959), *J. Heterocycl. Chem.*, 4, 605–609 (1967), *Yaku-Shi* (*Journal of Chemicals*), 82, 36–45 (1962), JP-B-39-26203, JP-A-63-229449, OLS 2,043,944, JP-A-4-267249, JP-A-9-118685, JP-B-45-8831 and EP-A-915371.

A specific synthesis example thereof is described below.

Synthesis of Compound (2-2):

Bis(tetramethylthiourea)tetrafluoroborate gold (I) (1.21 g) was dissolved in water (30 ml) and to the resulting aqueous solution, a methanol (1 ml) solution of mesoionic-4-(4-(3,3-diethylthioureido)butyl)-1,5-dimethyl-3-mercapto-1,2,4-triazole (1.46 g) was added. After stirring for 1 hour, the reaction solution was concentrated and purified by silica gel column chromatography (elution solvent: methylene chloride/methanol=10/1) to obtain 0.81 g of Compound (2-2).

Formula (3) which is a preferred example of formula (1) is described in detail below.

In formula (3), examples of the aliphatic hydrocarbon group represented by $R^7$, $R^8$, $R^9$ or $R^{10}$ include a substituted or unsubstituted linear or branched alkyl group having from 1 to 30 carbon atoms (e.g., methyl, ethyl, isopropyl, n-propyl, n-butyl, t-butyl, 2-pentyl, n-hexyl, n-octyl, t-octyl, 2-ethylhexyl, 1,5-dimethylhexyl, n-decyl, n-dodecyl, n-tetradecyl, n-hexadecyl, hydroxyethyl, hydroxypropyl, 2,3-dihydroxypropyl, carboxymethyl, carboxyethyl, sodium sulfoethyl, diethylaminoethyl, diethylaminopropyl, butoxypropyl, ethoxyethoxyethyl, n-hexyloxypropyl), a substituted or unsubstituted cyclic alkyl group having from 3 to 18 carbon atoms (e.g., cyclopropyl, cyclopentyl, cyclohexyl, cyclooctyl, adamantyl, cyclododecyl), an alkenyl group having from 2 to 16 carbon atoms (e.g., allyl, 2-butenyl, 3-pentenyl), an alkynyl group having from 2 to 10 carbon atoms (e.g., propargyl, 3-pentynyl) and an aralkyl group having from 6 to 16 carbon atoms (e.g., benzyl). Examples of the aryl group include a substituted or unsubstituted phenyl group having from 6 to 20 carbon atoms and a substituted or unsubstituted naphthyl group having from 10 to 20 carbon atoms, such as unsubstituted phenyl group, unsubstituted naphthyl group, 3,5-dimethylphenyl group, 4-fluorophenyl group and 4-dimethylaminophenyl group. Examples of the heterocyclic group include a pyridyl group, a furyl group, an imidazolyl group, a piperidyl group and a morphoryl group. Examples of the amino group include an unsubstituted amino group, a methylamino group, a hydroxyethylamino group, an n-octylamino group, a dibenzylamino group, a dimethylamino group and a diethylamino group.

In formula (3), $R^7$, $R^8$, $R^9$ and $R^{10}$ each may have a substituent, if possible. Examples of the substituent is the same as those for the substituent which $L^1$ and $L^2$ may have.

In formula (3) $Y^1$, $Y^2$, $A^1$, $A^2$, X and n have the same meanings as defined in formula (1).

The compound represented by formula (3) is preferably a compound where $Z^3$ and $Z^4$ each is selenium atom or tellurium atom, $R^7$, $R^8$, $R^9$ and $R^{10}$ each is a substituted or unsubstituted linear or branched alkyl group having from 1 to 6 carbon atoms, a substituted or unsubstituted phenyl group having from 6 to 10 carbon atoms and/or a heterocyclic group, and $Y^1$, $Y^2$, $A^1$, $A^2$, X and n are the same as $Y^1$, $Y^2$, $A^1$, $A^2$, X and n, respectively, in the preferred example of the compound represented by formula (1). $Z^3$ and $Z^4$, $R^7$ and $R^9$, $R^8$ and $R^{10}$, $Y^1$ and $Y^2$, and $A^1$ and $A^2$ in respective pairs are preferably the same so as to form a symmetric gold complex.

The compound represented by formula (3) is more preferably a compound where $R^7$, $R^8$, $R^9$ and $R^{10}$ each is a substituted or unsubstituted phenyl group having from 6 to 10 carbon atoms, and $Y^1$, $Y^2$, $A^1$, $A^2$, X and n are the same as $Y^1$, $Y^2$, $A^1$, $A^2$, X and n, respectively, in the more preferred example of the compound represented by formula (1).

Specific examples of the compound represented by formula (3) are set forth below, however, the present invention is by no means limited thereto. In the case of $Y^1$ and $Y^2$ each is a meso-ion, the compounds are shown in the same manner as in formula (2).

(3-1)

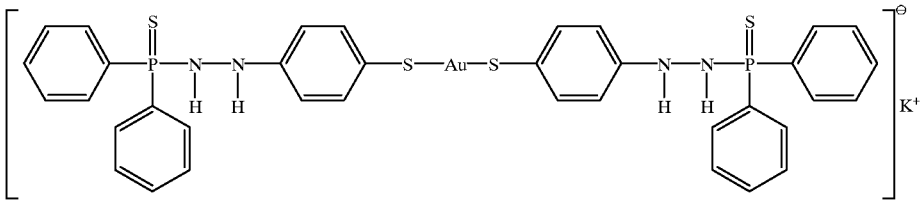

-continued
(3-2)
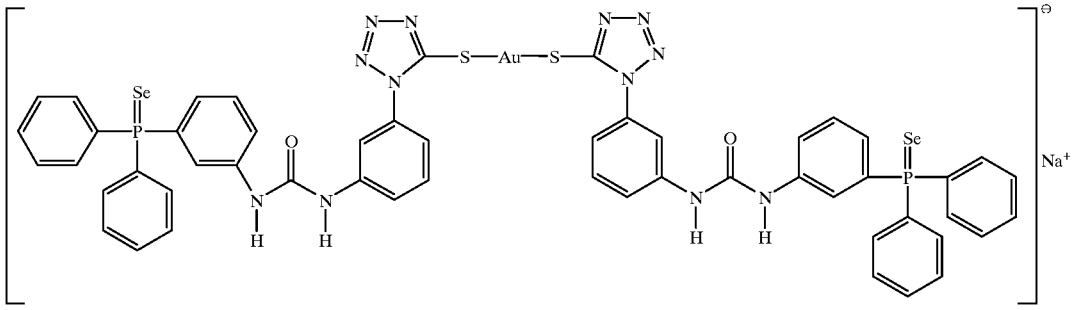
(3-3)
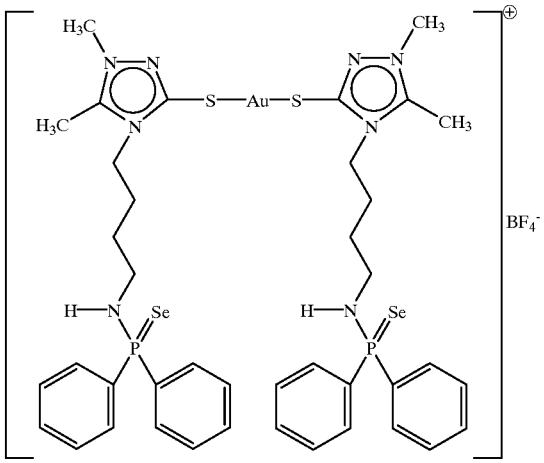
(3-4)
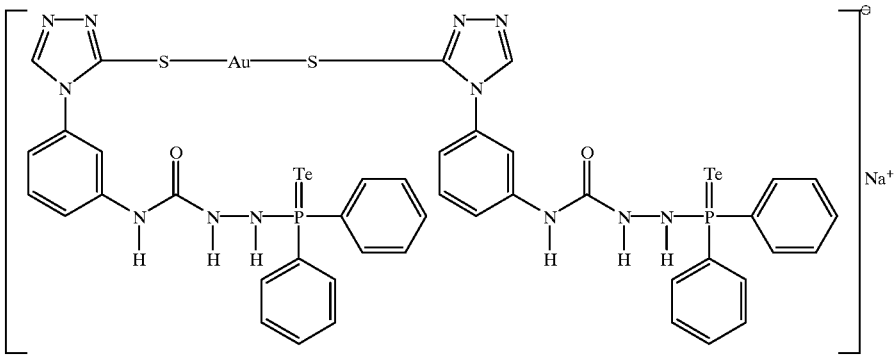
(3-5)
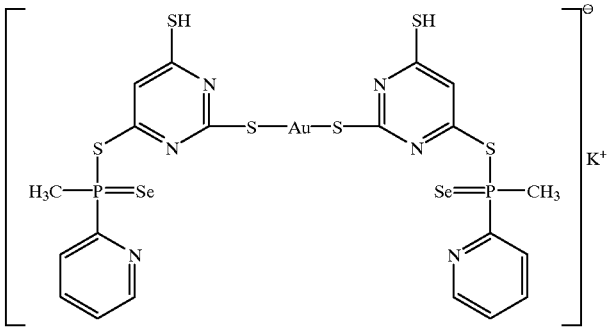

-continued (3-6)

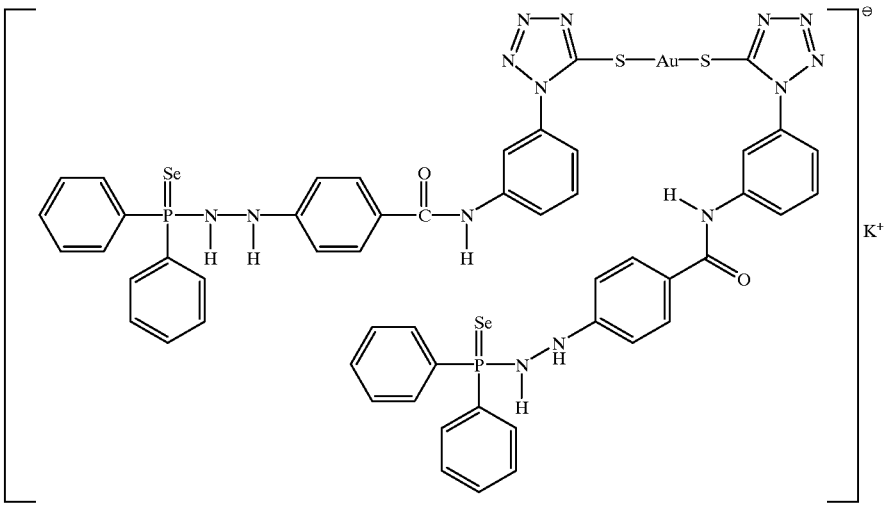

The compound represented by formula (3) of the present invention can be synthesize by a known method, for example, by referring to JP-A-5-40324, JP-A-5-224333, Japanese Patent Registered No. 2778853, JP-A-4-267249, JP-A-9-118685, JP-B-45-8831 and EP-A-915371.

A specific synthesis example is described below.

Synthesis of Compound (3-6):

Diphenylphosphine chloride (25 g) and elemental selenium (7.1 g) were refluxed under heating in toluene (100 ml) for 2 hours in an argon atmosphere, then cooled to room temperature and subsequently filtered. The filtrate obtained was gradually added dropwise to a dimethylacetamide (80 ml) solution of p-carboxyphenylhydrazine (14 g) and pyridine (13.6 ml) under ice cooling. After stirring at 40° C. for 1 hour, the reaction solution was returned to room temperature and then added to an aqueous dilute hydrochloric acid solution. The precipitated crystals were filtered and then dried to obtain 28 g of crystals (Intermediate 1). Intermediate 1 (8.3 g) and 1-m-aminophenyl-3-mercapto-1,2,3,4-tetrazole (3.8 g) were condensed by DCC (dicyclocarbodiimide, 40 g) to obtain 6.7 g of Intermediate 2 which is a ligand of Compound (3-6). Separately, an aqueous solution (7.5 ml) of potassium tetrachloroaurate (1.0 g) was added to an aqueous sodium iodide solution and then the deposited precipitate was filtered and added to a methanol solution (3.2 ml) of Intermediate 2 (6.3 g). The resulting mixture was heated at 50° C. and when homogenized, the solution was cooled to 5° C. and the precipitated crystals were filtered and then recrystallized with isopropanol to obtain 4.2 g of Compound (3-6).

Formula (4) which is one preferred example of $L^1$ and $L^2$ in formula (1) is described in detail below.

In formula (4), examples of the group containing a labile sulfur group capable of reacting with silver halide to produce silver sulfide, represented by $L^3$ and $L^4$ include thiosulfonic acid group, thiourea group, thioamido group and rhodanine group of an aryl or alkyl. Examples of the group containing a labile selenium group capable of producing silver selenide include a selenourea group, a selenoamido group, a selenoketone group, an arylphosphine selenide group, a selenophosphate group, a selenocarboxylic acid group, a selenoester group and an isoselenocyanate group. Examples of the group containing a labile tellurium group capable of producing silver telluride include a tellurourea group, a diacyl telluride group and a telluroamido group.

In formula (4), examples of the divalent linking group represented by $A^3$ include a substituted or unsubstituted linear or branched alkylene group having from 1 to 20 carbon atoms (e.g., methylene, ethylene, trimethylene, isopropylene, tetramethylene, hexamethylene, 3-oxapentylene, 2-hydroxytrimethylene), a substituted or unsubstituted cyclic alkylene group having from 3 to 18 carbon atoms (e.g., cyclopropylene, cyclopentylene, cyclohexylene), a substituted or unsubstituted alkenylene group having from 2 to 20 carbon atoms (e.g., ethene, 2-butelene), an alkynylene having from 2 to 10 carbon atoms (e.g., ethine), a substituted or unsubstituted o-, m- or p-phenylene group having from 6 to 20 carbon atoms (e.g., unsubstituted p-phenylene), a substituted or unsubstituted naphthylene group having from 10 to 20 carbon atoms (e.g., unsubstituted 2,5-naphthylene), a heterocyclic linking group (e.g., 2,6-pyridylene), a carbonyl group (—CO—), a thiocarbonyl group (—CS—), an imido group (—CN—), a sulfonyl group (—$SO_2$—), a sulfone group (—SO—), an ester group (—$CO_2$—), a thioester group (—C(=O)S—), an amido group (—C(=O) N—), a dicarbamoyl group, an ether group (—O—), a thioether group (—S—), an amino group (—N—), a ureido group (—NC(=O)N—), a thioureido group (—NC(=S)N—) and a thiosulfonyl group (—$SO_2$S—). Two or more of these divalent linking groups may be combined with each other to newly form a divalent linking group. In the case where $A^3$ is combined with $A^1$ or $A^2$ in formula (1), $A^3$ is a trivalent linking group resulting from elimination of one hydrogen atom contained in $A^3$.

The compound represented by formula (4) is preferably a compound where $L^3$ is a group containing a labile sulfur group capable of reacting with silver halide to produce silver sulfide (for example, a thiourea group, thioamido group or a thiosulfonic acid group), $L^4$ is a group containing a labile selenium group or a labile tellurium group capable of reacting with silver halide to produce silver selenide or silver telluride (for example, a selenourea group, a selenoamido group, a phosphine selenide group, a tellurourea group or a diacyl telluride group), and $A^3$ is a substituted or unsubstituted linear or branched alkylene group having from 1 to 10 carbon atoms, a substituted or unsubstituted cyclic alkylene group having from 3 to 10 carbon atoms, a substituted or unsubstituted alkenylene group having from 2 to 10 carbon atoms, a substituted or unsubstituted phenylene group having from 6 to 15 carbon atoms, a heterocyclic linking group, a carbonyl group, a sulfonyl group, an ether group, an amido group, an amino group, a ureido group or a divalent or trivalent linking group newly formed as a result of combining of these groups with each other.

The compound represented by formula (4) is more preferably a compound where $L^3$ is a thiourea group, $L^4$ is a selenourea group, a selenoamido group or phosphine selenide, $A^3$ is a substituted or unsubstituted linear or branched alkylene group having from 1 to 6 carbon atoms, a substituted or unsubstituted cyclic alkylene group having from 3 to 6 carbon atoms, a substituted or unsubstituted alkenylene group having from 2 to 6 carbon atoms, a substituted or unsubstituted phenylene group having from 6 to 12 carbon atoms, a heterocyclic linking group, a carbonyl group, an amido group, an amino group, a ureido group or a divalent or trivalent linking group newly formed as a result of linking of these linking groups with each other, and m is an integer of 1 or more (preferably 10 or less, more preferably 6 or less).

Specific examples of the compound represented by formula (4) are set forth below, however, the present invention is by no means limited thereto.

(4-1)

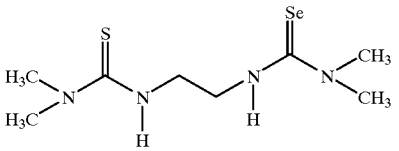

(4-2)

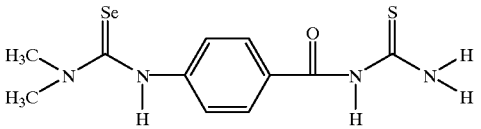

(4-3)

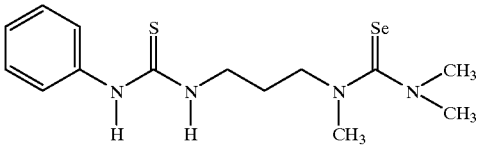

(4-4)

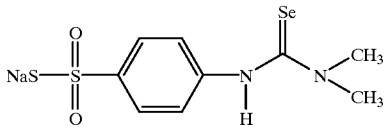

-continued (4-5)

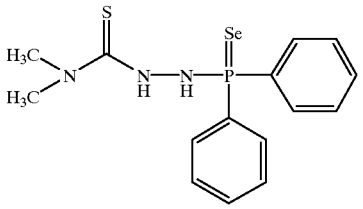

(4-6)

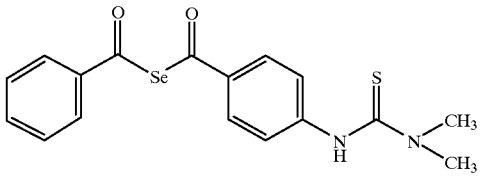

(4-7)

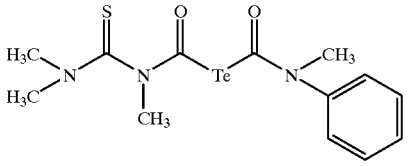

(4-8)

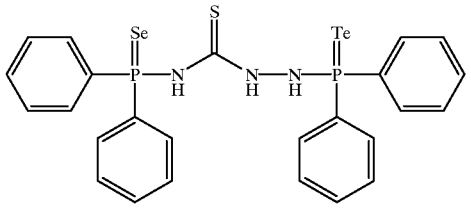

The compound represented by formula (4) of the present invention can be synthesized by a known method, for example, by referring to *Chem. Rev.*, 55, 181–228 (1955), *J. Org. Chem.*, 24, 470–473 (1959), *J. Heterocycl. Chem.*, 4, 605–609 (1967), *Yakushi* (*Journal of Chemicals*), 82, 36–45 (1962), JP-B-39-26203, JP-A-63-229449, OLS 2,043,944, JP-A-5-40324, JP-A-5-224333, Japanese Patent Registered No. 2,778,853, JP-A-6-19035 and JP-A-9-197602.

A specific synthesis example is described below.

Synthesis of Compound (4-5):

Diphenylphosphine chloride (12.5 g) and elemental selenium (3.55 g) were refluxed under heating in toluene (50 ml) for 2 hours in an argon atmosphere, then cooled to room temperature and subsequently filtered. The filtrate obtained was gradually added dropwise to a dimethylacetamide (40 ml) solution of 1,1-dimethylthiosemicarbazide (5 g) and pyridine (3.4 ml) under ice cooling. After stirring at 40° C. for 1 hour, the reaction solution was returned to room temperature and extracted with ethyl acetate. The extract solution was concentrated and the solid residue obtained was recrystallized with ethanol to obtain 9.2 g of Compound (4-5).

Specific examples of the compound represented by formula (1) are set forth below, however, the present invention is by no means limited thereto.

In the case where $Y^1$ and $Y^2$ each is a meso-ion, the compounds are shown in the same manner as in formula (2).

(1-1)
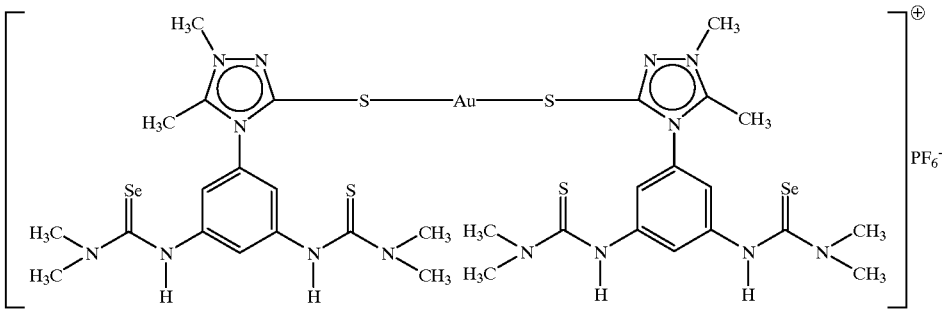
(1-2)
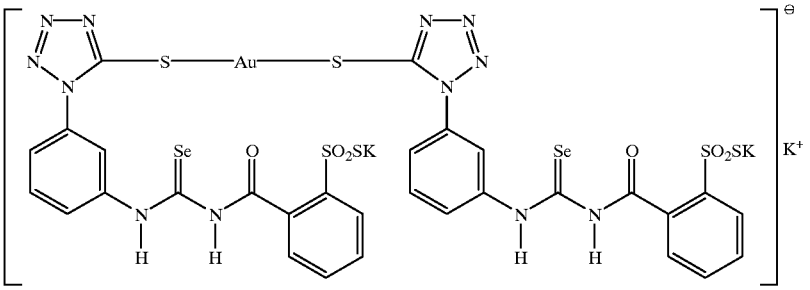
(1-3)
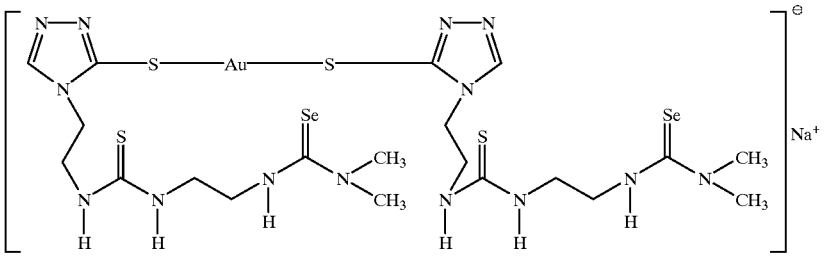
(1-4)
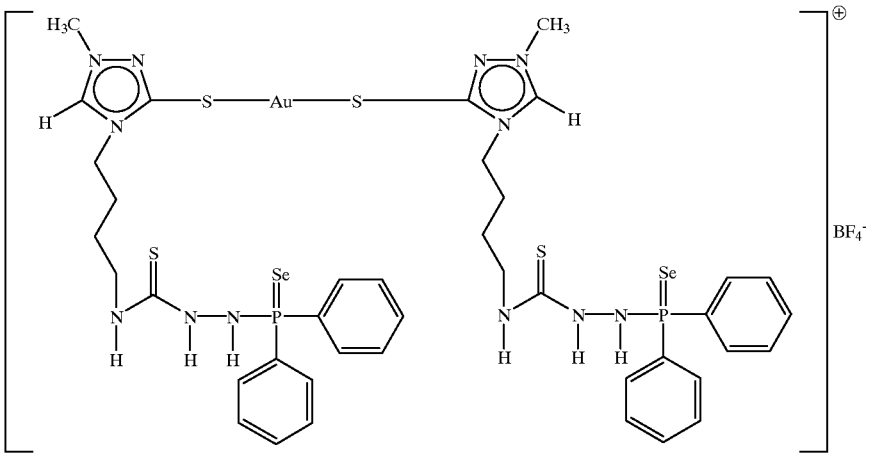

-continued
(1-5)
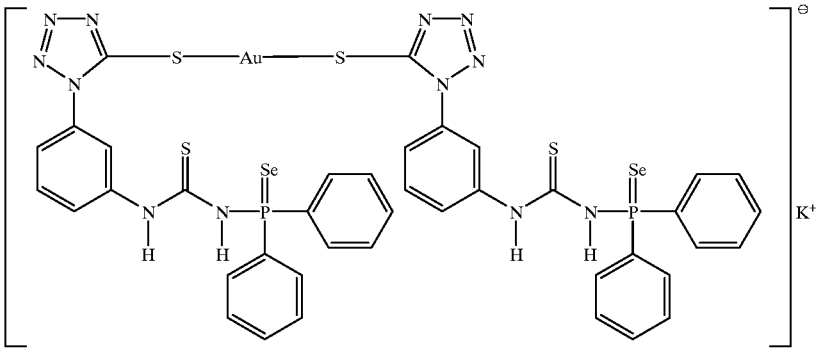
(1-6)
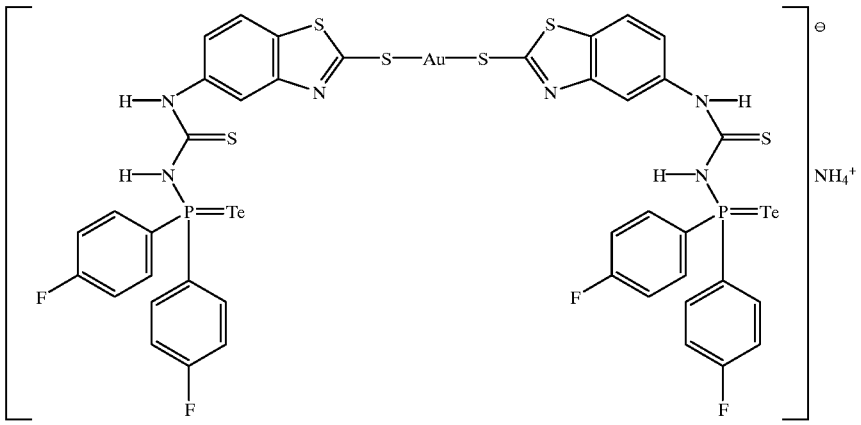
(1-7)
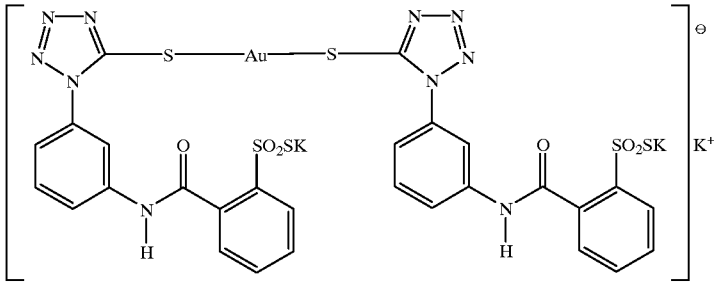

-continued (1-8)

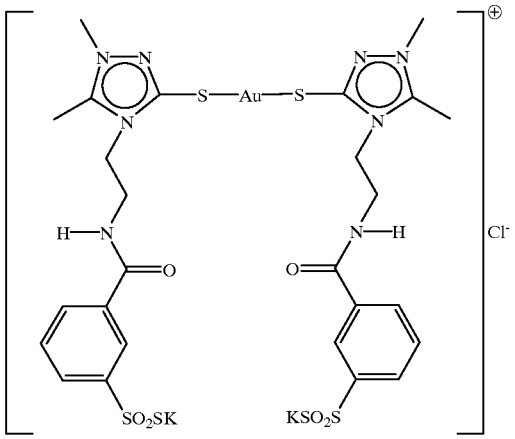

(1-9)

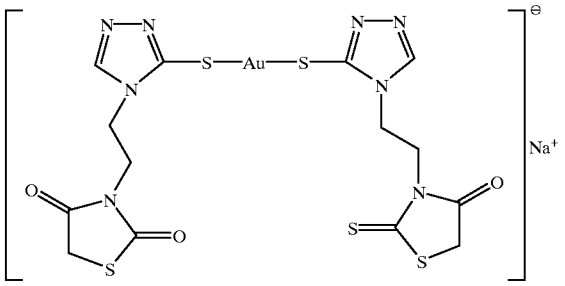

(1-10)

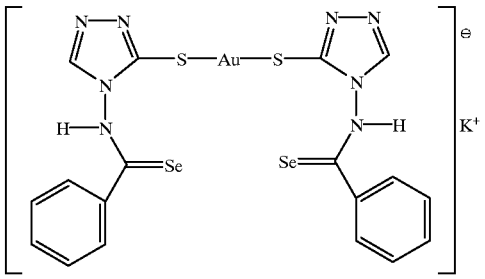

(1-11)

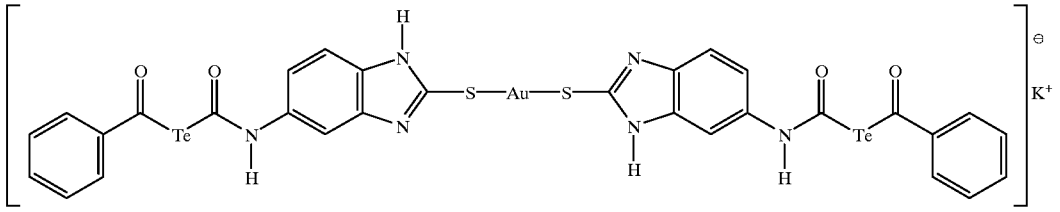

The compound represented by formula (1) of the present invention can be synthesized by a known method, for example by referring to *Chem. Rev.*, 55, 181–228 (1955), *J. Org. Chem.*, 24, 470–473 (1959), *J. Heterocycl. Chem.*, 4, 605–609 (1967), *Yakushi* (*Journal of Chemicals*), 82, 36–45 (1962), JP-B-39-26203, JP-A-63-229449, OLS 2,043,944, JP-A-5-40324, JP-A-5-224333, Japanese Patent Registered No. 2,778,853, JP-A-6-19035, JP-A-9-197602, JP-A-4-267249, JP-A-9-118685, JP-B-45-8831 and EP-A-915371.

A specific synthesis example is described below.

Synthesis of Compound (1-4):

Bis(tetramethylthiourea)terafluoroborate gold (I) (1.21 g) was dissolved in water (30 ml) and to the resulting aqueous solution, a methanol (2 ml) solution of mesoionic-4-(4-(4-(diphenylphosphine selenide)-2-thiosemicarbazide)butyl)-1-methyl-3-mercapto-1,2,4-triazole (2.4 g) was added. After stirring for 1 hour, the reaction solution was concentrated and then purified by silica gel column chromatography to obtain 1.8 g of Compound (1-4).

Formula (A-1) of the present invention is described in detail below.

The azole compound represented by $B^1$ and $B^2$ in formula (A-1) is described below. The azole compound as used herein means an unsaturated 5-membered ring compound containing at least one nitrogen atom (III) usually in valence and two double bonds not adjacent to each other (for example, pyrroles, imidazoles, pyrazoles, 1,2,3-triazoles, 1,2,4-triazoles, tetrazoles, isooxazoles, isothiazoles, oxadiazoles and thiadiazoles) or a cyclic compound containing the above-described 5-membered ring (for example, indoles, isoindoles, indolidines, indazoles, benzimidazoles, purines, benzotriazoles, carbazoles and tetraazaindenes).

The azole compound represented by $B^1$ and $B^2$ is preferably a compound represented by formula (A-2) or (A-3).

Formulae (A-2) and (A-3) are described below.

Examples of the aliphatic hydrocarbon group represented by $W^1$ and $W^2$ in formula (A-2) include a substituted or unsubstituted linear or branched alkyl group having from 1 to 30 carbon atoms (e.g., methyl, ethyl, isopropyl, n-propyl, n-butyl, t-butyl, 2-pentyl, n-hexyl, n-octyl, t-octyl, 2-ethylhexyl, 1,5-dimethylhexyl, n-decyl, n-dodecyl, n-tetradecyl, n-hexadecyl, hydroxyethyl, hydroxypropyl, 2,3-dihydroxypropyl, carboxymethyl, carboxyethyl, sodium sulfoethyl, diethylaminoethyl, diethylaminopropyl, butoxypropyl, ethoxyethoxyethyl, n-hexyloxypropyl), a substituted or unsubstituted cyclic alkyl group having from 3 to 18 carbon atoms (e.g., cyclopropyl, cyclopentyl, cyclohexyl, cyclooctyl, adamantyl, cyclododecyl), an alkenyl group having from 2 to 16 carbon atoms (e.g., allyl, 2-butenyl, 3-pentenyl), an alkynyl group having from 2 to 10 carbon atoms (e.g., propargyl, 3-pentynyl) and an aralkyl group having from 6 to 16 carbon atoms (e.g., benzyl). Examples of the aryl group include a substituted or unsubstituted phenyl group having from 6 to 20 carbon atoms and a naphthyl group having from 10 to 20 carbon atoms, such as unsubstituted phenyl, unsubstituted naphthyl, 3,5-dimethylphenyl, 4-butoxyphenyl, 4-dimethylaminophenyl and 2-carboxyphenyl. Examples of the heterocyclic group include a substituted or unsubstituted nitrogen-containing 5-membered heterocyclic ring (e.g., imidazolyl, 1,2,4-triazolyl, tetrazolyl, oxadiazolyl, thiadiazolyl, benzimidazolyl, purynyl), a substituted or unsubstituted nitrogen-containing 6-membered heterocyclic ring (e.g., pyridyl, piperidyl, 1,3,5-triazino, 4,6-dimercapto-1,3,5-triazino) and a furyl group. Examples of the alkyloxy group include a methoxy group, an ethoxy group and an isopropyloxy group. Examples of the halogen atom include fluorine atom, chlorine atom and bromine atom. Examples of the substituted amino group include a monomethylamino group, a dimethylamino group, a diethylamino group and a 2-hydroxyethylamino group.

Examples of the amido group represented by $W^2$ include an acetylamido group. Examples of the acyl group include an acetyl group and a benzoyl group. Examples of the ureido group include an unsubstituted ureido group and an N-methylureido group. Examples of the sulfonamido group include a methylsulfonamido group and a phenylsulfonamido group. Examples of the sulfamoyl group include an unsubstituted sulfamoyl group, an N,N-dimethylsulfamoyl group and an N-phenylsulfamoyl group. Examples of the carbamoyl group include an unsubstituted carbamoyl group, an N,N-diethylcarbamoyl group and an N-phenylcarbamoyl group.

$Y^1$ and $Y^2$, $Y^3$ and $Y^4$, $Y^4$ and $Y^5$, and $Y^5$ and $Y^6$ in respective pairs may be combined to form a ring and the ring formed is a 5- or 6-membered unsaturated ring. Examples of the ring include a benzene ring, a pyridine ring, a cyclopentane ring and a cyclohexane ring.

In the compound represented by formula (A-2), the position coordinated to gold is not necessarily limited to the nitrogen atom shown in formula (A-2) and any position may be used as long as it can be coordinated.

The compound represented by formula (A-2) is preferably a compound represented by the following formula (A-4), (A-5) or (A-6), more preferably a compound represented by formula (A-4).

(A-4)

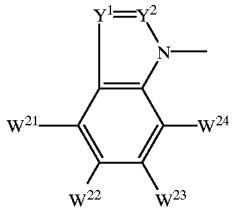

(A-5)

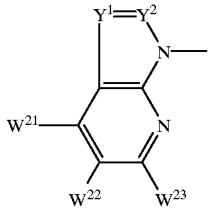

(A-6)

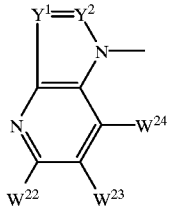

wherein $Y^1$ and $Y^2$ have the same meanings as $Y^1$ and $Y^2$ in formula (A-2), and $W^{21}$, $W^{22}$, $W^{23}$ and $W^{24}$ each has the same meaning as $W^2$ in formula (A-2), provided that either one of $W^{21}$ and $W^{23}$ in formula (A-5), and either one of $W^{22}$ and $W^{24}$ in formula (A-6) are a hydroxyl group, preferably, $W^{21}$ in formula (A-5) and $W^{24}$ in formula (A-6) are a hydroxyl group.

The compounds represented by formulae (A-4), (A-5) and (A-6) each is preferably a compound where $Y^1$ is nitrogen atom or C—H, $Y^2$ is nitrogen atom, C—H, C—OH or C—$NH_2$, and $W^{21}$, $W^{22}$, $W^{23}$ and $W^{24}$ each contains a water-soluble group. The water-soluble group is preferably a hydroxy group, an amino group, a carboxy group or a sulfo group.

The compounds represented by formulae (A-4), (A-5) and (A-6) each is more preferably a diazole compound where $Y^1$ and $Y^2$ each is nitrogen atom or C—H and at least one of them is nitrogen atom, and most preferably a triazole compound where $Y^1$ and $Y^2$ both are nitrogen atom.

Formula (A-3) is described in detail below.

In formula (A-3), the aliphatic hydrocarbon group, the aryl group, the heterocyclic group, the alkyloxy group, the substituted amino group and the halogen atom represented by $W^3$ and $W^4$ and the aliphatic hydrocarbon group represented by $W^5$ have the same meanings as the substituents described in detail for the substituents represented by $W^1$ and/or $W^2$ in formula (A-2). Also, the ring which may be formed by the combining of $A^1$ and $A^2$, $A^5$ and $A^6$, and $A^6$ and $A^7$ in respective pairs with each other has the same meaning as the ring which may be formed by the combining of $Y^1$ and $Y^2$, $Y^3$ and $Y^4$, $Y^4$ and $Y^5$, and $Y^5$ and $Y^6$ in respective pairs in formula (A-2) with each other. Examples of the unsaturated 5-membered ring having two double bonds not adjacent to each other, which is formed by $A^3$, $A^4$, $A^5$, $A^6$ and $A^7$, include an unsaturated 5-membered ring containing from 0 to 4 nitrogen atoms, such as pentadiene ring, pyrrole ring, imidazole ring, pyrazole ring, 1,2,4-triazole ring and tetrazole ring.

In the compound represented by formula (A-3), the position coordinated to gold is not necessarily limited to the nitrogen atom shown in formula (A-3) and any position may be used as long as it can be coordinated.

The compound represented by formula (A-3) is preferably a compound represented by the following formula (A-7) or (A-8), more preferably a compound represented by formula (A-7):

(A-7)

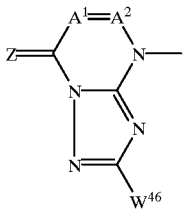

(A-8)

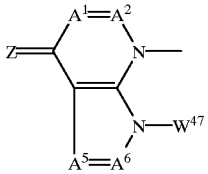

wherein $A^1$, $A^2$, $A^5$ and $A^6$ have the same meanings as those in formula (A-3), and $W^{46}$ in formula (A-7) and $W^{47}$ in formula (A-8) each has the same meaning as $W^4$ in formula (A-3).

The compounds represented by formula (A-7) and (A-8) each is preferably a compound where $A^1$ and $A^2$ each is C—$W^{31}$ or C—$W^{32}$ (wherein $W^{31}$ and $W^{32}$ each has the same meaning as $W^3$ in formula (A-3)) and Z is oxygen atom.

The compounds represented by formula (A-7) and (A-8) each is more preferably a compound where $W^{31}$ is hydrogen atom, an alkyl group having from 1 to 3 carbon atoms, a halogen atom, a nitrile group or a nitro group, and $W^{32}$ is hydrogen atom, an alkyl group having from 1 to 3 carbon atoms, a hydroxy group or a substituted or unsubstituted amino group, and most preferably a compound where $W^{45}$ in formula (A-7) and $W^{47}$ in formula (A-8) each is hydrogen atom.

Examples of the compound containing at least one labile sulfur group, labile selenium group or labile tellurium group capable of reacting with silver halide to produce silver sulfide, silver selenide or silver telluride, represented by B in formula (A-1) include thiosulfates, thioureas, thioamides, selenoureas, selenoamides, telluroureas, telluroamides, rhodanines, selenophosphates, tellurophosphates, selenoketones, selenocarboxylic acids, selenoesters, isoselenocyanates, dicarbamoyl tellurides and diacyl tellurides. The compound may have two or more of the above-described labile chalcogen groups at the same time.

Examples of the hydantoin compound represented by $B^2$ include N-methylhydantoin. Examples of the phosphine compound include triphenylphosphine and triethylphosphine. Examples of the thioether compound include a substituted or unsubstituted linear or branched thioethers having from 1 to 8 thioether groups (e.g., bishydroxyethylthioether). Examples of the mesoionic compound include mesoionic compound include mesoionic-3-mercapto-1,2,4-triazoles (e.g., mesoionic-1,4,5-trimethyl-3-mercapto-1,2,4-triazole).

When $B^2$ represents $R^1$—S, examples of the aliphatic hydrocarbon group represented by $R^1$ include a substituted or unsubstituted linear or branched alkyl group having from 1 to 30 carbon atoms (e.g., methyl, ethyl, isopropyl, n-propyl, n-butyl, t-butyl, 2-pentyl, n-hexyl, n-octyl, t-octyl, 2-ethylhexyl, 1,5-dimethylhexyl, n-decyl, n-dodecyl, n-tetradecyl, n-hexadecyl, hydroxyethyl, hydroxypropyl, 2,3-dihydroxypropyl, carboxymethyl, carboxyethyl, sodium sulfoethyl, diethylaminoethyl, diethylaminopropyl, butoxypropyl, ethoxyethoxyethyl, n-hexyloxypropyl), a substituted or unsubstituted cyclic alkyl group having from 3 to 18 carbon atoms (e.g., cyclopropyl, cyclopentyl, cyclohexyl, cyclooctyl, adamantyl, cyclododecyl), an alkenyl group having from 2 to 16 carbon atoms (e.g., allyl, 2-butenyl, 3-pentenyl), an alkynyl group having from 2 to 10 carbon atoms (e.g., propargyl, 3-pentynyl) and an aralkyl group having from 6 to 16 carbon atoms (e.g., benzyl). Examples of the aryl group include a substituted or unsubstituted phenyl group having from 6 to 20 carbon atoms and a substituted or unsubstituted naphthyl group having from 10 to 20 carbon atoms, such as unsubstituted phenyl, unsubstituted naphthyl, 3,5-dimethylphenyl, 4-butoxyphenyl, 4-dimethylaminophenyl and 2-carboxyphenyl. Examples of the heterocyclic group include a substituted or unsubstituted nitrogen-containing 5-membered heterocyclic ring (e.g., imidazolyl, 1,2,4-triazolyl, tetrazolyl, oxadiazolyl, thiadiazolyl, benzimidazolyl, purynyl), a substituted or unsubstituted nitrogen-containing 6-membered heterocyclic ring (e.g., pyridyl, piperidyl, 1,3,5-triazino, 4,6-dimercapto-1,3,5-triazino), and a furyl group. Examples of the acyl group include an acetyl group and a benzoyl group. Examples of the sulfonyl group include a substituted or unsubstituted alkylsulfonyl group having from 1 to 10 carbon atoms (e.g., methanesulfonyl, ethanesulfonyl) and a substituted or unsubstituted phenylsulfonyl group having from 6 to 16 carbon atoms (e.g., unsubstituted phenylsulfonyl).

The compounds represented by $B^1$ and $B^2$ in formula (A-1) each may have a substituent, if possible. Examples of the substituent include a halogen atom (e.g., fluorine, chlorine, bromine), an aliphatic hydrocarbon group (e.g., methyl, ethyl, isopropyl, n-propyl, t-butyl, n-octyl, cyclopentyl, cyclohexyl), an alkenyl group (e.g., allyl, 2-butenyl, 3-pentenyl), an alkynyl group (e.g., propargyl, 3-pentynyl), an aralkyl group (e.g., benzyl, phenethyl), an aryl group (e.g., phenyl, naphthyl, 4-methylphenyl), a heterocyclic group (e.g., pyridyl, furyl, imidazolyl, piperidinyl, morphoryl), an alkyloxy group (e.g., methoxy, ethoxy, butoxy, 2-ethylhexyloxy, ethoxyethoxy, methoxyethoxy), an aryloxy group (e.g., phenoxy, 2-naphthyloxy), an amino group (e.g., unsubstituted amino, dimethylamino, diethylamino, dipropylamino, dibutylamino, ethylamino, dibenzylamino, anilino), an acylamino group (e.g., acetylamino, benzoylamino), a ureido group (e.g., unsubstituted ureido, N-methylureido, N-phenylureido), a thioureido group (e.g., unsubstituted thioureido, N-methylthioureido, N-phenylthioureido), a selenoureido group (e.g., unsubstituted selenoureido), a phosphine selenide group (e.g., diphenylphosphine selenide), a telluroureido group (e.g., unsubstituted telluroureido), a urethane group (e.g., methoxycarbonylamino, phenoxycarbonylamino), a sulfonamido group (e.g., methylsulfonamido, phenylsulfonamido), a sulfamoyl group (e.g., unsubstituted sulfamoyl, N,N-dimethylsulfamoyl, N-phenylsulfamoyl), a carbamoyl group (e.g., unsubstituted carbamoyl, N,N-diethylcarbamoyl, N-phenylcarbamoyl), a sulfonyl group (e.g., mesyl, tosyl), a sulfinyl group (e.g., methylsulfinyl, phenylsulfinyl), an alkyloxycarbonyl group (e.g., methoxycarbonyl, ethoxycarbonyl), an aryloxycarbonyl group (e.g., phenoxycarbonyl), an acyl group (e.g., acetyl, benzoyl, formyl, pivaloyl), an acyloxy group (e.g., acetoxy, benzoyloxy), a phosphoramido group (e.g., N,N-diethyl phosphoramido), an alkylthio group (e.g., methylthio, ethylthio), an arylthio group (e.g., phenylthio), a cyano group, a sulfo group, a thiosulfonic acid group, a sulfinic acid group, a carboxy group, a hydroxy group, a mercapto group, a phosphono group, a nitro group, a sulfino group, an ammonio group (e.g., trimethylammonio), a phosphonio group, a hydrazino group, a thiazolino group and a silyloxy group (e.g., t-butyldimethylsilyloxy, t-butyldiphenylsilyloxy). When two or more substituents are present, they may be the same or different.

X and n in formula (A-1) are described below.

Examples of the counter anion represented by X in formula (A-1) include a halogenium ion (e.g., $F^-$, $Cl^-$, $Br^-$, $I^-$), tetrafluoroboronate ion ($BF_4^{-1}$), hexafluorophosphonate ion ($PF_6^-$), sulfate ion ($S_2O_4^{2-}$), an arylsulfonate ion (e.g., p-toluenesulfonate ion, naphthalene-2,5-disulfonate ion) and a carboxy ion (e.g., acetate ion, trifluoroacetate ion, oxalate ion, benzoate ion) Examples of the counter cation represented by X include an alkali metal ion (e.g., lithium cation, sodium cation, potassium cation), an alkaline earth metal ion (e.g., magnesium ion, calcium ion), a substituted or unsubstituted ammonium ion (e.g., unsubstituted ammonium ion, triethylammonium, tetramethylammonium), a substituted or unsubstituted pyridinium ion (e.g., unsubstituted pyridinium ion, 4-phenylpyridinium ion) and a proton. n is a number of X necessary for neutralizing the electric charge of the compound and represents a value of from 0 to 1. The value may be a decimal.

Preferred embodiments of formula (A-1) are described below.

The compound represented by formula (A-1) is preferably a compound where $B^1$ and $B^2$ each is an azole compound, X is, in the case of a counter anion, a halogenium ion, a tetrafluoroboronate ion or hexafluorophosphonate ion and in the case of a counter cation, a proton, an alkali metal ion, an alkaline earth metal ion or an ammonium ion. A water-soluble group is preferably substituted to at least one (more preferably both) of $B^1$ and $B^2$ and examples of the water-soluble group include a sulfo group, a carboxy group, a hydroxy group and an amino group.

The compound represented by formula (A-1) is more preferably a compound where $B^1$ and $B^2$ each is a compound represented by formula (A-2) or (A-3), still more preferably a compound where $B^1$ and $B^2$ each is a compound described above as a preferred example in the detailed description of formula (A-2) and (A-3).

Specific examples of the compound represented by formula (A-1) are set forth below, however, the present invention is by no means limited thereto.

Compound A-1

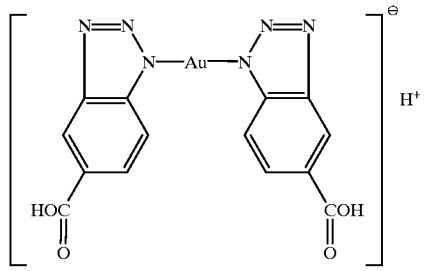

Compound A-2

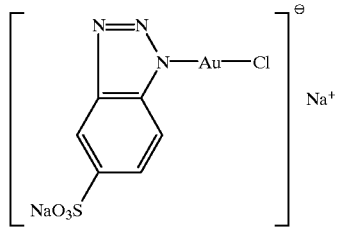

Compound A-3

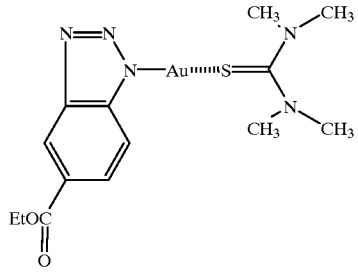

Compound A-4

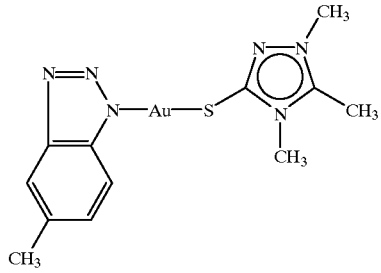

Compound A-5

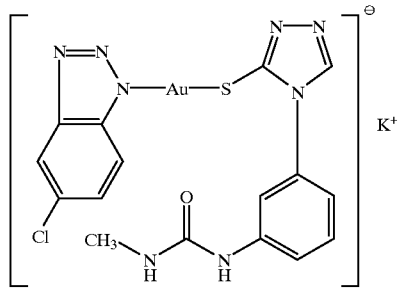

-continued
Compound A-6
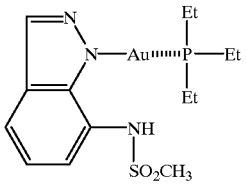
Compound A-7
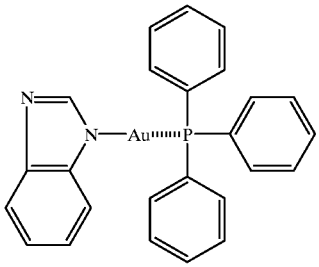
Compound A-8
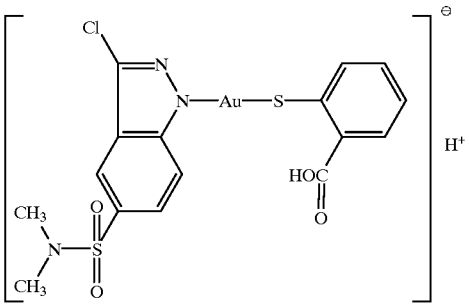
Compound A-9
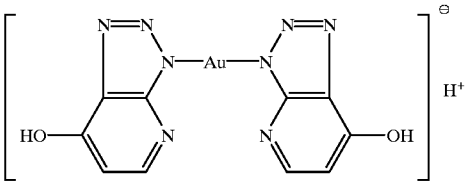
Compound A-10
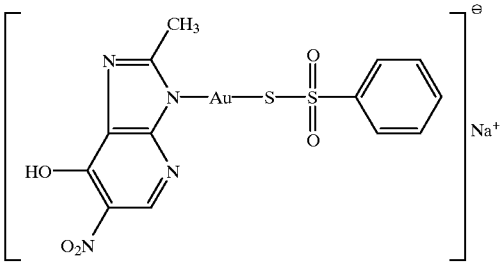
Compound A-11
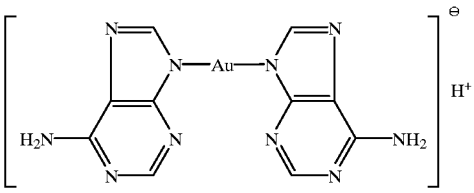
-continued
Compound A-12
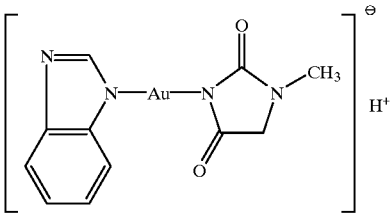
Compound A-13
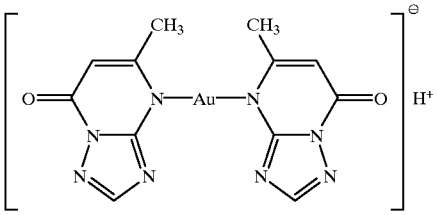
Compound A-14
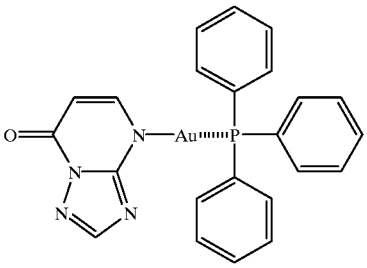
Compound A-15
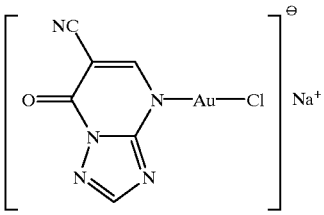
Compound A-16
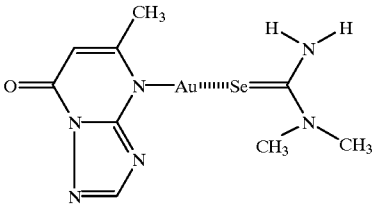
Compound A-17
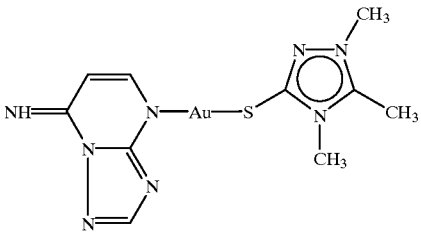

-continued

Compound A-18

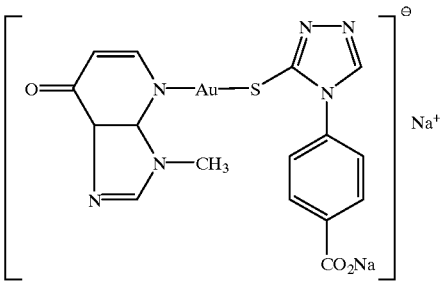

Compound A-19

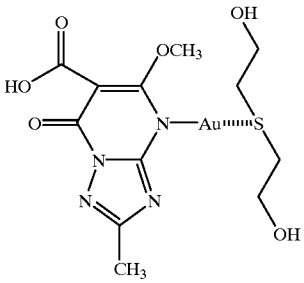

Compound A-20

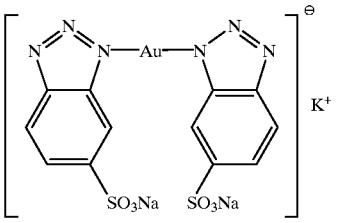

Compound A-21

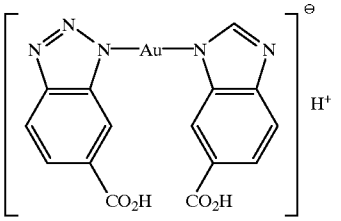

Compound A-22

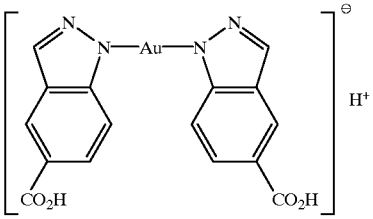

Compound A-23

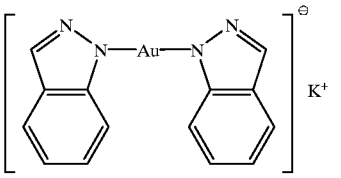

In those gold complexes where $B^2$ in formula (A-1) is a meso-ion, the partial charge polarized on the mesoionic ligand is omitted so as to avoid confounding with the total charge of the complex ion. The circle denoting 6 non-localized π electrons on the heterocyclic moiety is shown as it is, though it does not reveal aromaticity. This is specifically shown below using mesoionic-1,4,5-trimethyl-3-mercapto-1,2,4-triazole and a gold complex thereof as an example.

(Mesoionic Compound and Gold Complex Thereof)

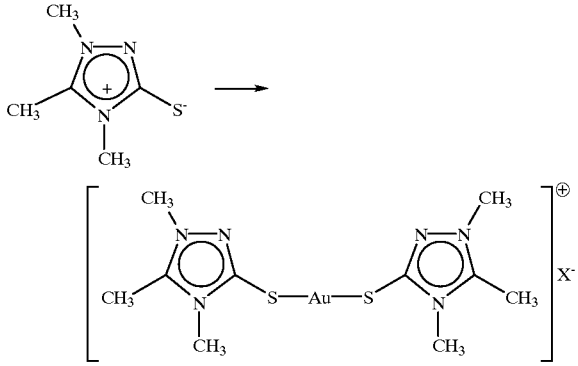

wherein X has the same meaning as defined in formula (A-1).

The compounds represented by $B^1$ and $B^2$ in formula (A-1) of the present invention are easily available or can be synthesized by a known method.

The compound represented by formula (A-1) of the invention can be synthesized by a known method, for example, by referring to *INORG. NUCL. CHEM. LETTERS*, Vol. 10, page 641 (1974), *Transition Met. Chem.*, Vol. 1, page 248 (1976), *Acta. Cryst.*, B32, page 3321 (1976), JP-A-8-69075, JP-B-45-8831, EP-A-915371, JP-A-6-11788, JP-A-6-501789, JP-A-4-267249 and JP-A-9-118685.

A specific synthesis example of a representative compound of formula (A-1) is described below.

Synthesis of Compound (A-1):

In an aqueous solution (3,000 ml) of tetrachloroauric acid tetrahydrate (10.0 g, 24.3 mmol), 2-hydroxyethylsulfide (11.9 g, 4 equivalents) was added and the reaction solution was transferred to a warm bath at 70° C. and continuously stirred, as a result, the solution turned from yellow to colorless transparency within about 30 minutes. The reaction solution was cooled to room temperature and thereto an alkali aqueous solution of an easily available benzotriazole-5-carboxylic acid (7.9 g, 48.6 mmol) was added and stirred at room temperature for 4 hours. To the resulting reaction solution, a slight amount of concentrated hydrochloric acid was added to render the solution acidic and the precipitated crystals were filtered under suction and then recrystallized with a methanol/water solvent to obtain Compound A-1 (9.5 g, 75%).

The compound represented by formula (1), (2) or (3) and the compound represented by formula (A-1) of the present invention each is preferably added in an amount of from $1\times10^{-8}$ to $1\times10^{-2}$ mol, more preferably from $1\times10^{-6}$ to $1\times10^{-3}$ mol per mol of silver halide.

The compound represented by formula (1), (2) or (3) and the compound represented by formula (A-1) of the present invention each may be added using a solvent such as water, an alcohol (e.g., methanol, ethanol), a ketone (e.g., acetone), an amide (e.g., dimethylformamide), a glycol (e.g., methyl propylene glycol) or an ester (e.g., ethyl acetate).

The compound represented by formula (1), (2) or (3) and the compound represented by formula (A-1) of the present invention each may be added in any stage during the production of the emulsion but is preferably added between the completion of formation of silver halide grains and the completion of chemical sensitization process.

Similarly to the gold complex represented by formula (1), (2), (3) or (A-1) of the present invention, a compound represented by the following formula (A), (B) or (C) may be used:

$$\{L^1—Au(I)—L^2\}X_n \quad (A)$$

wherein $L^1$ and $L^2$ each represents a compound capable of forming a complex with Au(I), the compound containing a labile sulfur group, labile selenium group or labile tellurium group capable of reacting with silver halide to produce silver sulfide, silver selenide or silver telluride, provided that $L^1$ and $L^2$ may be the same or different and may be combined with each other, X represents a counter salt necessary for neutralizing the electric charge of the compound, and n represents a number of from 0 to 1;

$$\{L^1—Au(I)—(S_2O_3M)\}X_n \quad (B)$$

wherein $L^1$ represents a compound containing at least one of a labile sulfur group, a labile selenium group and a labile tellurium group each capable of reacting with silver halide to produce silver sulfide, silver selenide or silver telluride, a hydantoin compound, a thioether compound, a mesoionic compound or $R^1$—S, $R^1$ represents an aliphatic hydrocarbon group, an aryl group, a heterocyclic group, an acyl group, an amido group, a thiocarbonyl group or a sulfonyl group, X represents a counter salt necessary for neutralizing the electric charge of the compound, M represents an alkali metal ion or an ammonium ion, and n represents a number of from 0 to 1;

$$\{L^1—Au(I)—S—R^1\}X_n \quad (C)$$

wherein $L^1$ represents a compound containing at least one of a labile sulfur group, a labile selenium group and a labile tellurium group each capable of reacting with silver halide to produce silver sulfide, silver selenide or silver telluride, $R^1$ represents an aliphatic hydrocarbon group, an aryl group or a heterocyclic group, provided that $L^1$ and $R^1$ may be combined with each other, X represents a counter salt necessary for neutralizing the electric charge of the gold complex, and n represents a number of from 0 to 1.

Representative examples of the compound represented by formula (A) are set forth below.

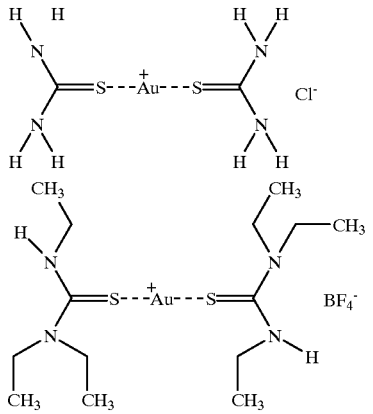

Representative examples of the compound represented by formula (B) are set forth below.

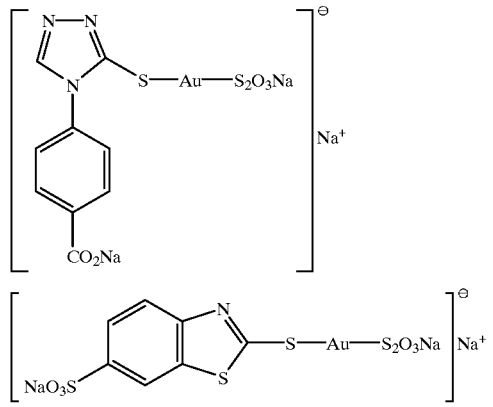

Representative examples of the compound represented by formula (C) are set forth below.

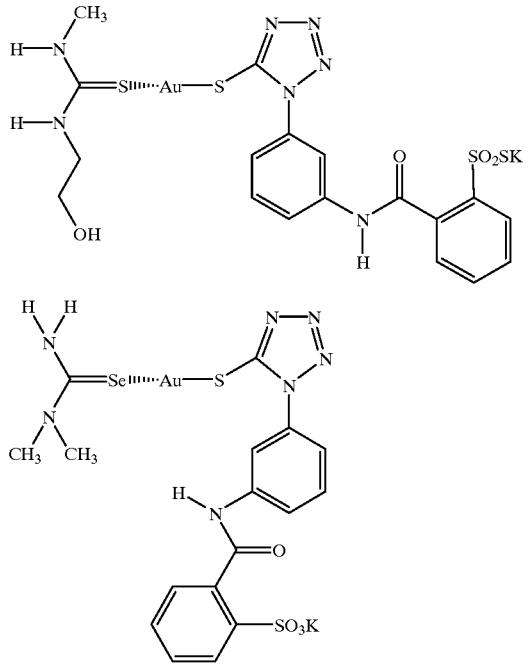

The silver halide emulsion and the like which are preferred in the present invention are described below.

The silver halide emulsion for use in the silver halide photographic light-sensitive material of the present invention is not particularly limited on the silver halide and silver chloride, silver chlorobromide, silver bromide, silver iodochloride or silver iodobromide may be used. The emulsion preferably contains bromide ion or iodide ion. The size of the silver halide grain is not particularly limited but the grain preferably has an equivalent-sphere diameter of from 0.01 to 3 $\mu$m. With respect to the shape of the silver halide grain, either an irregular crystal form (regular crystal grain) or an irregular crystal form may be used. The regular crystal grain includes cubic form, octahedral form, dodecahedral form, tetradecahedral form, eicosahedral form and octatetracontahedral form. The irregular crystal form includes spherical form and pebble-like form. The grain may have one or more twin planes and a hexagonal tabular grain or triangular tabular grain having two or three parallel twin planes is preferably used. In the tabular grain, the grain size distribution thereof is preferably monodisperse (having a variation coefficient of from 10 to 20%). The preparation of monodisperse tabular grains is described in JP-A-63-11928 A monodisperse hexagonal tabular grain is described in JP-A-63-151618, a circular monodisperse tabular grain emulsion is described in JP-A-1-131541, and an emulsion in which 95% or more of the entire projected area is occupied by tabular grains having two parallel twin planes as a main plane and the size distribution of the tabular grains is monodisperse, is disclosed in JP-A-2-838. Furthermore, a tabular grain emulsion prepared using a polyalkylene oxide block copolymer and having a coefficient of variation of the grain size of 10% or less is disclosed in EP-A-514742. By using these techniques, monodisperse grains preferred in the present invention can be prepared.

The coefficient of variation of the grain thickness is also preferably 20% or less, more preferably from 5 to 15%.

Know tabular grains include a tabular grain having (100) main surface and a tabular grain having (111) main. With respect to the former grain, silver bromide is described in U.S. Pat. No. 4,063,951 and JP-A-5-281640, and silver chloride is described in EP-A-0534395 and U.S. Pat. No. 5,264,337. With respect to the latter tabular grain which is a grain having one or more sheets of the above-described twin planes and having various forms, silver chloride is described in U.S. Pat. Nos. 4,399,215, 4,983,508 and 5,183,732, JP-A-3-137632 and JP-A-3-116113. The present invention can be preferably applied to both a tabular grain having (100) main surface and a tabular grain having (111) main surface.

The tabular emulsion preferably used in the present invention is an emulsion in which silver halide grains having an aspect ratio (equivalent-circle diameter/grain thickness) of from 2 to 100, preferably 5 or more, more preferably 8 or more, occupy 50% (area) or more, preferably 60% or more, more preferably 85% or more, of all silver halide grains in the emulsion.

The equivalent-circle diameter of the tabular grain is from 0.2 to 5.0 $\mu$m, preferably from 0.5 to 3.0 $\mu$m, more preferably from 0.6 to 2.0 $\mu$m. The thickness of the tabular grain is preferably from 0.02 to 0.3 $\mu$m, more preferably from 0.03 to 0.2 $\mu$m.

The silver halide grain may have a dislocation line within the grain and the technique for introducing a dislocation line into a silver halide grain by controlling the dislocation is described in JP-A-63-220238. According to this patent publication, a specific high iodide phase is provided inside a tabular silver halide grain having an average aspect ratio of 2 or more and by covering the outside thereof with a phase having an iodide content lower than the high iodide phase, a dislocation can be introduced. This introduction of dislocation can provide effects such as increase of sensitivity, improvement of storability, improvement of latent image stability and reduction of pressure fog. According to this technique, the dislocation is introduced mainly into the edge part of a tabular grain. A tabular grain having a dislocation introduced into the center part is described in U.S. Pat. No. 5,238,796. The present invention is effective on silver halide grains in which 50% or more by number of grains have 10 or more dislocation lines per one grain.

Additives which can be added from the grain formation until the coating in the preparation of a silver halide emulsion are not particularly limited. In order to accelerate the growth during the crystal formation or to effectively perform the chemical sensitization at the time of grain formation and/or chemical sensitization, a silver halide solvent may be used. As the silver halide solvent, a water-soluble thiocyanate, ammonia, a thioether or a thiourea may be preferably used. Examples of the silver halide solvent include thiocyanates (e.g., those described in U.S. Pat. Nos. 2,222,264, 2,448,534 and 3,320,069), ammonia, thioether compounds (e.g., those described in U.S. Pat. Nos. 3,271,157, 3,574,628, 3,704,130, 4,297,439 and 4,276,347), thione compounds (e.g., those described in JP-A-53-144319, JP-A-53-82408 and JP-A-55-77737), amine compounds (e.g., those described in JP-A-54-100717), thiourea derivatives (e.g., those described in JP-A-55-2982), imidazoles (e.g., those described in JP-A-54-100717) and substituted mercaptotetrazoles (e.g., those described in JP-A-57-202531).

The production method of a silver halide emulsion is not particularly limited. In general, an aqueous silver salt solution and an aqueous halogen salt solution are added to a reaction vessel in which an aqueous gelatin solution is put, while stirring efficiently. Specific examples of the production method include the methods described in P. Glafkides, *Chemie et Phisique Photographique*, Paul Montel (1967), G.F. Duffin, *Photographic Emulsion Chemistry*, The Focal Press (1966), and V. L. Zelikman et al., *Making and Coating Photographic Emulsion*, The Focal Press (1964). More specifically, any of an acidic process, a neutral process and an ammonia process may be used, and the form for reacting a soluble silver salt and a soluble halogen salt may be any of a single jet method, a double jet method and a combination thereof. The growth is preferably accelerated within the range of not exceeding the critical supersaturation degree by using a method of changing the addition rate of silver nitrate or an aqueous alkali halide solution according to the grain growth speed (as described, for example, in British Patent 1,535,016, JP-B-48-36890 and JP-B-52-16364) or a method of changing the concentration of the aqueous solution (as described, for example, in U.S. Pat. No. 4,242,445 and JP-A-55-158124). These methods are preferably used because regeneration of nuclei does not occur and silver halide grains uniformly grow.

In place of adding a silver salt solution and a halogen salt solution to a reaction vessel, fine grains previously prepared may be added to the reaction vessel to generate nucleation and/or grain growth to thereby obtain silver halide grains and this method is also preferred. This technique is described in JP-A-1-183644, JP-A-1-183645, JP-A-2-44335, JP-A-2-43534, JP-A-2-43535 and U.S. Pat. No. 4,879,208. According to this method, the halogen ion distribution within the emulsion grain crystal can be made completely uniform and preferred photographic properties can be achieved. In the present invention, emulsion grains having various structures can be used. A so-called core-shell double structure grain consisting of an inside (core) and an outside (shell), a triple structure grain (described, for example, in JP-A-60-222844) and a greater multiple structure grain may be used. When an emulsion grain is intended to have a structure in the inside thereof, not only a grain having the above-described wrapping structure but also a grain having a so-called junction structure may be prepared. Examples thereof are described in JP-A-58-108526, JP-A-59-16254, JP-A-59-133540, JP-B-58-24772 and EP-A-199290. The crystal to be joined may have a composition different from the host crystal and may be grown to join to the edge or corner part or on the plane part of the host crystal. The joined crystal can be formed irrespective of whether the host crystal has a uniform halogen composition or a core-shell type structure. In the case of the junction structure, silver halides can of course be combined with each other but also a silver salt compound not having a rock-salt structure, such as silver rhodanide and silver carbonate, can be combined, if possible, with silver halide to give a junction structure grain. In the present invention, a core-shell double structure grain is most preferred.

In the case of a silver iodobromide grain having the above-described structure, for example, in a core-shell type grain, the silver iodide content of the core part may be high and the silver iodide content of the shell part may be low. On the contrary, the silver iodide content of the core part may be low and the silver iodide content of the shell part may be high. Similarly, in the case of a grain having a junction structure, the host crystal may have a high silver iodide content and the joined crystal may have a relatively low silver iodide content. The grain may also have a reverse relationship with respect to the silver iodide content. The boundary between portions different in the halogen composition of a grain having the above-described structure may be clear or may be unclear due to a mixed crystal formed using difference in the composition. Furthermore, a continuous change may be positively provided in the structure. The silver halide emulsion is preferably surface latent image type, however, as disclosed in JP-A-59-133542, by selecting the developer or the development conditions, an internal latent image-type emulsion may be used. A shallow internal latent image-type emulsion covered with a thin shell may also be used depending on the purpose.

The production method of a silver iodobromide tabular emulsion which is preferably used in the present invention is described, for example, in U.S. Pat. Nos. 4,439,520, 4,434,226, 4,433,048, 4,414,310 and 5,334,495.

With respect to an ultra-thin tabular emulsion having a grain thickness of 0.1 $\mu$m or less, U.S. Pat. Nos. 5,460,928, 5,411,853 and 5,418,125 describe the emulsion.

In the case where the present invention is applied to a high silver chloride tabular emulsion, examples of the emulsion which is preferably used include those described in European Patents 723187, 619517, 534,395 and 584,644.

The silver halide emulsion is usually subjected to spectral sensitization. The dye usually used for the spectral sensitization is preferably a methine dye. The methine dye includes a cyanine dye, a merocyanine dye, a complex cyanine dye, a complex merocyanine dye, a holopolar cyanine dye, a hemicyanine dye, a styryl dye and a hemioxonol dye. To this dye, any ring usually used for cyanine dyes as a basic heterocyclic ring may be applied. Examples of the basic heterocyclic ring which can be used include a pyrroline ring, an oxazoline ring, a thiazoline ring, a pyrrole ring, an oxazole ring, a thiazole ring, a selenazole ring, an imidazole ring, a tetrazole ring and a pyridine ring. Also, a ring obtained by condensing a cyclic hydrocarbon ring or an aromatic hydrocarbon ring to a heterocyclic ring may be used. Examples of the condensed ring include an indolenine ring, a benzindolenine ring, an indole ring, a benzoxazole ring, a naphthoxazole ring, a benzothiazole ring, a naphthothiazole ring, a benzoselenazole ring, a benzimidazole ring and a quinoline ring. On the carbon atom of these rings, a substituent may be bonded. To the merocyanine dye or complex merocyanine dye, a 5- or 6-membered heterocyclic ring having a ketomethylene structure may be applied. Examples of such a heterocyclic ring include a pyrazolin-5-one ring, a thiohydantoin ring, a 2-thiooxazolidine-2,4-dione ring, a thiazolidine-2,4-dione ring, a rhodanine ring and a thiobarbituric acid ring.

The amount of the sensitizing dye added is preferably from 0.001 to 100 mmol, more preferably from 0.01 to 10 mmol, per mol of silver halide. The sensitizing dye is preferably added during the chemical sensitization or before the chemical sensitization (for example, during the grain formation or physical ripening).

Together with the sensitizing dye, a dye which itself has no spectral sensitization effect or a substance which absorbs substantially no visible light, but which exhibits supersensitization may be added to the emulsion. Examples of such a dye or substance include aminostyryl compounds substituted by a nitrogen-containing heterocyclic group (those described in U.S. Pat. Nos. 2,933,390 and 3,635,721), aromatic organic acid-formaldehyde condensation products (those described in U.S. Pat. No. 3,743,510), cadmium salts and azaindene compounds. The combination of a sensitizing dye with the above-described dye or substance is described in U.S. Pat. Nos. 3,615,613, 3,615,641, 3,617,295 and 3,635,721.

The silver halide emulsion is generally subjected to chemical sensitization before use. The chemical sensitization is performed using chalcogen sensitization (e.g., sulfur sensitization, selenium sensitization, tellurium sensitization), noble metal sensitization (e.g., gold sensitization) and reduction sensitization individually or in combination. In the present invention, chemical sensitization is preferably performed using a combination of sulfur sensitization and gold-sulfur sensitization, however, selenium sensitization and tellurium sensitization are also preferred. In the sulfur sensitization, a labile sulfur compound is used as a sensitizer. The labile sulfur compound is disclosed in P. Glafkides, *Chimie et Physique Photographique*, 5th Ed., Paul Montel (1987), *Research Disclosure*, Vol. 307, No. 307105, T. H. James (compiler), *The Theory of the Photographic Process*, 4th Ed., Macmillan (1977), and H. Frieser, *Die Grundlagen der Photographischen Prozess mit Silver-halogeniden*, Akademische Verlagsgeselbshaft (1968). Examples of the sulfur sensitizer include thiosulfates (e.g., sodium thiosulfate, p-toluenethiosulfonate), thioureas, (e.g., diphenylthiourea, triethylthiourea, N-ethyl-N'-(4-methyl-2-thiazolyl)thiourea, carboxymethyltrimethylthiourea), thioamides (e.g., thioacetamide, N-phenylthioacetamide), rhodanines (e.g., rhodanine, N-ethyl rhodanine, 5-benzylidene rhodanine, 5-benzylidene-N-ethyl rhodanine, diethyl rhodanine), phosphinesulfides (e.g., trimethylphosphinesulfide), thiohydantoins, 4-oxo-oxazolidine-2-thiones, dipolysulfides (e.g., dimorpholine disulfide, cystine, hexathiocane-thione), mercapto compounds (e.g., cysteine), polythionate and elemental sulfur. An active gelatin can also be used as a sulfur sensitizer.

In the selenium sensitization, a labile selenium compound is used as a sensitizer. The labile selenium compound is described in JP-B-43-13489, JP-B-44-15748, JP-A-4-25832, JP-A-4-109240, JP-A-4-271341 and JP-A-5-40324. Examples of the selenium sensitizer include colloidal metal selenium, selenoureas (e.g., N,N-dimethylselenourea, trifluoromethylcarbonyl-trimethylselenourea, acetyltrimethylselenourea), selenoamides (e.g., selenoamide, N,N-diethylphenylselenoamide), phosphine selenides (e.g., triphenylphosphineselenide, pentafluorophenyl-triphenylphosphineselenide), selenophosphates (e.g., tri-p-tolylselenophosphate, tri-n-butylselenophosphate), selenoketones (e.g., selenobenzophenone), isoselenocyanates, selenocarboxylic acids, selenoesters and diacyl selenides. In addition, relatively stable selenium compounds (those described in JP-B-46-4553 and JP-B-52-34492) such as selenious acid, potassium selenocyanate, selenazoles and selenides may also be used as a selenium sensitizer.

In the tellurium sensitization, a labile tellurium compound is used as a sensitizer. The labile tellurium compound is described in Canadian Patent 800,958, British Patents 1,295,462 and 1,396,696, JP-A-4-204640, JP-A-4-271341, JP-A-4-333043 and JP-A-5-303157. Examples of the tellurium sensitizer include telluroureas (e.g., tetramethyltellurourea, N,N'-dimethylethylenetellurourea, N,N'-diphenylethylenetellurourea), phosphine tellurides (e.g., butyl-diisopropylphosphine telluride, tributylphosphine telluride, tributoxyphosphine telluride, ethoxydiphenylphophine telluride), diacyl (di) tellurides (e.g., bis(diphenylcarbamoyl) ditelluride, bis(N-phenyl-N-methylcarbamoyl) ditelluride, bis(N-phenyl-N-methylcarbamoyl) telluride, bis(ethoxycarbonyl) telluride), isotellurocyanates (e.g., allylisotellurocyanate), telluroketones (e.g., telluroacetone, telluroacetophenone), telluroamides (e.g., telluroacetamide, N,N-dimethyltellurobenzamide), tellurohydrazides (e.g., N,N', N'-trimethyltellurobenzohydrazide), telluroesters (e.g., t-butyl-t-hexyltelluroester), colloidal tellurium, (di) tellurides and other tellurium compounds (e.g., potassium telluride, telluropentathionate sodium salt).

In the noble metal sensitization, a salt of noble metals such as platinum, palladium and iridium may be used as a sensitizer in combination with the compound represented by each formula of the present invention. The noble metal salt is described in P. Glafkides, *Chemie et Phisique Photographique*, 5th Ed., Paul Montel (1987) and *Research Disclosure*, Vol. 307, No. 307105.

In the present invention, reduction sensitization can be used in combination.

In the reduction sensitization, a reducing compound is used as a sensitizer. The reducing compound is described in P. Glafkides, *Chemie et Phisique Photographique,* 5th Ed., Paul Montel, (1987), and *Research Disclosure*, Vol. 307, No. 307105. Examples of the reducing sensitizer include aminoiminomethanesulfinic acid (thiourea dioxide), borane compounds (e.g., dimethylaminoborane), hydrazine compounds (e.g., hydrazine, p-tolylhydrazine), polyamine compounds (e.g., diethylenetriamine, triethylenetetramine), stannous chloride, silane compounds, reductones (e.g., ascorbic acid), sulfites, aldehyde compounds and hydrogen. The reduction sensitization may also be performed using an atmosphere of high pH or excess silver ion (so-called silver ripening).

The chemical sensitization may be performed using a combination of two or more of the above-described sensitization treatments. A combination of chalcogen sensitization and gold sensitization is particularly preferred. The reduction sensitization is preferably applied during the formation of silver halide grains. The amount of the sensitizer used is generally determined according to the kind of silver halide grain and chemical sensitization conditions used. The amount of the chalcogen sensitizer used is from $10^{-8}$ to $10^{-2}$ mol, preferably from $10^{-7}$ to $5\times10^{-3}$ mol, per mol of silver halide. The amount of the noble metal sensitizer used is preferably from $10^{-7}$ to $10^{-2}$ mol per mol of silver halide. The conditions for chemical sensitization are not particularly limited. The pAg is from 6 to 11, preferably from 7 to 10, the pH is preferably from 4 to 10, and the temperature is preferably from 40 to 95° C., more preferably from 45 to 85° C.

The layer structure of the silver halide photographic material is not particularly limited. However, in the case of a color photographic material, a multi-layer structure is used so as to separately record blue light, green light and red light. Each silver halide emulsion layer may consists of two layers of high-sensitivity layer and low-sensitivity layer. Examples of practical layer arrangements include the following (1) to (6).

(1) BH/BL/GH/GL/RH/RL/S (2) BH/BM/BL/GH/GM/GL/RH/RM/RL/S (3) BH/BL/GH/RH/GL/RL/S (4) BH/GH/RH/BL/GL/RL/S (5) BH/BL/CL/GH/GL/RH/RL/S (6) BH/BL/GH/GL/CL/RH/RL/S

In these layer arrangements, B denotes a blue-sensitive layer, G denotes a green-sensitive layer, R denotes a red-sensitive layer, H denotes a highest-sensitivity layer, M denotes a medium-sensitivity layer, L denotes a low-sensitivity layer, S denotes a support and CL denotes an interimage effect-imparting layer. Light-insensitive layers such as protective layer, filter layer, interlayer, antihalation layer and subbing layer are omitted. With the same color sensitivity, the high-sensitivity layer and the low-sensitivity layer may be reversely arranged. The arrangement (3) is described in U.S. Pat. No. 4,184,876, (4) is described in *Research Disclosure*, Vol. 225, No. 22534, JP-A-59-177551 and JP-A-59-177552, and (5) and (6) are described in JP-A-61-34541. Of these, the arrangements (1), (2) and (4) are preferred. The silver halide photographic material of the present invention can be similarly applied, other than the color photographic material, to X-ray light-sensitive material, black-and-white light-sensitive material for photographing, light-sensitive material for photomechanical process, and printing paper.

Various additives (e.g., binder, chemical sensitizer, spectral sensitizer, stabilizer, gelatin, hardening agent, surfactant, antistatic agent, polymer latex, matting agent, color coupler, ultraviolet absorbent, discoloration inhibitor, dyestuff) for the silver halide emulsion, the support for the photographic material, and the processing method (e.g., coating method, exposure method, development method) of the photographic material are described in *Research Disclosure*, Vol. 176, No. 17643 (RD-17643), ibid., Vol. 187, No. 18716 (RD-18716), and ibid., Vol. 225, No. 22534 (RD-22534). The pertinent portions in these *Research Disclosures* are summarized in the table below.

| Kinds of Additives | RD-17643 | RD-18716 | RD-22534 |
|---|---|---|---|
| 1. Chemical sensitizer | p. 23 | p. 648, right col. | p. 24 |
| 2. Sensitivity increasing agent | | p. 648, right col. | |
| 3. Spectral sensitizer, supersensitizer | pp. 23–24 | p. 648, right col. to p. 649, right col. | pp. 24–28 |
| 4. Brightening agent | p. 24 | | |
| 5. Antifoggant, stabilizer | pp. 24–25 | p. 649, right col. | p. 24 and p. 31 |
| 6. Light absorbent, filter dye, UV absorbent | pp. 25–26 | p. 649, right col. to p. 650, left col. | |
| 7. Stain inhibitor | p. 25, right col. | p. 650, left to right cols. | |
| 8. Dye Image Stabilizer | p. 25 | | p. 32 |
| 9. Hardening agent | p. 26 | p. 651, left col. | p. 32 |
| 10. Binder | p. 26 | " | p. 28 |
| 11. Plasticizer, lubricant | p. 27 | p. 650, right col. | |
| 12. Coating aid, surfactant | pp. 26–27 | p. 650, right col. | |
| 13. Antistatic agent | p. 27 | p. 650, right col. | |
| 14. Color coupler | p. 25 | p. 648 | p. 31 |

As the gelatin hardening agent, for example, active halide compounds (e.g., 2,4-dichloro-6-hydroxy-1,3,5-triazine, a sodium salt thereof) and active vinyl compounds (e.g., 1,3-bisvinylsulfonyl-2-propanol, 1,2-bis(vinylsulfonylacetamido)ethane, vinyl polymer having a vinylsulfonyl group on the side chain) are preferred because hydrophilic colloid such as gelatin can be rapidly hardened and stable photographic properties are obtained. Also, N-carbamoyl pyridinium salts (e.g., (1-morpholinocarbonyl-3-pyridinio)methanesulfonate) and haloamidinium salts (e.g., 1-(1-chloro-1-pyridinomethylene)pyrrolidinium 2-naphthalenesulfonate) are preferred because of their high hardening rate.

The color photographic material can be subjected to a development processing by an ordinary method described in *Research Disclosure*, Vol. 176, No. 17643, and ibid., Vol. 187, No. 18716. The color photographic light-sensitive material is usually subjected to a water washing treatment or a treatment with a stabilizer after the development, bleach-fixing or fixing treatment. The water washing is generally performed in a countercurrent washing system using two or more tanks for the purpose of saving water. With respect to the stabilization in place of water washing, a representative example thereof is a multistage countercurrent stabilization described in JP-A-57-8543.

In addition to those described above, JP-A-11-65007 may be referred to for the color coupler (paragraph Nos. 0019 to 0024), the chemical sensitization (paragraph Nos. 0041 to 0053), the antifoggant (paragraph No. 0057), the sensitizing dye and the like (paragraph Nos. 0058 to 0060), the development processing (paragraph Nos. 0080 to 0099) and the application to APS system (paragraph No. 0100 to 0126).

The present invention can also preferably applied to a color diffusion transfer light-sensitive material using an internal latent image-type direct positive silver halide emulsion. The internal latent image-type direct positive silver halide emulsion includes a type where the grain is fogged by light and a type where the grain is chemically fogged using a nucleating agent. Of these, an emulsion of a type where the grain is chemically fogged is preferred.

The nucleating agent is preferably a hydrazine, a hydrazide, a heterocyclic quaternary salt compound, a thiourea-bonded acylhydrazine compound, or a hydrazine-base compound having bonded thereto as the adsorbing group a thioamide ring or a heterocyclic group such as triazole or tetrazole.

Preferred examples of the internal latent image-type direct positive silver halide emulsion include the emulsions described in U.S. Pat. Nos. 3,206,313, 3,761,266, 4,035,185, 4,395,478, 4,504,570, 4,434,226, 4,414,310 and 4,439,520.

In the case of using the compound represented by formula (1) of the present invention for an internal latent image-type direct positive silver halide emulsion, the compound is preferably used in an amount of from $5\times10^{-5}$ to $1\times10^{-7}$ mol, more preferably from $1\times10^{-5}$ to $1\times10^{-6}$ mol, per mol of silver halide in the core grain. Also in the case of chemically sensitizing a shell grain, the compound is preferably used in the above-described amount based on the silver halide in the shell grain.

The present invention is described in greater detail below by referring to the Examples, however, the present invention should not be construed as being limited thereto.

EXAMPLE 1

Preparation of Em-1

1,200 ml of an aqueous solution containing 1.0 g of low molecular weight gelatin having a molecular weight of 15,000 and 1.0 g of KBr was vigorously stirred while keeping it at 35° C. Thereto, 30 ml of an aqueous solution containing 1.9 g of $AgNO_3$ and 30 ml of an aqueous solution containing 1.5 g of KBr and 0.7 g of low molecular weight gelatin having a molecular weight of 15,000 were added by a double jet method over 30 seconds to perform nucleation. At this time, the excess KBr concentration was kept constant. Then, 50 g of KBr was added and the temperature was elevated to 75° C. to perform ripening. After the completion of ripening, 35 g of phthalated gelatin containing 35 $\mu$mol/g of methionine and having a molecular weight of 100,000 and a phthalation ratio of 97% was added, the pH was adjusted to 5.6, and thereto 150 ml of an aqueous solution containing 30 g of $AgNO_3$ and an aqueous KBr solution were added by a double jet method over 16 minutes (Growth Step 1). At this time, the silver potential was kept at −20 mV based on the saturated calomel electrode. Thereto, an aqueous solution containing 110 g of $AgNO_3$ and an aqueous KBr solution (15 wt %) containing 3.8 mol % of KI were added by a double jet method over 15 minutes while accelerating the flow rate such that the final flow rate became 1.2 times the initial flow rate (Growth Step 2). At this time, the silver potential was kept at −20 mV. After returning the number of revolution for stirring, 132 ml of an aqueous solution containing 35 g of $AgNO_3$ and an aqueous KBr solution were added by a double jet method over 7 minutes. At this time, the addition of the aqueous KBr solution was controlled to raise the electric potential to +20 mV at the completion of addition. Thereto, 2 mg of sodium benzenethiosulfonate was added, KBr was added to adjust the silver potential to −20 mV, and 100 ml of an aqueous solution containing 6.8 g of $AgNO_3$ and 900 ml of an aqueous solution containing 7.1 g of KI were added by a double jet method over 10 minutes. Immediately after the completion of addition, 250 ml of an aqueous solution containing 70 g of $AgNO_3$ and 170 ml of an aqueous solution containing 50 g of KBr were added over 20 minutes. The emulsion obtained was washed with water, then 45 g of gelatin was added thereto, and the pH and the pAg were adjusted at 40° C. to 5.8 and 8.7, respectively.

This emulsion Em-1 was observed at a liquid nitrogen temperature through a transmission-type electron microscope, as a result, dislocation lines were found to be present in a high density at the fringe portion of a grain. Apparently, 20 or more dislocation lines were present per one grain. In Em-1, the grains having an aspect ratio of 8 or more occupied 61%, the average aspect ratio was 9.0, the variation coefficient of the iodide distribution among grains was 17 and the average iodide content was 4.3 mol %.

(Chemical Sensitization and Spectral Sensitization)

(Preparation of Solid Fine Dispersion of Sensitizing Dye)

Solid fine dispersions of Sensitizing Dyes 1 to 3 were prepared as follows. The preparation conditions are shown in Table 1. That is, after dissolving an inorganic salt in ion exchange water, the sensitizing dye was added and dispersed under the condition of 60° C. using a dissolver blade at 2,000 rpm for 20 minutes, thereby preparing respective solid fine dispersions of Sensitizing Dyes 1 to 3.

Sensitizing Dye 1

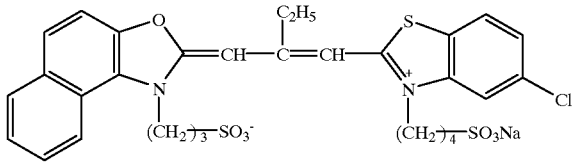

Sensitizing Dye 2

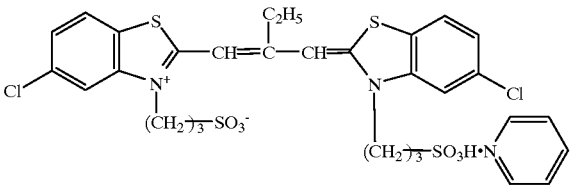

Sensitizing Dye 3

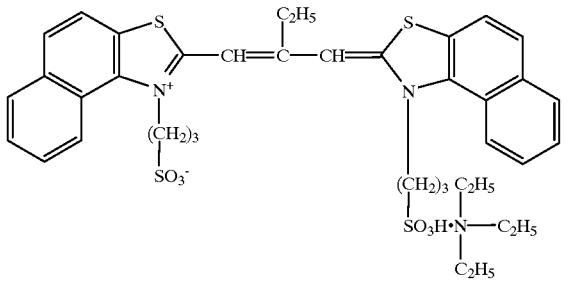

TABLE 1

| Sensitizing Dye | Amount of Sensitizing Dye | $NaNO_3/Na_2SO_4$ | Water | Dispersing Time | Dispersing Temperature |
|---|---|---|---|---|---|
| 1 | 3 parts by weight | 0.8 parts by weight/ 3.2 parts by weight | 43 parts by weight | 20 min. | 60° C. |
| 2 | 4 parts by weight | 0.6 parts by weight/ | 42.8 parts by weight | 20 min. | 60° C. |
| 3 | 0.12 parts by weight | 2.4 parts by weight | | | |

Preparation of Em-1AR to Em-6AR

The temperature of Em-1 was elevated to 56° C. and thereto, Sensitizing Dyes 1, 2 and 3 were added at a molar ratio of 58:36:1 and each in the form of solid fine dispersion. Subsequently, calcium nitrate was added in an amount of 1,800 ppm based on the emulsion. Thereafter, a gold compound of the present invention shown in Table 2, a sulfur sensitizer, potassium thiosulfate ($1.5\times10^{-3}$ mol/mol-Ag), chloroauric acid and N,N-dimethylselenourea were added and ripened to optimally perform the chemical sensitization. At the completion of chemical sensitization, disodium salt of 1-(p-carboxyphenyl)-5-mercaptotetrazole was added. Thus, Em-1AR to Em-6AR were prepared.

-continued

Compound (K-1)

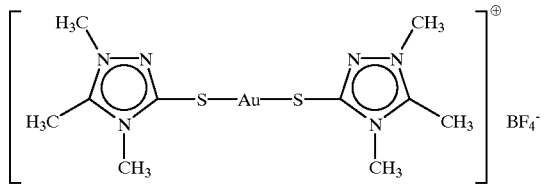

TABLE 2

| Sample No. | Chloroauric Acid (mol/mol-Ag) | Gold Complex (mol/mol-Ag) | Sulfur Sensitizer (mol/mol-Ag) | N,N-Dimethyl-selenourea (mol/mol-Ag) | Fog | Relative Sensitivity | Δfog | Relation to Present Invention |
|---|---|---|---|---|---|---|---|---|
| Em-1AR | ($3 \times 10^{-6}$) | — | HK-1 ($6 \times 10^{-6}$) | ($3 \times 10^{-6}$) | 0.38 | 100 | 0.52 | Comparison |
| Em-2AR | — | K-1 ($3 \times 10^{-6}$) | HK-1 ($6 \times 10^{-6}$) | ($3 \times 10^{-6}$) | 0.36 | 102 | 0.55 | Comparison |
| Em-3AR | — | K-2 ($3 \times 10^{-6}$) | HK-2 ($6 \times 10^{-6}$) | ($3 \times 10^{-6}$) | 0.36 | 101 | 0.49 | Comparison |
| Em-4AR | ($1.5 \times 10^{-6}$) | 1-4 ($1.5 \times 10^{-6}$) | ($3 \times 10^{-6}$) | | 0.30 | 110 | 0.37 | Invention |
| Em-5AR | — | 2-2 ($3 \times 10^{-6}$) | — | ($3 \times 10^{-6}$) | 0.31 | 108 | 0.39 | Invention |
| Em-6AR | ($1.5 \times 10^{-6}$) | 3-6 ($1.5 \times 10^{-6}$) | ($6 \times 10^{-6}$) | | 0.31 | 108 | 0.38 | Invention |

(HK-1)

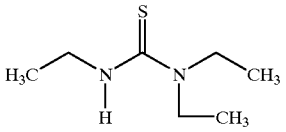

(HK-2)

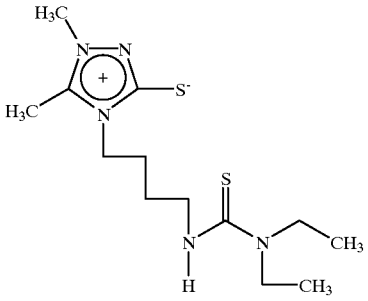

-continued

Compound (K-2)

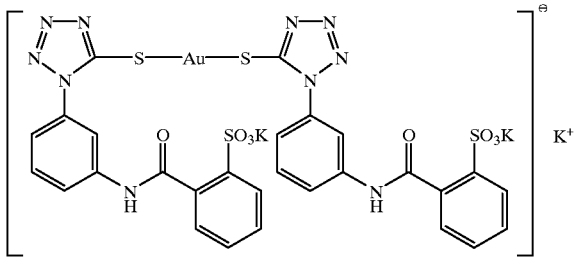

On a cellulose triacetate film support having provided thereon an undercoat layer, each of the emulsions subjected to chemical sensitization as above was coated with a protective layer under the coating conditions shown in Table 3 below to prepare samples.

TABLE 3

Emulsion Coating Conditions (1) Emulsion Layer

Emulsion:

respective emulsions (as silver $2.1\times10^{-2}$ mol/m$^2$)

Coupler ($1.5\times10^{-3}$ mol/m$^2$)

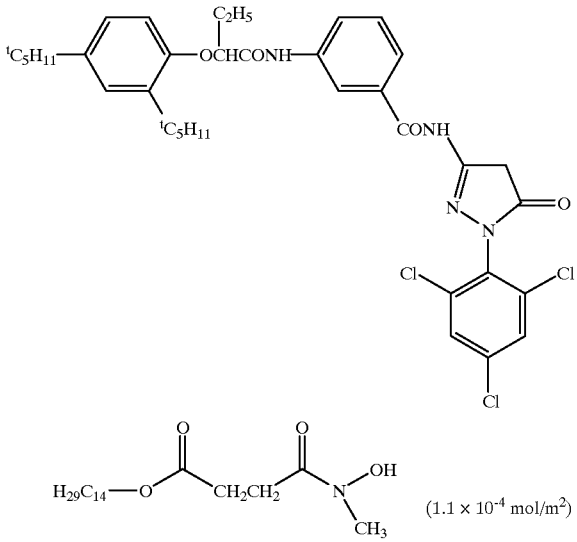

Tricresyl phosphate (1.10 g/m$^2$)

Gelatin (2.30 g/m$^2$)

(2) Protective Layer 2,4-Dichloro-6-hydroxy-s-triazine sodium salt (0.08 g/m$^2$)

Gelatin (1.80 g/m$^2$)

The thus-obtained samples were left standing under the conditions of 40° C. and a relative humidity of 70% for 14 hours and then exposed for 1/100 seconds through gelatin filter SC-50 produced by Fuji Photo Film Co., Ltd. and a continuous wedge.

Thereafter, each sample was processed by the method described below (until the accumulative replenishing amount of the solution reached 3 times the mother solution tank volume) using negative processor FP-350 manufactured by Fuji Photo Film Co., Ltd.

(Processing Method)

| Step | Processing Time | Processing Temperature (° C.) | Replenishing Amount* (ml) |
|---|---|---|---|
| Color development | 3 min 15 sec | 38 | 45 |
| Bleaching | 1 min 00 sec | 38 | 20 The overflow of bleaching solution was all introduced into the bleach-fixing tank. |
| Bleach-fixing | 3 min 15 sec | 38 | 30 |
| Water washing (1) | 40 sec | 35 | countercurrent piping system from (2) to (1) |
| Water washing (2) | 1 min 00 sec | 35 | 30 |
| Stabilization | 40 sec | 38 | 20 |
| Drying | 1 min 15 sec | 55 | |

*Replenishing amount was per 1.1 m of a 35 mm-width light-sensitive material (corresponding to 1 roll of 24 Ex.).

The composition of each processing solution is shown below.

(Color Developing Solution)

| | Tank Solution (g) | Replenisher (g) |
|---|---|---|
| Diethylenetriaminepentaacetic acid | 1.0 | 1.1 |
| 1-Hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-Ethyl-N-(β-hydroxyethyl)-amino]-2-methylaniline sulfate | 4.5 | 5.5 |
| Water to make | 1.0 l | 1.0 l |
| pH (adjusted by potassium hydroxide and sulfuric acid) | 10.05 | 10.10 |

(Bleaching Solution)

The tank solution and the replenisher were common.

| | (unit: g) |
|---|---|
| Ammonium ethylenediaminetetraacetato ferrate dihydrate | 20.0 |
| Ethylenediaminetetraacetate disodium salt | 10.0 |
| Ammonium bromide | 100.0 |
| Ammonium nitrate | 10.0 |
| Bleaching accelerator $(CH_3)_2N—CH_2—CH_2—S—S—CH_2—CH_2—N(CH_3)_2.2HCl$ | 0.005 mol |
| Aqueous ammonia (27%) | 15.0 ml |
| Water to make | 1.0 l |
| pH (adjusted by aqueous ammonia and nitric acid) | 6.3 |

(Bleach-Fixing Solution)

| | Tank Solution (g) | Replenisher (g) |
|---|---|---|
| Ammonium ethylenediaminetetraacetato ferrate dihydrate | 50.0 | — |
| Ethylenediaminetetraacetate disodium salt | 5.0 | 2.0 |
| Sodium sulfite | 12.0 | 20.0 |
| Aqueous solution of ammonium thiosulfate (700 g/l) | 240.0 ml | 400.0 ml |
| Aqueous ammonia (27%) | 6.0 ml | — |
| Water to make | 1.0 l | 1.0 l |
| pH (adjusted by aqueous ammonia and acetic acid) | 7.2 | 7.3 |

(Washing Water)

The tank solution and the replenisher were common.

Tap water was passed through a mixed bed column filled with an H-type strongly acidic cation exchange resin (Amberlite IR-120B, produced by Rhom and Haas) and an OH-type anion exchange resin (Amberlite IR-400, produced by the same company) to reduce the calcium and magnesium ion concentrations each to 3 mg/l or less and then thereto 20 mg/l of sodium isocyanurate dichloride and 0.15 g/l of sodium sulfate were added. The resulting solution had a pH of from 6.5 to 7.5.

(Stabilizing Solution)

The tank solution and the replenisher were common.

| | (unit: g) |
|---|---|
| Sodium p-toluenesulfinate | 0.03 |
| Polyoxyethylene-p-monononylphenyl ether (average polymerization degree: 10) | 0.2 |
| Disodium ethylenediaminetetraacetate | 0.05 |
| 1,2,4-Triazole | 1.3 |
| 1,4-Bis(1,2,4-triazol-1-ylmethyl)-piperazine | 0.75 |
| Water to make | 1.0 l |
| pH | 8.5 |

The processed samples each was measured on the density using a green filter. The sensitivity was shown by a relative value of the reciprocal of the exposure amount necessary for giving a density of (fog density+0.2).

For evaluating the storability, the following test was performed.

An unexposed sample was stored at 50° C. and a relative humidity of 60% for 2 weeks. This sample and the same sample but stored at 5° C. for 2 weeks were exposed for sensitometry at a color temperature of 4,800° K. through a continuous wedge for 1/100 seconds, then subjected to the above-described color development processing, and subsequently measured on the density. The difference between the fog value of the sample stored at 50° C. and the fog value of the sample stored at 5° C. (Δfog) was obtained. A larger plus value reveals a higher density.

The results are shown together in Table 2.

Respective samples were prepared and tested as above by controlling the samples to have the same gold atom content (the samples were also prepared such that the amount of the reactive sulfur group was equal to the amount of the reactive selenium group).

As apparently seen from Table 2, when the gold compound of the present invention is used, as compared with the case where chloroauric acid and a thiourea compound were separately added, high sensitivity and low fog were attained and surprisingly, the increase of fog during the storage was remarkably reduced.

Furthermore, as compared with the present invention, when Compound K-1 described in JP-A-4-267249 or Compound K-2 described in European Patent 915371 was used, the increase of fog during the storage could not be reduced.

From these, it is verified that when a thiourea complex of gold is used as in the present invention, photographic properties of higher level than those in conventional techniques where a thiourea compound and a gold compound have been heretofore added separately, can be obtained.

EXAMPLE 2

Layers each having the following composition were coated one on another on an undercoated cellulose triacetate cellulose film support to manufacture a multi-layer color light-sensitive material Sample 101.

(Compositions of Light-Sensitive Layers)

Main materials used for each layer are classified as follows.

ExC: cyan coupler

ExM: magenta coupler

ExY: yellow coupler

ExS: sensitizing dye

UV: ultraviolet absorbent

HBS: high boiling point organic solvent

H: gelatin hardener

ExF: dye

The numerals corresponding to respective components show coated amounts expressed by the unit of g/m$^2$. In the case of silver halide, a coated amount calculated in terms of silver is shown. Furthermore, the coated amounts of sensitizing dyes are expressed by mol per mol of silver halide in the same layer.

(Sample 101)

| | | |
|---|---|---|
| First Layer (First Antihalation Layer) | | |
| Black Colloidal Silver | as silver | 0.155 |
| Silver Iodobromide Emulsion P | as silver | 0.01 |
| Gelatin | | 0.87 |
| ExC-1 | | 0.002 |
| ExC-3 | | 0.002 |
| Cpd-2 | | 0.001 |
| HBS-1 | | 0 004 |
| HBS-2 | | 0.002 |
| Second Layer (Second Antihalation Layer) | | |
| Black Colloidal Silver | as silver | 0.066 |
| Gelatin | | 0.407 |
| ExM-1 | | 0.050 |
| ExF-1 | | $2.0 \times 10^{-3}$ |
| HBS-1 | | 0.074 |
| Solid Disperse Dye ExF-2 | | 0.015 |
| Solid Disperse Dye ExF-3 | | 0.020 |
| Third Layer (Interlayer) | | |
| Silver Iodobromide Emulsion O | as silver | 0.020 |
| ExC-2 | | 0.022 |
| Polyethyl acrylate latex | | 0.085 |
| Gelatin | | 0.294 |
| Fourth Layer (Low-Sensitivity Red-Sensitive Emulsion Layer) | | |
| Silver Iodobromide Emulsion A | as silver | 0.323 |
| ExS-1 | | $5.5 \times 10^{-4}$ |
| ExS-2 | | $1.0 \times 10^{-5}$ |
| ExS-3 | | $2.4 \times 10^{-4}$ |
| ExC-1 | | 0.109 |
| ExC-3 | | 0.044 |
| ExC-4 | | 0.072 |
| ExC-5 | | 0.011 |
| ExC-6 | | 0.003 |
| Cpd-2 | | 0.025 |
| Cpd-4 | | 0.025 |
| HBS-1 | | 0.17 |
| Gelatin | | 0.80 |
| Fifth Layer (Medium-Sensitivity Red-Sensitive Emulsion Layer) | | |
| Silver Iodobromide Emulsion B | as silver | 0.28 |
| Silver Iodobromide Emulsion C | as silver | 0.54 |
| ExS-1 | | $5.0 \times 10^{-4}$ |
| ExS-2 | | $1.0 \times 10^{-5}$ |
| ExS-3 | | $2.0 \times 10^{-4}$ |
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| Cpd-2 | | 0.036 |
| Cpd-4 | | 0.028 |
| HBS-1 | | 0.16 |
| Gelatin | | 1.18 |
| Sixth Layer (High-Sensitivity Red-Sensitive Emulsion Layer) | | |
| Silver Iodobromide Emulsion D | as silver | 1.47 |
| ExS-1 | | $3.7 \times 10^{-4}$ |
| ExS-2 | | $1 \times 10^{-5}$ |
| ExS-3 | | $1.8 \times 10^{-4}$ |
| ExC-1 | | 0.18 |
| ExC-3 | | 0.07 |
| ExC-6 | | 0.029 |

-continued

| | | |
|---|---|---|
| ExC-7 | | 0.010 |
| ExY-5 | | 0.008 |
| Cpd-2 | | 0.046 |
| Cpd-4 | | 0.077 |
| HBS-1 | | 0.25 |
| HBS-2 | | 0.12 |
| Gelatin | | 2.12 |
| Seventh Layer (Interlayer) | | |
| Cpd-1 | | 0.089 |
| Solid Disperse Dye ExF-4 | | 0.030 |
| HBS-1 | | 0.050 |
| Polyethyl acrylate latex | | 0.83 |
| Gelatin | | 0.84 |
| Eighth Layer (Layer for Imparting Interimage Effect to Red-Sensitive Layer): | | |
| Silver Iodobromide Emulsion E | as silver | 0.560 |
| ExS-6 | | $1.7 \times 10^{-4}$ |
| ExS-10 | | $4.6 \times 10^{-4}$ |
| Cpd-4 | | 0.030 |
| ExM-2 | | 0.096 |
| ExM-3 | | 0.028 |
| ExY-1 | | 0.031 |
| HBS-1 | | 0.085 |
| HBS-3 | | 0.003 |
| Gelatin | | 0.58 |
| Ninth Layer (Low-Sensitivity Green-Sensitive Emulsion Layer): | | |
| Silver Iodobromide Emulsion F | as silver | 0.39 |
| Silver Iodobromide Emulsion G | as silver | 0.28 |
| Silver Iodobromide Emulsion H | as silver | 0.35 |
| ExS-4 | | $2.4 \times 10^{-5}$ |
| ExS-5 | | $1.0 \times 10^{-4}$ |
| ExS-6 | | $3.9 \times 10^{-4}$ |
| ExS-7 | | $7.7 \times 10^{-5}$ |
| ExS-8 | | $3.3 \times 10^{-4}$ |
| ExM-2 | | 0.36 |
| ExM-3 | | 0.045 |
| HBS-1 | | 0.28 |
| HBS-3 | | 0.01 |
| HBS-4 | | 0.27 |
| Gelatin | | 1.39 |
| Tenth Layer (Medium-Sensitivity Green-Sensitive Emulsion Layer) | | |
| Silver Iodobromide Emulsion I | as silver | 0.45 |
| ExS-4 | | $5.3 \times 10^{-5}$ |
| ExS-7 | | $1.5 \times 10^{-4}$ |
| ExS-8 | | $6.3 \times 10^{-4}$ |
| ExC-6 | | 0.009 |
| ExM-2 | | 0.031 |
| ExM-3 | | 0.029 |
| ExY-1 | | 0.006 |
| ExM-4 | | 0.028 |
| HBS-1 | | 0.064 |
| HBS-3 | | $2.1 \times 10^{-3}$ |
| Gelatin | | 0.44 |
| Eleventh Layer (High-Sensitivity Green-Sensitive Emulsion Layer) | | |
| Silver Iodobromide Emulsion I | as silver | 0.19 |
| Silver Iodobromide Emulsion J | as silver | 0.80 |
| ExS-4 | | $4.1 \times 10^{-5}$ |
| ExS-7 | | $1.1 \times 10^{-4}$ |
| ExS-8 | | $4.9 \times 10^{-4}$ |
| ExC-6 | | 0.004 |
| ExM-1 | | 0.016 |
| ExM-3 | | 0.036 |
| ExM-4 | | 0.020 |
| ExM-5 | | 0.004 |
| ExY-5 | | 0.003 |
| ExM-2 | | 0.013 |
| Cpd-3 | | 0.004 |
| Cpd-4 | | 0.007 |
| HBS-1 | | 0.18 |
| Polyethyl acrylate latex | | 0.099 |
| Gelatin | | 1.11 |

-continued

| | | |
|---|---|---|
| Twelfth Layer (Yellow Filter Layer) | | |
| Yellow Colloidal Silver | as silver | 0.047 |
| Cpd-1 | | 0.16 |
| Solid Disperse Dye ExF-5 | | 0.020 |
| Solid Disperse Dye ExF-6 | | 0.020 |
| Oil-Soluble Dye ExF-7 | | 0.010 |
| HBS-1 | | 0.082 |
| Gelatin | | 1.057 |
| Thirteenth Layer (Low-Sensitivity Blue-Sensitive Emulsion Layer): | | |
| Silver Iodobromide Emulsion K | as silver | 0.18 |
| Silver Iodobromide Emulsion L | as silver | 0.20 |
| Silver Iodobromide Emulsion M | as silver | 0.07 |
| ExS-9 | | $4.4 \times 10^{-4}$ |
| ExS-10 | | $4.0 \times 10^{-4}$ |
| ExC-1 | | 0.041 |
| ExC-8 | | 0.012 |
| ExY-1 | | 0.035 |
| ExY-2 | | 0.71 |
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.41 |
| Fourteenth Layer (High-Sensitivity Blue-Sensitive Emulsion Layer): | | |
| Silver Iodobromide Emulsion N | as silver | 0.75 |
| ExS-9 | | $3.6 \times 10^{-4}$ |
| ExC-1 | | 0.013 |
| ExY-2 | | 0.31 |
| ExY-3 | | 0.05 |
| ExY-6 | | 0.062 |
| Cpd-2 | | 0.075 |
| Cpd-3 | | $1.0 \times 10^{-3}$ |
| HBS-1 | | 0.10 |
| Gelatin | | 0.91 |
| Fifteenth Layer (First Protective Layer) | | |
| Silver Iodobromide Emulsion O | as silver | 0.30 |
| UV-1 | | 0.21 |
| UV-2 | | 0.13 |
| UV-3 | | 0.20 |
| UV-4 | | 0.025 |
| F-18 | | 0.009 |
| HBS-1 | | 0.12 |
| HBS-4 | | $5.0 \times 10^{-2}$ |
| Gelatin | | 2.3 |
| Sixteenth Layer (Second Protective Layer) | | |
| H-1 | | 0.40 |
| B-1 (Diameter: 1.7 μm) | | $5.0 \times 10^{-2}$ |
| B-2 (Diameter: 1.7 μm) | | 0.15 |
| B-3 | | 0.05 |
| S-1 | | 0.20 |
| Gelatin | | 0.75 |

Furthermore, in order to improve storability, processability, pressure resistance, antifungal or microbicidal property, antistatic property and coatability, W-1 to W-5, B-4 to B-6, F-1 to F-18, iron salt, lead salt, gold salt, platinum salt, palladium salt, iridium salt, ruthenium salt and rhodium salt were appropriately added to each layer. Also, in the preparation of the samples, calcium in the form of an aqueous calcium nitrate solution was added in an amount of $8.5 \times 10^{-3}$ g to the coating solution for the eighth layer and in an amount of $7.9 \times 10^{-3}$ g to the coating solution for the eleventh layer, per mol of silver halide.

The AgI content, the grain size, the surface iodide content and the like of the emulsions shown above by abbreviations are shown in Table 4 below. The surface iodide content can be measured by XPS as follows. A sample is cooled to −115° C. in vacuum of $1 \times 10^{-9}$ torr and MgKα as a probe X ray is irradiated at an X-ray source voltage of 8 kV and an X-ray current of 20 mA. The measurement is performed for Ag3d5/2, Br3d and I3d5/2 electrons and the integrated intensity of peaks measured is corrected by the sensitivity factor. From the intensity ratio obtained, the surface iodide content is determined.

TABLE 4

| Name of Emulsion | Average Iodide Content (mol %) | Variation Coefficient related to Iodide Distribution Among Grains | Average Grain Size (equivalent-sphere diameter: μm) | Variation Coefficient of Equivalent-Sphere Diameter (%) | Projected Area Diameter (equivalent-circle diameter: μm) | Diameter/ Thickness Ratio | Surface Iodide Content (mol %) | Shape of Grain |
|---|---|---|---|---|---|---|---|---|
| A | 3.9 | 20 | 0.37 | 19 | 0.40 | 2.7 | 2.3 | tabular grain |
| B | 5.1 | 17 | 0.52 | 21 | 0.67 | 5.2 | 3.5 | " |
| C | 7.0 | 18 | 0.86 | 22 | 1.27 | 5.9 | 5.2 | " |
| D | 4.2 | 17 | 1.00 | 18 | 1.53 | 6.5 | 2.8 | " |
| E | 7.2 | 22 | 0.87 | 22 | 1.27 | 5.7 | 5.3 | " |
| F | 2.6 | 18 | 0.28 | 19 | 0.28 | 1.3 | 1.7 | " |
| G | 4.0 | 17 | 0.43 | 19 | 0.58 | 3.3 | 2.3 | " |
| H | 5.3 | 18 | 0.52 | 17 | 0.79 | 6.5 | 4.7 | " |
| I | 5.5 | 16 | 0.73 | 15 | 1.03 | 5.5 | 3.1 | " |
| J | 7.2 | 19 | 0.93 | 18 | 1.45 | 5.5 | 5.4 | " |
| K | 1.7 | 18 | 0.40 | 16 | 0.52 | 6.0 | 2.1 | " |
| L | 8.7 | 22 | 0.64 | 18 | 0.86 | 6.3 | 5.8 | " |
| M | 7.0 | 20 | 0.51 | 19 | 0.82 | 5.0 | 4.9 | " |
| N | 6.5 | 22 | 1.07 | 24 | 1.52 | 7.3 | 3.2 | " |
| O | 1.0 | — | 0.07 | — | 0.07 | 1.0 | — | uniform structure |
| P | 0.9 | — | 0.07 | — | 0.07 | 1.0 | — | uniform structure |

In Table 4, (1) Emulsions L to O were subjected to reduction sensitization using thiourea dioxide and thiosulfonic acid at the preparation of grains according to Example of JP-A-2-191938.

(2) Emulsions A to O were subjected to gold sensitization, sulfur sensitization and selenium sensitization in the presence of sodium thiocyanate and spectral sensitizing dyes described in respective light-sensitive layers according to Example of JP-A-3-237450.

(3) In the preparation of tabular grains, a low molecular weight gelatin was used according to Example of JP-A-1-158426.

(4) In the tabular grain, dislocation lines as described in JP-A-3-237450 were observed through a high-pressure electron microscope.

Preparation of Dispersion of Organic Solid Disperse Dye:

ExF-2 was dispersed by the following method. That is, 21.7 ml of water, 3 ml of a 5% aqueous solution of sodium p-octylphenoxyethoxyethoxyethanesulfonate and 0.5 g of a 5% aqueous solution of p-octylphenoxypolyoxyethylene ether (polymerization degree: 10) were placed in a 700-ml pot mill and thereto 5.0 g of Dye ExF-2 and 500 ml of zirconium oxide beads (diameter: 1 mm) were added. The contents were dispersed for 2 hours using a BO-Type vibration ball mill manufactured by Chuo Koki K.K. After the dispersion, the contents were taken out and added to 8 g of a 12.5% aqueous gelatin solution and thereafter, beads were removed by filtration to obtain a gelatin dispersion of the dye. The thus-obtained fine dye particles had an average particle diameter of 0.44 μm.

Solid dispersions of ExF-3, ExF-4 and ExF-6 were obtained in the same manner. The fine dye particles obtained had an average particle diameter of 0.24 μm, 0.45 μm, and 0.52 μm, respectively. ExF-5 was dispersed by the micro-precipitation dispersing method described in Example 1 of EP-A-549489. The average particle diameter was 0.06 μm.

The compounds used for forming each layer are shown below.

ExC-1

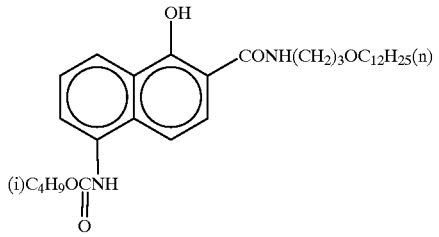

ExC-2

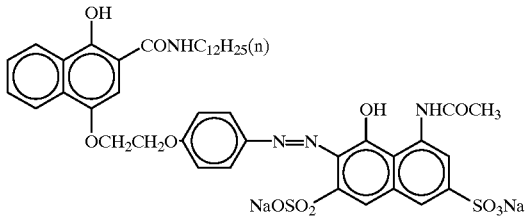

-continued
ExC-3
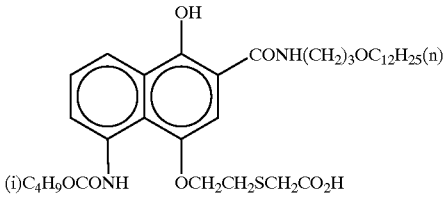
ExC-4
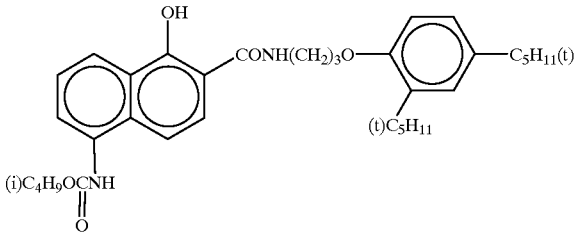
ExC-5
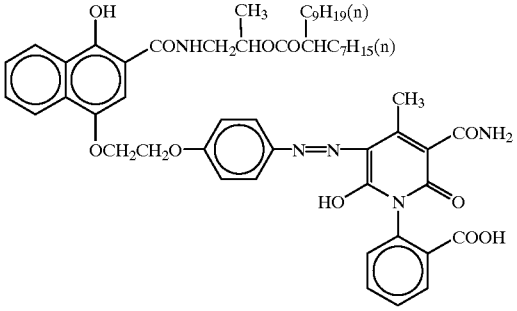
ExC-6
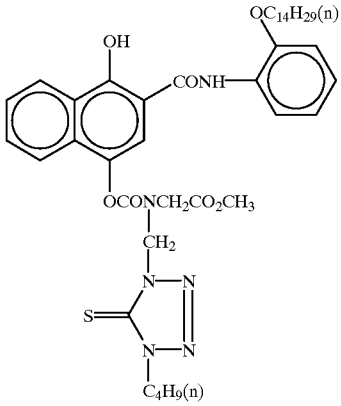
ExC-7
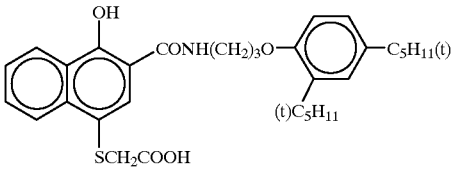
ExC-8
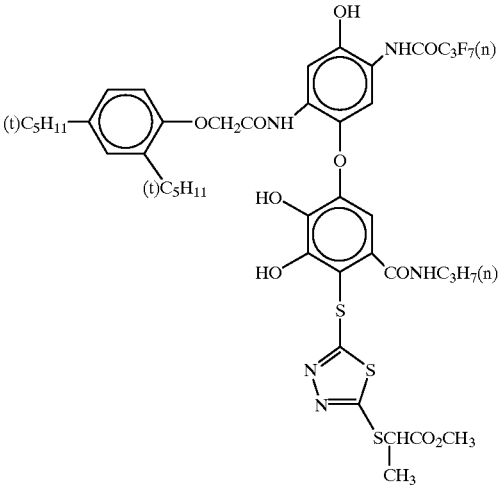
ExM-1
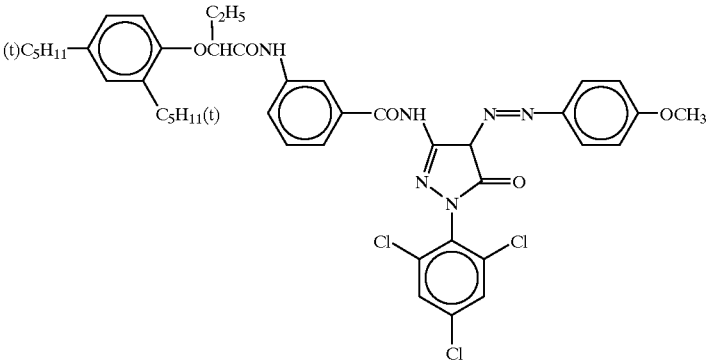

-continued
ExM-2
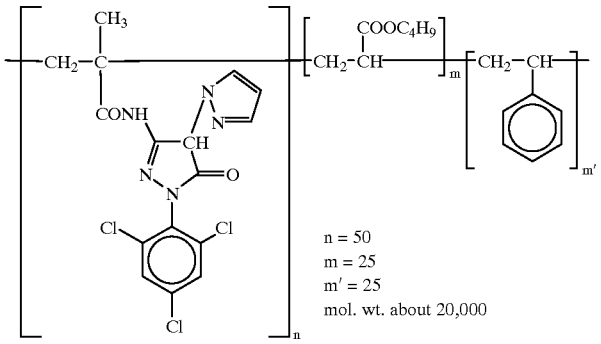
ExM-3
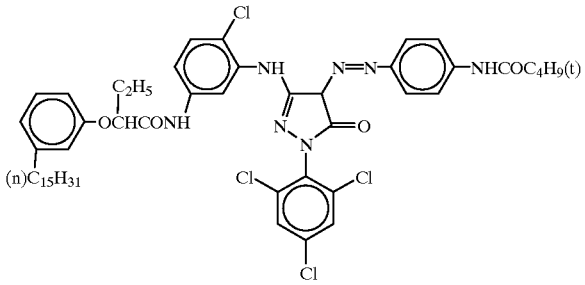
ExM-4
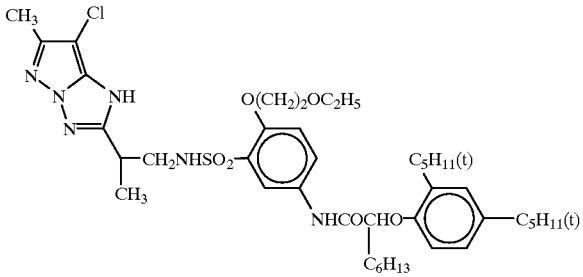
ExY-1
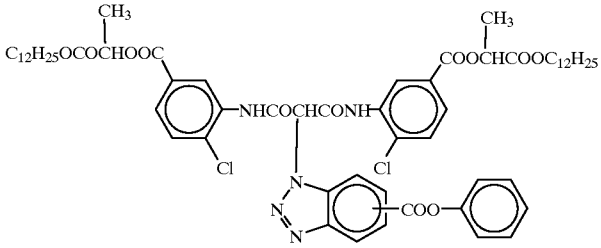
ExY-2
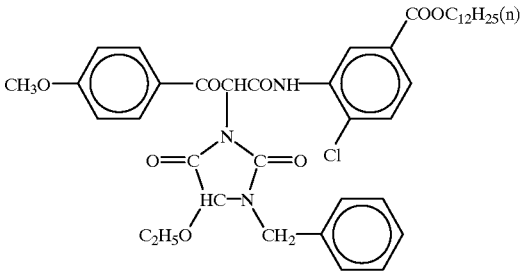
ExY-3
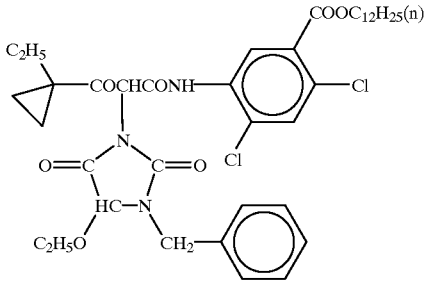
ExY-4
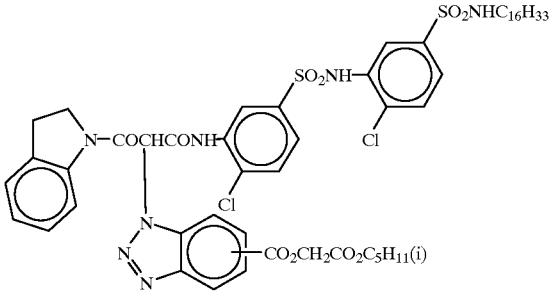
ExY-5
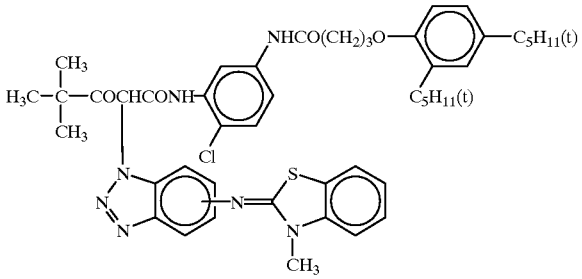
ExY-6
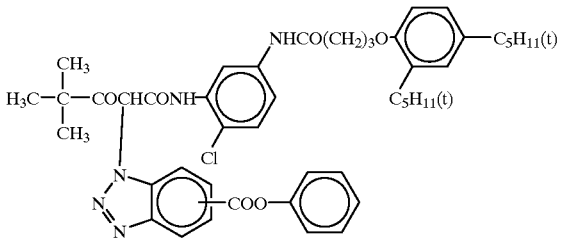
ExF-1
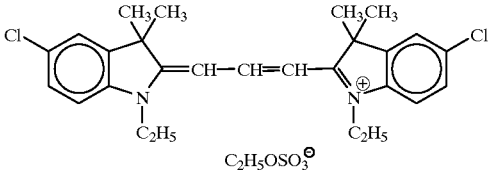

-continued
ExF-2
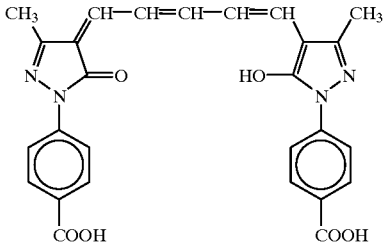
ExF-3
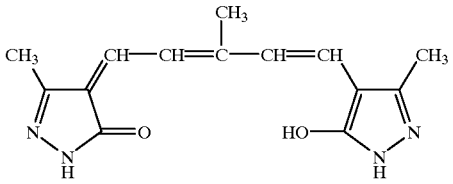
ExF-4
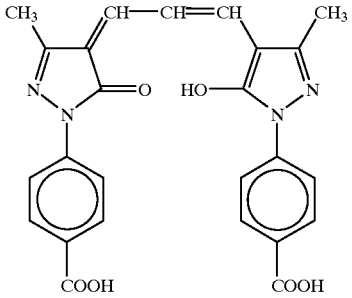
ExF-5
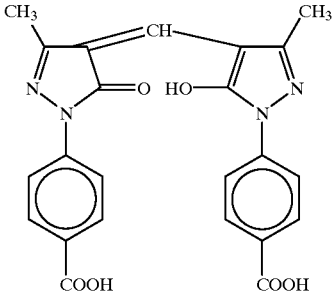
ExF-6
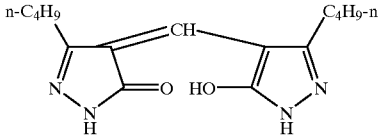
ExF-7
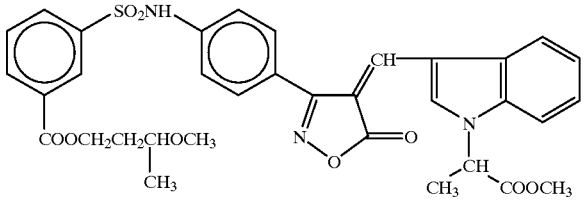
Cpd-1
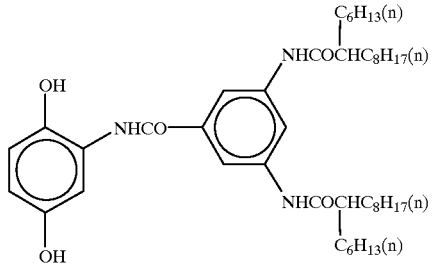
Cpd-2
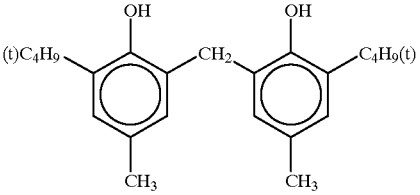
Cpd-3
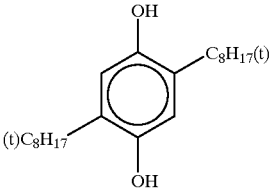
Cpd-4
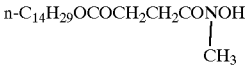
UV-1
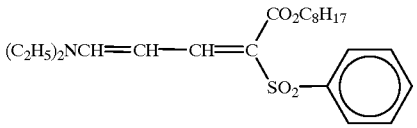
UV-2
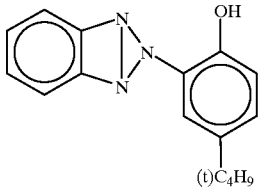

-continued
UV-4
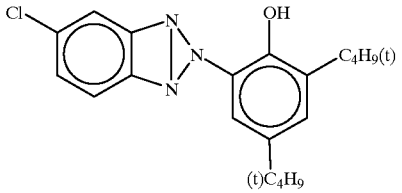
UV-3
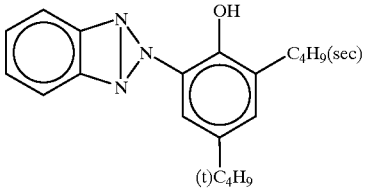
HBS-1
Tricresyl phosphate
HBS-2
Di-n-Butyl phosphate
HBS-3
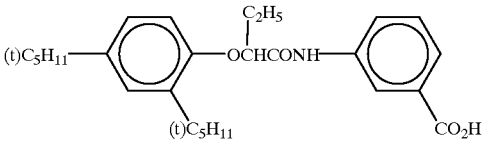
HBS-4
Tri(2-ethylhexyl) phosphate
ExS-1
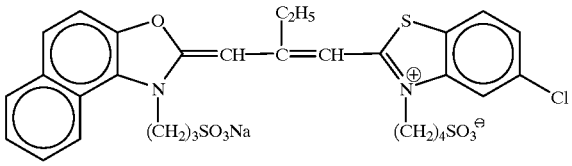
ExS-2
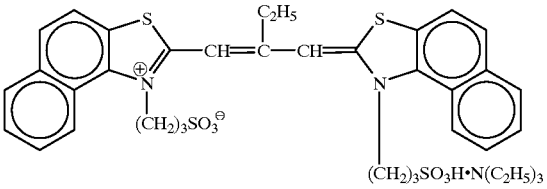
ExS-3
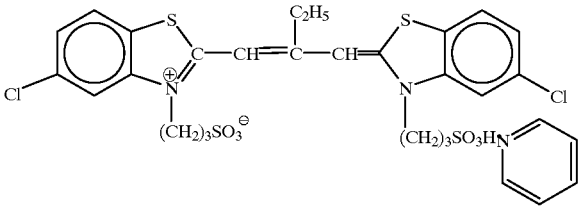
ExS-4
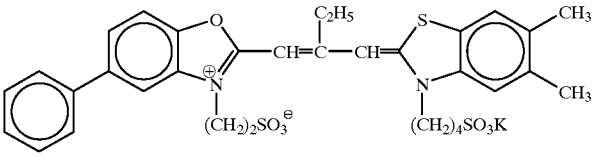
ExS-5
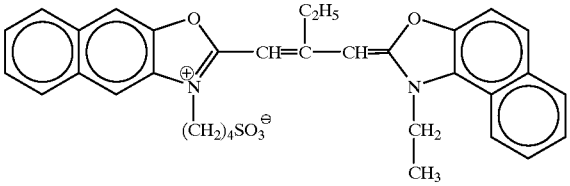
ExS-6
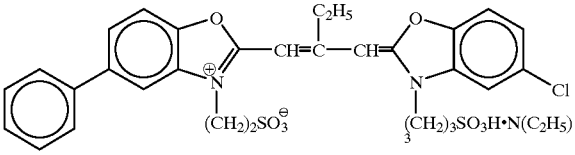
ExS-7
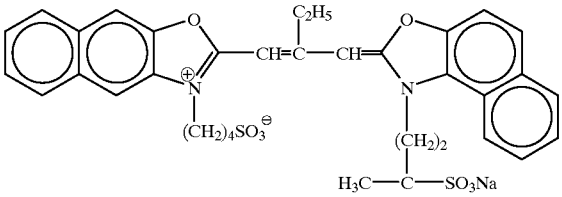
ExS-8
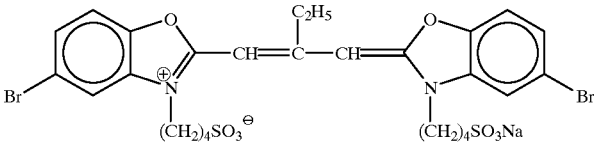
ExS-9
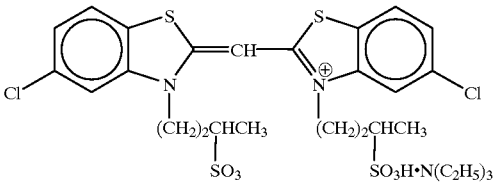
ExS-10
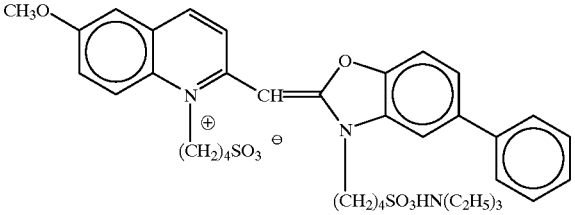

-continued
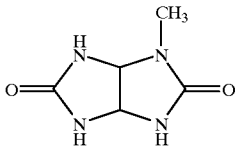
S-1
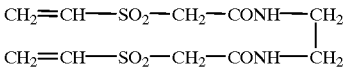
H-1
B-1
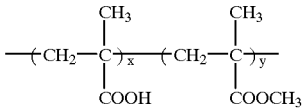
x/y = 10/90 (by weight)
average molecular weight:
about 35,000
B-2
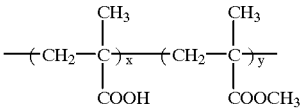
x/y = 40/60 (by weight)
average molecular weight:
about 20,000
B-3
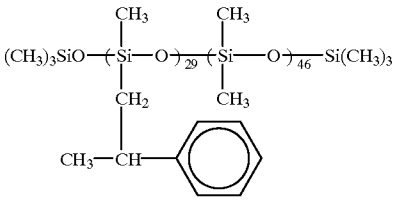
(by mole)
average molecular weight:
about 8,000
B-4
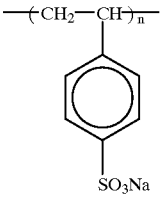
average molecular weight:
about 750,000
B-5
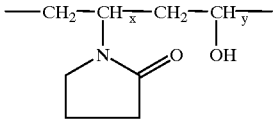
x/y = 70/30 (by weight)
average molecular weight:
about 17,000
B-6
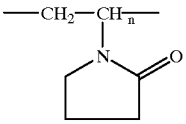
average molecular weight:
about 10,000
W-1
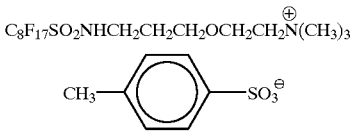
W-2
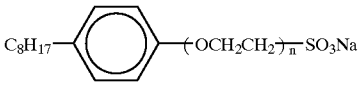
n = 2~4
W-3
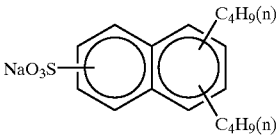
W-4
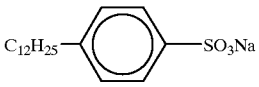
W-5
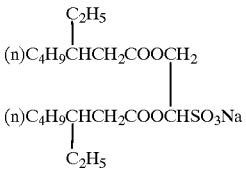
F-1
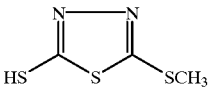

-continued
F-2
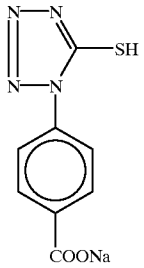
F-3
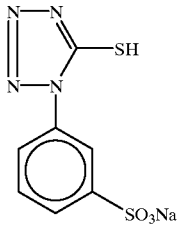
F-4
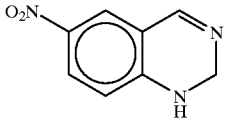
F-5
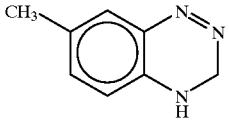
F-6
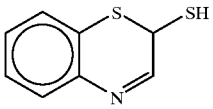
F-7
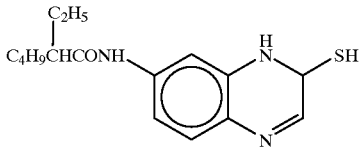
F-8
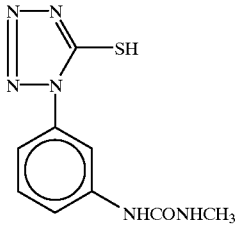
F-9
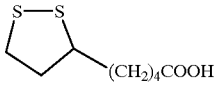
F-10
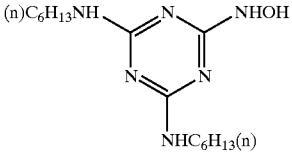
F-11
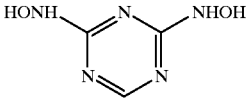
F-12
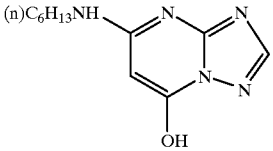
F-13
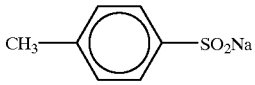
F-14
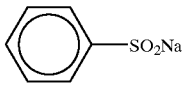
F-15
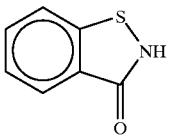
F-16
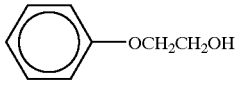
F-17
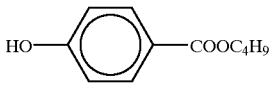

-continued

F-18

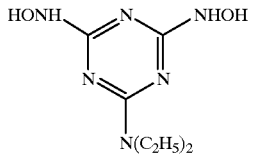

Preparation of Samples 102 to 104

Samples 102, 103 and 104 were prepared using Em-1AR, Em-2AR and Em-4AR, respectively, prepared in Example 1 in place of Silver Iodobromide Emulsion D in the sixth layer.

Each sample was developed by the following processing method.

(Processing Method)

| Step | Processing Time | Processing Temperature (° C.) |
|---|---|---|
| Color development | 3 min 15 sec | 38 |
| Bleach-fixing | 3 min 00 sec | 38 |
| Water washing | 30 sec | 24 |
| Fixing | 3 min 00 sec | 38 |
| Water washing (1) | 30 sec | 24 |
| Water washing (2) | 30 sec | 24 |
| Stabilization | 30 sec | 38 |
| Drying | 4 min 20 sec | 55 |

The composition of each processing solution is shown below.

| (Color Developer) | (unit: g) |
|---|---|
| Diethylenetriaminepentaacetic acid | 1.0 |
| 1-Hydroxyethylidene-1,1-diphosphonic acid | 2.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-Ethyl-N-(β-hydroxyethyl)amino]-2-methylaniline sulfate | 4.5 |
| Water to make | 1.0 l |
| pH (adjusted by potassium hydroxide and sulfuric acid) | 10.05 |

| (Bleach-Fixing Solution) | (unit: g) |
|---|---|
| Sodium ethylenediaminetetraacetato ferrate trihydrate | 100.0 |
| Ethylenediaminetetraacetate disodium salt | 10.0 |

-continued

| (Bleach-Fixing Solution) | (unit: g) |
|---|---|
| 3-Mercapto-1,2,4-triazole | 0.03 |
| Ammonium bromide | 140.0 |
| Ammonium nitrate | 30.0 |
| Aqueous ammonia (27%) | 6.5 ml |
| Water to make | 1.0 l |
| pH (adjusted by aqueous ammonia and nitric acid) | 6.0 |

(Fixing Solution)

| | |
|---|---|
| Ethylenediaminetetraacetic acid disodium salt | 0.5 |
| Ammonium sulfite | 20.0 |
| Aqueous solution of ammonium thiosulfate (700 g/l) | 295.0 ml |
| Acetic acid (90%) | 3.3 |
| Water to make | 1.0 l |
| pH (adjusted by aqueous ammonia and acetic acid) | 6.7 |

| (Stabilizing Solution) | (unit: g) |
|---|---|
| p-Nonylphenoxypolyglycidol (average polymerization degree of glycidol: 10) | 0.2 |
| Ethylenediaminetetraacetic acid | 0.05 |
| 1,2,4-Triazole | 1.3 |
| 1,4-Bis(1,2,4-triazol-1-ylmethyl)-piperazine | 0.75 |
| Hydroxyacetic acid | 0.02 |
| Hydroxyethyl cellulose (HEC SP-2000, produced by Dicel Kagaku) | 0.1 |
| 1,2-Benzisothiazolin-3-one | 0.05 |
| Water to make | 1.0 l |
| pH | 8.5 |

These processed samples each was measured on the density using a red filter, and the fog value, sensitivity and increase in fog during storage were evaluated in the same manner as in Example 1. The results are shown in Table 5 below. By the emulsion of the present invention (Em-4AR), even in the case of a multi-layer color light-sensitive material, high sensitivity and low fog were achieved and the increase of fog during storage was verified to be small.

TABLE 5

| Sample No. | Chloroauric Acid (mol/mol-Ag) | Gold Complex (mol/mol-Ag) | Sulfur Sensitizer (mol/mol-Ag) | Relative Sensitivity | Δfog | Relation to the Present Invention |
|---|---|---|---|---|---|---|
| 102 | $(3 \times 10^{-6})$ | — | 2-5 $(6 \times 10^{-6})$ | 100 | 0.17 | Comparison |

TABLE 5-continued

| Sample No. | Chloroauric Acid (mol/mol-Ag) | Gold Complex (mol/mol-Ag) | Sulfur Sensitizer (mol/mol-Ag) | Relative Sensitivity | Δfog | Relation to the Present Invention |
|---|---|---|---|---|---|---|
| 103 | — | HK-1 ($3 \times 10^{-6}$) | 2-5 ($6 \times 10^{-6}$) | 101 | 0.19 | Comparison |
| 104 | ($1.5 \times 10^{-6}$) | 1-4 ($1.5 \times 10^{-6}$) | ($3 \times 10^{-6}$) | 107 | 0.12 | Invention |

EXAMPLE 3

In Samples of Example 2, a support used in Sample 104 of Example 1 of U.S. Pat. No. 5,597,682 was used in place of the cellulose triacetate film support, namely, a PEN support having provided thereon a subbing layer and a back layer and being subjected to a heat treatment according to the method described in column 21, line 54 to column 23, line 29 of the patent publication. These samples each was loaded into a package unit with a photographing function and evaluated in the same manner as in Example 2.

As a result, similar results to those in Example 2 were obtained.

EXAMPLE 4

A color diffusion transfer light-sensitive material was prepared and processed in the same manner as Sample 102 in Example 1 of JP-A-7-333782 except that Emulsion Em-5AR prepared in Example 1 of the present invention was used in place of Em-D7 in the 8th, 15th and 22nd layers of the sample. Also, in the same manner as in the Example of JP-A-7-333782, a cover sheet was prepared and the sample was processed. The photographic properties obtained all were good.

EXAMPLE 5

Preparation of Em-1

Em-1 was prepared in the same manner as in Example 1.

Preparation of Em-1AR to Em-12AR

The temperature of Em-1 was elevated to 56° C. and thereto, the same Sensitizing Dyes 1, 2 and 3 as in Example 1 were added at a molar ratio of 58:36:1 and each in the form of solid fine dispersion. Subsequently, calcium nitrate was added in an amount of 1,800 ppm based on the emulsion. Thereafter, a gold compound of the present invention shown in Table 6, a ligand, thereof, hypo ($3\times10^{-6}$ mol/mol-Ag), potassium thiocyanate ($2.2\times10^{-3}$ mol/mol-Ag), chloroauric acid and N,N-dimethylselenourea were added and ripened to optimally perform the chemical sensitization. At the completion of chemical sensitization, disodium salt of 1-(p-carboxyphenyl)-5-mercaptotetrazole was added. Thus, Em-1AR to Em-12AR were prepared.

TABLE 6

| Sample No. | Chloroauric Acid (mol/mol-Ag) | Gold Complex (mol/mol-Ag) | Ligand of Gold Complex (mol/mol-Ag) | N,N-Dimethyl-selenourea (mol/mol-Ag) | Fog | Relative Sensitivity | Δfog | $\Delta S_{0.2}$ | Relation to Present Invention |
|---|---|---|---|---|---|---|---|---|---|
| Em-1AR | ($3 \times 10^{-6}$) | — | L-1 ($6 \times 10^{-6}$) | ($3 \times 10^{-6}$) | 0.35 | 100 | 0.38 | −25 | Comparison |
| Em-2AR | (") | | L-2 ($6 \times 10^{-6}$) | (") | 0.36 | 100 | 0.36 | −27 | " |
| Em-3AR | — | K-11 ($3 \times 10^{-6}$) | — | (") | 0.37 | 99 | 0.33 | −24 | " |
| Em-4AR | — | K-12 ($3 \times 10^{-6}$) | — | (") | 0.36 | 100 | 0.32 | −23 | " |
| Em-5AR | — | Compound A-1 ($3 \times 10^{-6}$) | — | (") | 0.31 | 104 | 0.28 | −10 | Invention |
| Em-6AR | — | Compound A-4 ($3 \times 10^{-6}$) | — | (") | 0.33 | 102 | 0.29 | −12 | " |
| Em-7AR | — | Compound A-13 ($3 \times 10^{-6}$) | — | (") | 0.32 | 101 | 0.29 | −12 | " |
| Em-8AR | — | Compound A-16 ($3 \times 10^{-6}$) | — | — | 0.33 | 103 | 0.28 | −14 | " |
| Em-9AR | — | Compound A-20 ($3 \times 10^{-6}$) | — | ($3 \times 10^{-6}$) | 0.31 | 105 | 0.27 | −11 | " |
| Em-10AR | — | Compound A-21 ($3 \times 10^{-6}$) | — | (") | 0.32 | 104 | 0.26 | −12 | " |
| Em-11AR | — | Compound A-22 ($3 \times 10^{-6}$) | — | (") | 0.32 | 103 | 0.27 | −11 | " |
| Em-12AR | — | Compound A-23 ($3 \times 10^{-6}$) | — | (") | 0.34 | 100 | 0.28 | −16 | " |

K-11

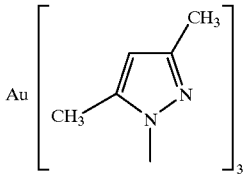

K-12

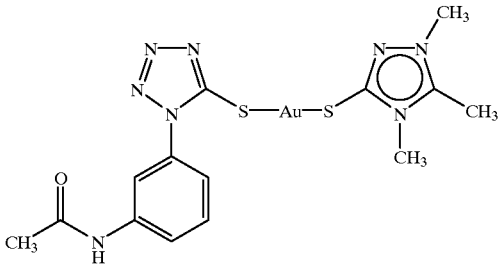

L-1

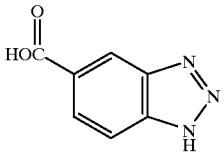

L-2

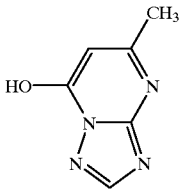

On a cellulose triacetate film support having provided thereon an undercoat layer, each of the emulsions subjected to chemical sensitization as above was coated with a protective layer under the coating conditions shown in Table 3 of Example 1 to prepare samples. These samples were processed in the same manner as in Example 1.

For evaluating the stability of a latent image generated after the exposure, the samples each was exposed in the same manner as above, stored at 40° C. and a relative humidity of 80% for 1 week, and then measured on the density together with the samples stored at 5° C. for 1 week after the exposure. From the density values obtained, the difference of sensitivity ($\Delta S_{0.2}$) was determined. A smaller value reveals that the latent image was more unstable and desensitized.

The results are shown together in Table 6.

Respective samples were prepared and tested as above by controlling the samples to have the same gold atom content (the samples were also prepared such that the amount of the reactive sulfur group was equal to the amount of the reactive selenium group).

As apparently seen from Table 6, when the gold compound of the present invention was used, the fog could be reduced while not incurring decrease of the sensitivity. Also, the increase of fog during storage could be prevented. Furthermore, the stability of the latent image generated by the exposure could be increased and even when aged after the exposure, the decrease of sensitivity could be prevented.

These results could not be obtained when chloroauric acid and a ligand were separately added (Em-1AR, Em-2AR).

When Compound K-11 described in JP-A-4-67032 or Compound K-12 described in U.S. Pat. No. 5,912,112 was added, the effect of preventing the increase of fog during storage may be observed, however, this was not in a sufficiently high level. Particularly, the effect of preventing the decrease of sensitivity after the exposure was low.

EXAMPLE 6

Sample 601 was prepared in the same manner as Sample 101 of Example 2.

Preparation of Samples 602 to 609

Samples 602 to 609 were prepared using Em-1AR to Em-8AR, respectively, prepared in Example 5 in place of Silver Iodobromide Emulsion D in the sixth layer.

Each sample was developed in the same manner as in Example 2.

These processed samples each was measured on the density using a red filter, and the relative sensitivity and decrease in the sensitivity after exposure were evaluated in the same manner as in Example 5. The results are shown in Table 7 below. By the emulsion of the present invention (Em-5AR to Em-8AR), even in the case of a multi-layer color light-sensitive material, high sensitivity could be maintained and the decrease of sensitivity after the exposure could be prevented. Furthermore, with respect to the increase in fog during storage, the same results as in Example 5 were obtained.

TABLE 7

| Sample No. | Chloroauric Acid (mol/mol-Ag) | Gold Complex (mol/mol-Ag) | Ligand of Gold Complex (mol/mol-Ag) | N,N-Dimethyl-selenourea (mol/mol-Ag) | Relative Sensitivity | $\Delta S_{0.2}$ | Relation to Present Invention |
|---|---|---|---|---|---|---|---|
| 602 | ($3 \times 10^{-6}$) | — | L-1 ($6 \times 10^{-6}$) | ($3 \times 10^{-6}$) | 100 | −20 | Comparison |
| 603 | ($3 \times 10^{-6}$) | — | L-2 ($6 \times 10^{-6}$) | ($3 \times 10^{-6}$) | 100 | −21 | Comparison |
| 604 | — | K-11 ($3 \times 10^{-6}$) | — | ($3 \times 10^{-6}$) | 98 | −18 | Comparison |
| 605 | — | K-12 ($3 \times 10^{-6}$) | — | ($3 \times 10^{-6}$) | 99 | −18 | Comparison |
| 606 | — | Compound A-1 ($3 \times 10^{-6}$) | — | ($3 \times 10^{-6}$) | 103 | −8 | Invention |
| 607 | — | Compound A-4 ($3 \times 10^{-6}$) | — | ($3 \times 10^{-6}$) | 101 | −10 | Invention |

TABLE 7-continued

| Sample No. | Chloroauric Acid (mol/mol-Ag) | Gold Complex (mol/mol-Ag) | Ligand of Gold Complex (mol/mol-Ag) | N,N-Dimethyl-selenourea (mol/mol-Ag) | Relative Sensitivity | $\Delta S_{0.2}$ | Relation to Present Invention |
|---|---|---|---|---|---|---|---|
| 608 | — | Compound A-13 ($3 \times 10^{-6}$) | — | ($3 \times 10^{-6}$) | 102 | −10 | Invention |
| 609 | — | Compound A-16 ($3 \times 10^{-6}$) | — | — | 102 | −12 | Invention |

EXAMPLE 7

In Samples of Example 6, a support used in Sample 104 of Example 1 of U.S. Pat. No. 5,597,682 was used in place of the cellulose triacetate film support, namely, a PEN support having provided thereon a subbing layer and a back layer and being subjected to a heat treatment according to the method described in column 21, line 54 to column 23, line 29 of the patent publication. These samples each was loaded into a package unit with a photographing function and evaluated in the same manner as in Example 6.

As a result, similar results to those in Example 6 were obtained.

EXAMPLE 8

A color diffusion transfer light-sensitive material was prepared in the same manner as Sample 102 in Example 1 of JP-A-7-333782 except that Emulsion Em-5AR prepared in Example 5 of the present invention was used in place of Em-D7 in the 8th, 15th and 22nd layers of the sample. Also, in the same manner as in the Example of JP-A-7-333782, a cover sheet was prepared and the sample was processed. The photographic properties obtained all were good.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having thereon at least one silver halide emulsion layer, which contains at least one compound represented by the following formula (1):

$$\{L^1—A^1—Y^1—Au(I)—Y^2—A^2—L^2\}X_n \quad (1)$$

wherein $L^1$ and $L^2$, which may be the same or different, each represents a group containing a labile sulfur group, labile selenium group or labile tellurium group capable of reacting with silver halide to produce silver sulfide, silver selenide or silver telluride, $Y^1$ and $Y^2$, which may be the same or different, each represents a coordination group capable of forming a complex with gold, $A^1$ and $A^2$, which may be the same or different, each represents a divalent linking group or a mere bond, X represents a counter salt necessary for neutralizing the electric charge of the compound, and n represents a number of from 0 to 1.

2. The silver halide photographic light-sensitive material as claimed in claim 1, wherein the compound represented by formula (1) is a symmetric compound where $L^1$ and $L^2$, $Y^1$ and $Y^2$, and $A^1$ and $A^2$ in respective pairs are the same.

3. The silver halide photographic light-sensitive material as claimed in claim 1, wherein in formula (1), $L^1—A^1—Y^1$ and/or $Y^2—A^2—L^2$ have a water-soluble group.

4. The silver halide photographic light-sensitive material as claimed in claim 1, wherein in formula (1), $L^1$ and $L^2$ each contains at least one bond of C═S, C═Se, C═Te, P═S, P═Se and P═Te.

5. The silver halide photographic light-sensitive material as claimed in claim 1, wherein formula (1) is represented by the following formula (2) or formula (3):

(2)

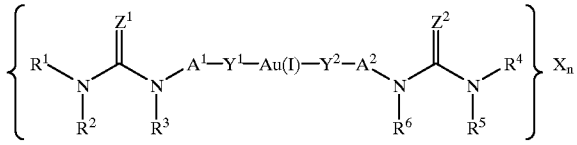

wherein $Z^1$ and $Z^2$ each represents sulfur atom, selenium atom or tellurium atom, $R^1$, $R^2$, $R^3$, $R^4$, $R^5$ and $R^6$ each represents hydrogen atom, an aliphatic hydrocarbon group, an aryl group, a heterocyclic group, an acyl group, an amino group, an alkoxy group, a hydroxy group or a carbamoyl group, provided that these may be combined to form a ring, and $Y^1$, $Y^2$, $A^1$, $A^2$, X and n have the same meanings as defined in formula (1);

(3)

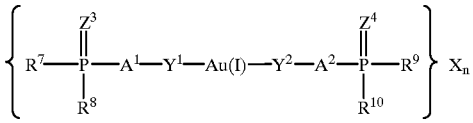

wherein $Z^3$ and $Z^4$ each represents sulfur atom, selenium atom or tellurium atom, $R^7$, $R^8$, $R^9$ and $R^{10}$ each represents an aliphatic hydrocarbon group, an aryl group, a heterocyclic group or an amino group, and $Y^1$, $Y^2$, $A^1$, $A^2$, X and n have the same meanings as defined in formula (1).

6. The silver halide photographic light-sensitive material as claimed in claim 5, wherein in formula (3), $Z^3$ and $Z^4$ each is selenium atom or tellurium atom.

7. The silver halide photographic light-sensitive material as claimed in claim 1, wherein in formula (1), $L^1$ and $L^2$ each is represented by the following formula (4):

$$L^3—A^3{}_m—L^4 \quad (4)$$

wherein $L^3$ and $L^4$ each represents a group having a labile sulfur group, a labile selenium group or a labile tellurium group capable of reacting with silver halide to produce silver sulfide, silver selenide or silver telluride, $A^3$ represents a divalent or trivalent linking group, and m represents an integer of 0 or more, provided that any one of $L^3$, $L^4$ and $A^3$ is combined with $A^1$ or $A^2$ in formula (1).

8. The silver halide photographic light-sensitive material as claimed in claim 7, wherein in formula (4), $L^3$ is a group containing a labile sulfur group capable of reacting with silver halide to produce silver sulfide, and $L^4$ is a group containing a labile selenium group capable of reacting with silver halide to produce silver selenide.

9. The silver halide photographic light-sensitive material as claimed in claim 7, wherein in formula (4), the labile sulfur group contained in $L^3$ and $L^4$ is a thiocarbonyl group (C═S) or a thiosulfonic acid group (—$SO_2S^-$), and the labile selenium group is a selenocarbonyl (C═Se) group or a phosphine selenide group (P═Se).

10. The silver halide photographic light-sensitive material as claimed in claim 1, wherein in formula (1), $Y^1$ and $Y^2$ each is an arylmercapto group or a heterocyclic mercapto group.

11. The silver halide photographic light-sensitive material as claimed in claim 1, wherein in formula (1), $Y^1$ and $Y^2$ each is a mercaptotetrazole group, a mercaptotriazole group or a mesoionic 3-mercapto-1,2,4-triazole group.

12. The silver halide photographic light-sensitive material as claimed in claim 1, wherein said silver halide emulsion comprises internal latent image-type direct positive silver halide grains each having a core/shell structure consisting of a chemically sensitized core and a chemically sensitized shell, and at least one of the compounds represented by formula (1) is present at the chemical sensitization of said core and/or shell.

13. The silver halide photographic light-sensitive material as claimed in claim 1, which has at least one blue-sensitive emulsion layer, at least one green-sensitive emulsion layer, at least one red-sensitive emulsion layer and at least one hydrophilic protective colloid layer on the support.

14. The silver halide photographic light-sensitive material as claimed in claim 1, which contains at least one silver halide emulsion where tabular silver halide grains having an aspect ratio of 8 or more occupy 60% or more of the entire projected area of silver halide grains contained in the silver halide emulsion containing at least one compound represented by formula (1).

15. The silver halide photographic light-sensitive material as claimed in claim 1, which contains a silver halide emulsion chemically sensitized with at least one compound represented by formula (1).

16. A silver halide photographic light-sensitive material comprising a support having thereon at least one silver halide emulsion layer, which contains at least one compound represented by the following formula (A-1):

$$\{B^1—Au(I)—B^2\}X_n \qquad \text{(A-1)}$$

wherein $B^1$ represents an azole compound which is linked to the Au via a nitrogen atom thereof and $B^2$ is selected from the group consisting of an azole compound, a compound containing at least one of a labile sulfur group, a labile selenium group, and a labile tellurium group each capable of reacting with silver halide to produce silver sulfide, silver selenide or silver telluride, a hydantoin compound, a phosphine compound, a halogen atom, a thioether compound, a mesoionic compound and $R^1$—S, $R^1$ represents an aliphatic hydrocarbon group, an aryl group, a heterocyclic group, an acyl group or a sulfonyl group, X represents a counter anion or cation necessary for neutralizing the electric charge of the compound, and n represents a number of from 0 to 1.

17. The silver halide photographic light-sensitive material as claimed in claim 16, wherein the azole compound represented by $B^1$ in formula (A-1) is represented by the following formula (A-2) or (A-3):

(A-2)

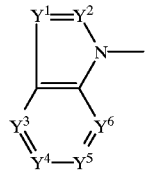

wherein $Y^1$ and $Y^2$ each independently represents nitrogen atom or C—$W^1$, $W^1$ represents hydrogen atom, an aliphatic hydrocarbon group, an aryl group, a heterocyclic group, a hydroxy group, an alkyloxy group, a halogen atom or a substituted or unsubstituted amino group, $Y^3$, $Y^4$, $Y^5$ and $Y^6$ each represents C—$W^2$ or nitrogen atom, and $W^2$ represents the same substituent as $W^1$, a carboxy group, a sulfo group, an amido group, an acyl group, a ureido group, a sulfonamido group, a sulfamoyl group, a carbamoyl group, a nitrile group or a nitro group, provided that $Y^1$ and $Y^2$, $Y^3$ and $Y^4$, $Y^4$ and $Y^5$, and $Y^5$ and $Y^6$ in respective pairs may be combined to form a ring;

(A-3)

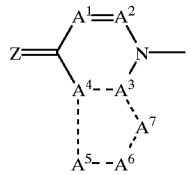

wherein $A^1$ and $A^2$ each represents nitrogen atom and/or C—$W^3$, $W^3$ represents hydrogen atom, an aliphatic hydrocarbon group, an aryl group, a heterocyclic group, a hydroxy group, an alkyloxy group, a substituted or unsubstituted amino group, a halogen atom, a nitrite group, a nitro group or a carboxy group, $A^3$ and $A^4$ each represents nitrogen atom, carbon atom or C—H, $A^5$, $A^6$ and $A^7$ each represents nitrogen atom or C—$W^4$, $W^4$ has the same meaning as $W^3$, the ring formed by $A^3$, $A^4$, $A^5$, $A^6$ and $A^7$ represents an unsaturated 5-membered ring containing two double bonds not adjacent to each other, Z represents oxygen atom or N—$W^5$, and $W^5$ represents hydrogen atom or an aliphatic hydrocarbon group, provided that $A^1$ and $A^2$, $A^5$ and $A^6$, and $A^6$ and $A^7$ in respective pairs may be combined to form a ring.

18. The silver halide photographic light-sensitive material as claimed in claim 17, wherein in formula (A-1), $B^2$ is a compound represented by formula (A-2) or (A-3).

19. The silver halide photographic light-sensitive material as claimed in claim 16, wherein in formula (A-1), $B^2$ is a compound containing at least one of a labile sulfur group, a labile selenium group and a labile tellurium group capable of reacting with silver halide to produce silver sulfide, silver selenide or silver telluride, a mesoionic compound or $R^1$—S.

20. The silver halide photographic light-sensitive material as claimed in claim 16, wherein in formula (A-1), at least one of $B^1$ and $B^2$ has at least one water-soluble group.

21. The silver halide photographic light-sensitive material as claimed in claim 16, which has at least one blue-sensitive emulsion layer, at least one green-sensitive emulsion layer, at least one red-sensitive emulsion layer and at least one hydrophilic protective colloid layer on the support.

22. The silver halide photographic light-sensitive material as claimed in claim 16, which contains at least one silver halide emulsion where tabular silver halide grains having an aspect ratio of 8 or more occupy 60% or more of the entire projected area of silver halide grains contained in the silver halide emulsion containing at least one compound represented by formula (A-1).

23. The silver halide photographic light-sensitive material as claimed in claim 16, which contains a silver halide emulsion chemically sensitized with at least one compound represented by formula (A-1).

24. The silver halide photographic light-sensitive material as claimed in claim 16, wherein the compound represented by formula (A-1) has one of the following formula A-1–A-23:

Compound A-1

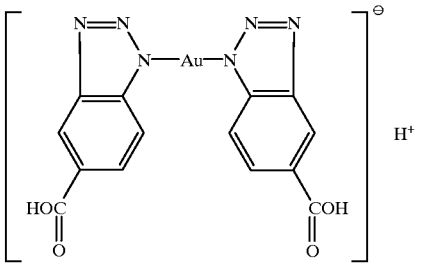

Compound A-2

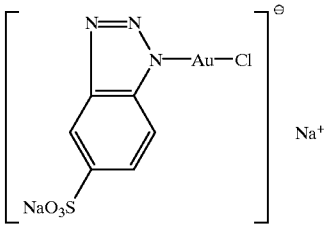

Compound A-3

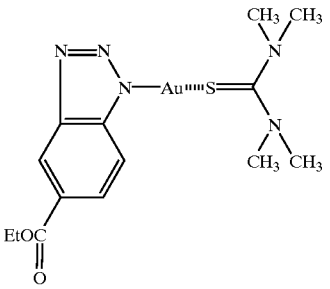

Compound A-4

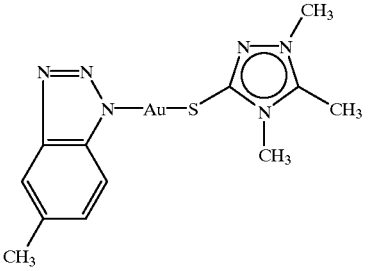

-continued

Compound A-5

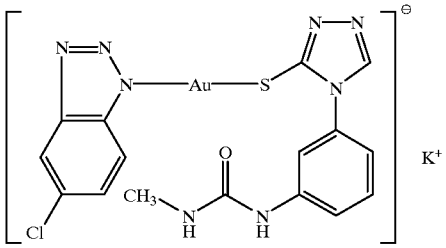

Compound A-6

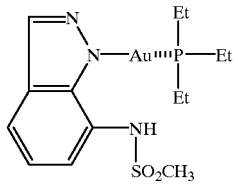

Compound A-7

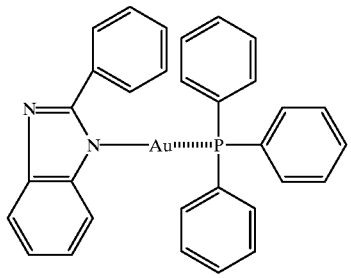

Compound A-8

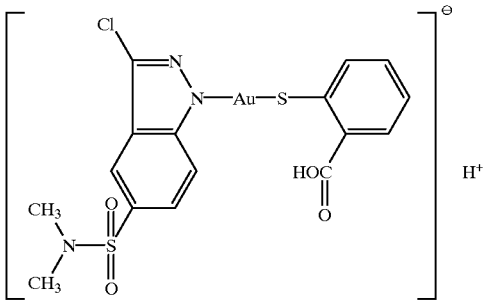

Compound A-9

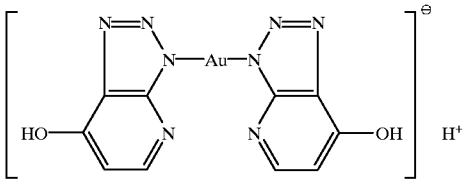

-continued
Compound A-10
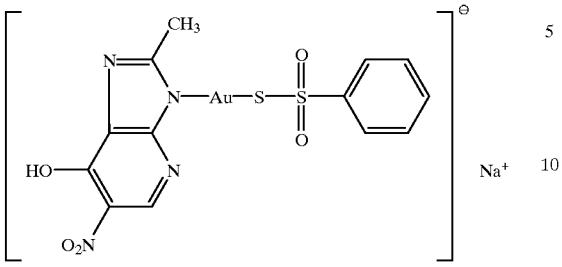
Compound A-11
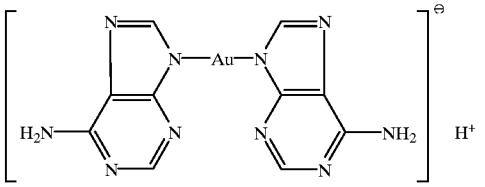
Compound A-12
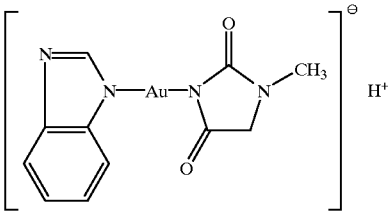
Compound A-13
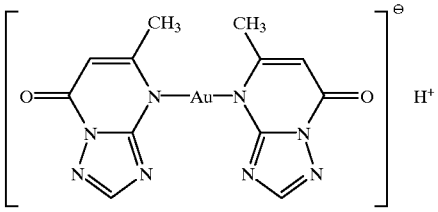
Compound A-14
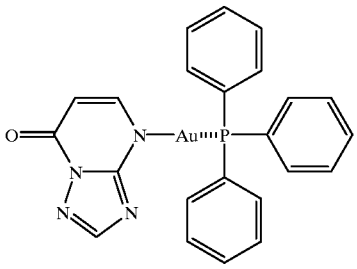
Compound A-15
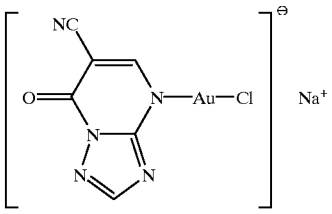
-continued
Compound A-16
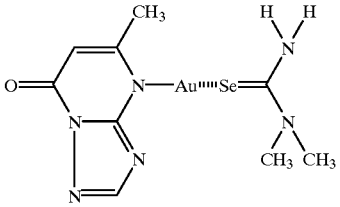
Compound A-17
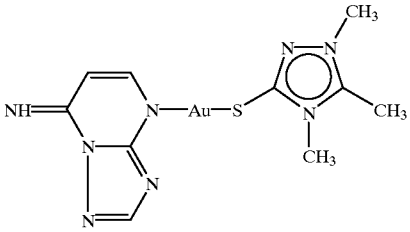
Compound A-18
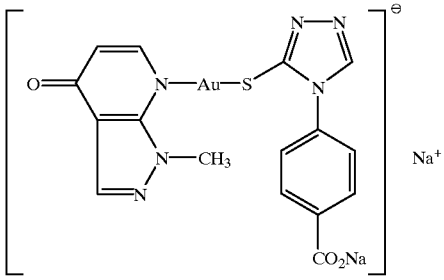
Compound A-19
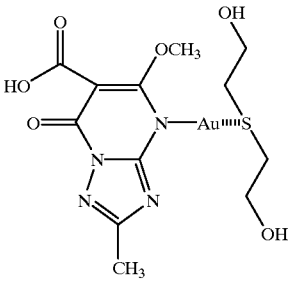
Compound A-20
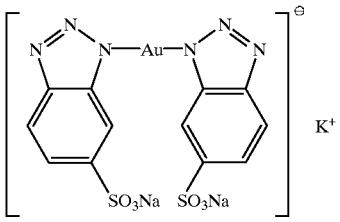
Compound A-21
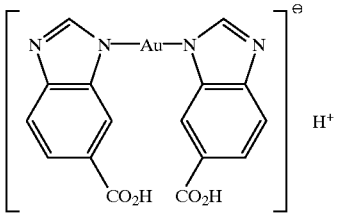

-continued

Compound A-22

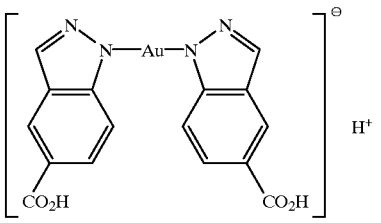

Compound A-23

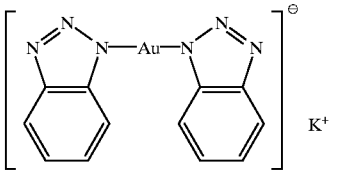

25. A silver halide emulsion chemically sensitized with at least one compound represented by formula (1):

$$\{L^1—A^1—Y^1—Au(I)—Y^2—A^2—L^2\}X_n \quad (1)$$

wherein $L^1$ and $L^2$, which may be the same or different, each represents a group containing a labile sulfur group, labile selenium group or labile tellurium group capable of reacting with silver halide to produce silver sulfide, silver selenide or silver telluride, $Y^1$ and $Y^2$, which may be the same or different, each represents a coordination group capable of forming a complex with gold, $A^1$ and $A^2$, which may be the same or different, each represents a divalent linking group or a mere bond, X represents a counter salt necessary for neutralizing the electric charge of the compound, and n represents a number of from 0 to 1.

26. A silver halide emulsion chemically sensitized with at least one compound represented by formula (A-1):

$$\{B^1—Au(I)—B^2\}X_n \quad (A\text{-}1)$$

wherein $B^1$ represents an azole compound which is linked to the Au via a nitrogen atom thereof and $B^2$ is selected from the group consisting of an azole compound, a compound containing at least one of a labile sulfur group, a labile selenium group, and a labile tellurium group each capable of reacting with silver halide to produce silver sulfide, silver selenide or silver telluride, a hydantoin compound, a phosphine compound, a halogen atom, a thioether compound, a mesoionic compound and $R^1$—S, $R^1$ represents an aliphatic hydrocarbon group, an aryl group, a heterocyclic group, an acyl group or a sulfonyl group, X represents a counter anion or cation necessary for neutralizing the electric charge of the compound, and n represents a number of from 0 to 1.

* * * * *